US012398942B2

(12) United States Patent
Park et al.

(10) Patent No.: US 12,398,942 B2
(45) Date of Patent: Aug. 26, 2025

(54) REFRIGERATOR

(71) Applicant: LG ELECTRONICS INC., Seoul (KR)

(72) Inventors: Kyungwook Park, Seoul (KR); Kihwang Kim, Seoul (KR); Jongkwon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 18/102,410

(22) Filed: Jan. 27, 2023

(65) Prior Publication Data

US 2023/0243572 A1 Aug. 3, 2023

(30) Foreign Application Priority Data

Jan. 28, 2022 (KR) ..... 10-2022-0013687

(51) Int. Cl.
*F25D 17/08* (2006.01)
*F25D 17/06* (2006.01)

(52) U.S. Cl.
CPC ..... *F25D 17/08* (2013.01); *F25D 17/065* (2013.01); *F25D 2317/062* (2013.01); *F25D 2317/0655* (2013.01); *F25D 2317/0661* (2013.01); *F25D 2317/0666* (2013.01); *F25D 2317/067* (2013.01)

(58) Field of Classification Search
CPC .. F25D 17/08; F25D 23/064; F25D 2317/067; F25D 2317/0671; F25D 2317/0672
See application file for complete search history.

(56) References Cited

U.S. PATENT DOCUMENTS 10,317,123 B1 * 6/2019 Wohlers ..... F25D 29/00
10,712,076 B2 * 7/2020 Luo ..... F25D 17/045
11,333,421 B2 * 5/2022 Song ..... F25D 17/045
(Continued)

FOREIGN PATENT DOCUMENTS

CN 107120905 9/2017
CN 210220332 U 3/2020
(Continued)

OTHER PUBLICATIONS

Extended European Search Report in European Appln. No. 23153951.1, mailed on Aug. 24, 2023, 13 pages.
(Continued)

*Primary Examiner* — Christopher R Zerphey
(74) *Attorney, Agent, or Firm* — Fish & Richardson P.C.

(57) ABSTRACT

A refrigerator includes an inner case including (i) a refrigerating case that defines a refrigerator compartment and (ii) a freezing case that defines a freezer compartment, an outer case disposed outside the inner case, a connection duct disposed between the inner case and the outer case, and a refrigerator compartment cold air supply duct that is detachably coupled to a rear inner surface of the refrigerating case and in fluid communication with the connection duct. The connection duct and the refrigerator compartment cold air supply duct are in communication on a rear surface of the refrigerating case with the refrigerating case interposed therebetween, thereby reducing the area occupied by the refrigerator compartment cold air supply duct disposed in the rear inner surface of the refrigerator compartment.

24 Claims, 52 Drawing Sheets

(56) References Cited

U.S. PATENT DOCUMENTS

| | | | | |
|---|---|---|---|---|
| 11,530,865 | B2 * | 12/2022 | Hong | F25D 23/061 |
| 11,692,756 | B2 * | 7/2023 | Park | F25D 11/02 62/427 |
| 2013/0000333 | A1 | 1/2013 | Kim et al. | |
| 2017/0108264 | A1 | 4/2017 | Luo | |
| 2017/0115048 | A1 * | 4/2017 | Zardo | F25C 5/22 |
| 2020/0326116 | A1 | 10/2020 | Hong et al. | |
| 2023/0152025 | A1 | 5/2023 | Kim et al. | |

FOREIGN PATENT DOCUMENTS

| | | | |
|---|---|---|---|
| CN | 111397275 | B | 7/2020 |
| CN | 113154754 | | 7/2021 |
| KR | 19990072299 | | 9/1999 |
| KR | 20070010547 | | 1/2007 |
| KR | 20140019565 | A | 2/2014 |
| KR | 20190121437 | A | 10/2019 |
| KR | 20200121110 | | 10/2020 |
| KR | 20210053173 | | 5/2021 |
| WO | WO 2021210738 | A1 | 10/2021 |

OTHER PUBLICATIONS

Partial European Search Report in European Appln. No. 23153951.1, mailed on May 22, 2023, 13 pages.

Extended European Search Report in European Appln. No. 23153951.1, mailed on May 9, 2025, 7 pages.

* cited by examiner

REFRIGERATOR

CROSS-REFERENCE TO RELATED APPLICATION

This application claims priority to and the benefit of Korean Patent Application No. 10-2022-0013687, filed on Jan. 28, 2022, the disclosure of which is incorporated herein by reference in its entirety.

BACKGROUND

Technical Field

The present disclosure relates to a refrigerator, more particularly, a refrigerator that may increase an inner volume of a refrigerator compartment.

Background of the Disclosure

A refrigerator is a home appliance configured to supply cold air generated by refrigerant circulation to a storage chamber (e.g., a refrigerator compartment or a freezer compartment) to keep various kinds of storage targets fresh for a long time in the storage chamber.

A refrigerator compartment refrigerates the storing targets and the freezer compartment freezes the storing target. Due to this structure, the amount of supplied cold air needs to be adjusted differently so that the refrigerator compartment and the freezer compartment may maintain different temperatures.

A refrigerant circulating in the order of a compressor, a condenser, an evaporator and a compressor flows into an evaporator, and the liquid refrigerant is vaporized into gaseous refrigerant. During this process, the cold air supplied to the refrigerator compartment and the freezer compartment may be generated by taking heat from the inside of the refrigerator.

Accordingly, separate evaporators for generating cold air may be provided in the refrigerator compartment and the freezer compartment, respectively, so that the cold air generated by the independent evaporators may be supplied to the compartments, respectively.

When the separate evaporators are provided in the refrigerator compartment and the freezer compartment, respectively, independent cold air supply systems, each of which includes an evaporator for generating cold air, a grill fan assembly for blowing the generated cold air to the refrigerator compartment or the freezer compartment, and a cold air supply duct having a cold air path to supply the cold air, should be also be provided in the refrigerator compartment and the freezer compartment, respectively.

When the separate cold air supply systems mentioned above are provided in the refrigerator compartment and the freezer compartment, respectively, the cold air supplied to the refrigerator and freezer compartments, which require different temperatures and amounts of cold air, may be independently controlled.

However, when the separate cold air systems mentioned above are provided in the refrigerator compartment and the freezer compartment, respectively, there is a problem in that inner volumes of the refrigerator compartment and the freezer compartment are reduced as much as the areas occupied by the cold air supply systems.

For example, the refrigerator compartment has a shape protruding inward so as to sufficiently secure an area in which the separate cold air supply system is disposed at a rear side of the refrigerator compartment.

As described above, as the area of the region protruding toward the inside of the refrigerator compartment increases more and more, the inner volume of the refrigerator compartment is inevitably reduced by the increased amount.

In addition, the cold air supply duct for supplying the cold air generated by the evaporator to the refrigerator compartment may be formed to have a predetermined thickness to cover the rear surface of the refrigerator compartment.

The cold air supply duct may be disposed on an inner rear surface of the refrigerator compartment. The inner volume of the refrigerator compartment is inevitably reduced as much as the area occupied by the cold air supply duct having the predetermined thickness mounted on the inner rear surface of the refrigerator compartment.

In particular, the cold air supply duct having the cold air path through which cold air passes may include an insulating material having a sufficient thickness to prevent heat exchange with the refrigerator compartment in a relatively humid environment.

To increase the inner volume of the refrigerator compartment, it is necessary to reduce the total area and thickness occupied by the cold air supply duct disposed in the rear surface of the refrigerator compartment.

Meanwhile, the cold air generated by one evaporator may be supplied to the refrigerator compartment and the freezer compartment, without the separate evaporators provided in the refrigerator compartment and the freezer compartment, respectively.

Accordingly, the evaporator for generating cold air and the grill fan assembly for blowing the generated cold air to the refrigerator compartment and the freezer compartment may be disposed in the freezer compartment.

The cold air supply duct having the cold air path to supply the cold air generated in the freezer compartment to the refrigerator compartment may be disposed inside the refrigerator compartment.

In this instance, since the cold air needs to be supplied to the refrigerator and freezer compartments that require different temperatures and amounts of cold air through one evaporator and one grill fan assembly, a flow path opening/closing damper may be further provided in the refrigerator compartment to selectively block the cold air supplied to the refrigerator compartment.

For example, the amount of the cold air supplied to the refrigerator compartment may be adjusted by selectively opening and closing the flow path opening/closing damper disposed in the cold air supply duct.

Accordingly, the refrigerator compartment may have a shape protruding inwardly to sufficiently secure an area in which the flow path opening/closing module is disposed on the rear surface of the refrigerator compartment.

In particular, when the refrigerator compartment is partitioned off into a plurality of spaces that require different temperatures, a plurality of flow path opening/closing modules need to be provided to adjust the mounts of the cold air supplied to the divided spaces, respectively. Accordingly, the refrigerator compartment has a shape further protruding inwardly.

When the flow path opening/closing module is disposed in the refrigerator compartment, the shape protruding inward with respect to the refrigerator compartment may occupy a large area.

As described above, as the area of the region protruding to the inside of the refrigerator compartment increases more and more, the inner volume of the refrigerator compartment is inevitably reduced by that increased amount.

The cold air flow path to the refrigerator compartment from the freezer compartment is blocked by closing the flow path opening/closing damper disposed in the refrigerator compartment, the cold air inside the freezer compartment may be replaced with the cold air inside the relatively humid refrigerator compartment based on the flow path opening/closing damper.

In this instance, since the flow path opening/closing damper is positioned in the refrigerator compartment, the cold air inside the freezer compartment could rise to a rear surface of the refrigerator compartment having a relatively humid environment, which might cause a problem of dew condensation near the flow path opening/closing damper.

To solve the problem of dew condensation, an insulating material may be reinforced to prevent heat exchange between the cold air of the freezer compartment, which rises up to the area of the flow path opening/closing damper, and the refrigerator compartment.

However, in this instance, there could be another problem in that the inner volume of the refrigerator compartment is additionally reduced by the added thickness of the reinforced insulating material.

Recently, an ice-making chamber may be provided in a refrigerator compartment door so that a user can take out ice without opening the freezer compartment to quickly and easily take out ice without loss of cold air from the freezer compartment.

In general, the cold air supplied to the ice-making chamber of the refrigerator compartment door may be supplied by an evaporator disposed in a rear surface of the freezer compartment to generate cold air.

In order to supply the cold air generated by the evaporator disposed in the rear surface of the freezer compartment to the ice-making chamber disposed in a front surface of the refrigerator, a side cold air supply duct passing through one lateral surface of the refrigerator may be connected to the ice-making chamber to supply cold air.

Since the cold air supplied to the ice-making chamber has a very low temperature, the area near the lateral surface of the refrigerator, through which the side cold air supply duct passes, may have a large temperature difference from another area near the other lateral surface through which the side cold air supply duct does not passes.

As described above, when the temperature difference between the area near one lateral surface of the refrigerator and the area near the other lateral surface becomes large, the overall cold air balance of the refrigerator might deteriorate. Accordingly, there might be difficulties in balancing the overall cold air of the refrigerator and providing an insulation function.

In case of a conventional refrigerator, a suction fan and a filter may be separately installed in a rear surface of a refrigerator compartment to deodorize the refrigerator compartment. The suction fan may be operated to suck and allow cold air inside the refrigerator to pass through the filter, thereby obtaining an effect of deodorizing the refrigerator compartment.

In this instance, to obtain the effect of deodorizing the refrigerator compartment, there is inconvenience of installing a separate suction fan in the refrigerator compartment. If the suction malfunctions, there could be a problem in that the suction fan needs to be repaired separately.

Since a separate space in which the function fan is inserted has to be sufficiently secured in the rear surface of the refrigerator, the area in which the suction fan is installed could greatly protrude inward inside the refrigerator compartment only to reduce the inner volume of the refrigerator.

In addition to the suction fan and filter for deodorizing the refrigerator compartment, a separate suction fan and a separate filter for deodorizing the freezer compartment must be provided in the freezer compartment. There are also a problem of inconvenience of separate management and installation and another problem of inner volume reduction of the freezer compartment.

SUMMARY

One objective of the present disclosure is to provide a refrigerator that may increase an inner volume of a refrigerator compartment by reducing an area occupied by a refrigerator compartment cold air supply duct disposed in an inner rear surface of the refrigerator compartment.

Another objective of the present disclosure is to provide a refrigerator that may increase an inner volume of a refrigerator compartment by reducing an area of a protrusion protruding inward inside the refrigerator compartment by reducing the number of components related to a cold air supply system disposed on an outer rear surface of the refrigerator compartment.

A further objective of the present disclosure is to provide a refrigerator including a new cold air supply system configured to supply cold air generated by one evaporator disposed in a freezer compartment to a refrigerator compartment having a plurality of divided spaces, the freezer compartment and even an ice-making chamber.

A still further objective of the present disclosure is to provide a refrigerator that may enhance workability by quickly and easily combining a refrigerator compartment cold air supply duct formed in a module assembly shape to an inner surface of the refrigerator compartment.

A still further objective of the present disclosure is to provide a refrigerator that may reduce dew condensation near a flow path opening/closing damper configured to selectively block the cold air generated by an evaporator disposed in a freezer compartment from being supplied to a refrigerator compartment.

A still further objective of the present disclosure is to provide a refrigerator that may balance overall cold air therein, when an ice-making chamber is provided in a front surface of the refrigerator.

A still further objective of the present disclosure is to provide a refrigerator that may increase an inner volume of a refrigerator compartment by reducing an area protruding toward the inside of the refrigerator compartment, while there is no need to install a separate suction fan.

Aspects according to the present disclosure are not limited to the above ones, and other aspects and advantages that are not mentioned above can be clearly understood from the following description and can be more clearly understood from the embodiments set forth herein.

A refrigerator according to an embodiment of the present disclosure is characterized in that a cold air flow path formed by communication between a connection duct and a refrigerator compartment cold air supply duct is extended in upward and downward direction.

The refrigerator may include an inner case comprising a refrigerating case defining a refrigerator compartment and a freezing case defining a freezer compartment; an outer case disposed outside the inner case; an insulating member and a connection duct that are disposed in a space formed between the inner case and the outer case; and a refrigerator compartment cold air supply duct detachably coupled to a rear inner surface of the refrigerating case to be in communication with the connection duct. A cold air flow path formed by communication between the connection duct and the refrigerator compartment cold air supply duct may be extended in upward and downward direction.

The connection duct may be directly in contact with the insulating material.

The cold air flow path may have a linear shape.

A front surface of the refrigerator compartment cold air supply duct and a front surface of the connection duct may include respective predetermined areas parallel to each other.

A refrigerator compartment cold air supply communication hole may be disposed on a rear surface of the inner case and opened upward.

A rear projected portion may be projected from a rear surface of the refrigerating case toward an inside of the refrigerating case, and the cold air supply communication hole may be provided on an upper surface of the rear projected portion.

At least predetermined area of the connection duct may be inserted in the rear projected portion from an outer surface of the refrigerating case.

The connection duct may be secured to the refrigerating case to support a predetermined area of a rear surface of the rear projected portion.

The connection duct may include a rear extended portion vertically extended along a rear end of an upper surface of the connection duct, and the rear extended portion may be secured to the refrigerating case to support a rear surface of the refrigerating case.

An upper surface of the connection duct and a lower surface of the refrigerator compartment cold air supply duct may include inclined surfaces, respectively, and the upper surface of the connection duct may face the lower surface of the refrigerator compartment cold air supply duct.

The inclined surface may descend toward a front surface of the refrigerator compartment, and the upper surface of the connection duct and the lower surface of the refrigerator compartment cold air supply duct may be coupled to each other by sliding.

A duct inserting groove may be provided on an upper surface of the refrigerating case and an upper area of the refrigerator compartment cold air supply duct may be partially inserted in the duct inserting groove to be secured.

The duct inserting groove may be disposed along an area in which an upper surface and a rear surface of the refrigerating case meet each other.

The refrigerator compartment cold air supply duct may include a duct insulating portion in which a cold air flow path is formed; and a duct sheet coupled to the duct insulating portion in a rear area of the duct insulating portion, and the duct sheet has a thickness that is smaller than a thickness of the duct insulating portion.

One end of the connection duct may be connected to the freezer compartment and the other end of the connection duct may be connected to the refrigerator compartment to pass through a center of the refrigerator compartment in a left-right direction. the width of the cold air flow path may increase from one end to the other end of the connection duct.

The refrigerator may further include a door configured to open and close the refrigerator compartment; an ice-making chamber provided in the door; and an ice-making chamber cold air supply duct configured to supply cold air to the ice-making chamber. The ice-making chamber cold air supply duct may be disposed to pass through the other lateral surface facing one lateral surface of the refrigerator compartment adjacent to the connection duct.

The refrigerator compartment cold air supply duct may include a first refrigerator compartment cold air flow path and a second refrigerator compartment cold air flow path that may be configured to branch the cold air guided from the connection duct. The first refrigerator compartment cold air flow path may have a flow path width that is wider than the second refrigerator compartment cold air flow path. The second refrigerator compartment cold air flow path may be disposed closer to the ice-making chamber cold air supply duct than the first refrigerator compartment cold air flow path.

The refrigerator may further comprise a refrigerator compartment cold air returning duct configured to return cold air inside the refrigerator compartment. One end and the other end of the refrigerator compartment cold air returning duct may be connected to the refrigerator compartment and the freezer compartment, respectively. One end and the other end of the refrigerator compartment cold air returning duct may be positioned to pass through a center of the refrigerator compartment and a center of the freezer compartment with respect to a left-right direction.

The refrigerator compartment may include a first storage chamber and a second storage chamber. The refrigerator compartment may further include a second storage chamber cold air supply duct disposed on an outer surface of the refrigerating case and configured to supply cold air to the second storage chamber. The connection duct and the second storage chamber cold air supply duct may be disposed in an area of the refrigerator compartment cold air returning duct, and the ice-making chamber cold air supply duct may be disposed in the other area of the refrigerator compartment cold air returning duct with respect to a left-right direction.

The second storage chamber cold air supply duct may be directly in contact with the insulating material.

A first storage chamber flow path opening/closing damper configured to selectively cut off the cold air supplied to the connection duct and a second storage chamber flow path opening/closing damper configured to selectively cut off the cold air supplied to the second storage chamber cold air supply duct may be provided in the freezer compartment.

The refrigerator compartment cold air supply duct may include a refrigerator compartment cold air main outlet hole configured to discharge cold air to the refrigerator compartment; and a refrigerator compartment cold air auxiliary outlet hole. A refrigerator compartment cold air auxiliary outlet guide comprising a refrigerator compartment filter may be provided on a front surface of the refrigerator compartment cold air auxiliary outlet hole, and the cold air supplied through the refrigerator compartment cold air auxiliary outlet hole may pass through the refrigerator compartment filter.

The refrigerator compartment cold air auxiliary outlet guide may further include an insulating material spaced a preset distance apart from a front surface of the refrigerator compartment filter, and the refrigerator compartment cold air auxiliary outlet guide may be configured to guide the cold air after passing through the refrigerator compartment filter to be discharged downward inside the refrigerator compartment through a space between the insulating material and the refrigerator compartment filter.

A returning duct filter may be disposed inside the refrigerator compartment cold air returning duct, and the cold air returning by the refrigerator compartment cold air returning duct may pass through the returning duct filter.

The connection duct and the refrigerator compartment cold air supply duct are in communication on a rear surface of the refrigerating case with the refrigerating case interposed therebetween, thereby reducing the area occupied by the refrigerator compartment cold air supply duct disposed in the rear inner surface of the refrigerator compartment.

The refrigerator according to the present disclosure may enhance capacity competitiveness by increasing the inner volume of the refrigerator compartment.

Furthermore, in the refrigerator according to the present disclosure, the flow path opening/closing module configured to selectively cut off the cold air supplied to the refrigerator compartment may be disposed in the freezer compartment, thereby reducing components related to the cold air supply system disposed on the outer rear surface of the refrigerator compartment.

Accordingly, the refrigerator may increase the inner volume of the refrigerator compartment by reducing the area of the projected part projected toward the inside of the refrigerator compartment and then enhance the capacity competitiveness.

Still further, the refrigerator according to the present disclosure may supply cold air to all of the refrigerator compartment, the freezer compartment and the ice-making chamber by using one evaporator and one grill fan assembly, and may adjust the cold air supplied to the refrigerator compartment divided into the first storage chamber and the second storage chamber by using the first storage chamber flow path opening/closing damper and the second storage chamber opening/closing damper provided in the grill fan assembly.

Accordingly, the refrigerator may provide a new cold air supply system capable of adjusting the cold air supply to the refrigerator compartment divided into the two storage chambers, the freezer compartment and the ice-making chamber by using one evaporator and the plurality of flow path opening/closing dampers provided in the freezer compartment.

Still further, in the refrigerator according to the present disclosure, the upper surface of the connection duct and the lower surface of the refrigerator compartment cold air supply duct, which have the inclined surfaces, respectively, may be coupled to each other by sliding, while pushing the refrigerator compartment cold air supply duct upward after inserting some area of the upper region of the refrigerator compartment cold air supply duct.

Accordingly, the refrigerator compartment cold air supply duct may be easily coupled inside the refrigerator compartment as a module assembly unit. The upper region of the refrigerator compartment cold air supply duct may be inserted in the duct inserting groove even without separate fastening means to be strongly secured by surface-to-surface contact, thereby facilitating assembling process simplification and improving workability.

Still further, in the refrigerator according to the present disclosure, the flow path opening/closing damper may be disposed in the freezer compartment, not the refrigerator compartment with a relatively humid environment. Accordingly, when the flow path opening/closing damper is closed, cold air inside the freezer compartment may not rise to the refrigerator compartment but stay in the freezer compartment, thereby reducing dew condensation near the flow path opening/closing damper.

Still further, the refrigerator according to the present disclosure may have the cold air supply system structure in which the connection duct and the second storage chamber cold air supply duct, which supply cold air to the refrigerator compartment, is disposed adjacent to one lateral surface of the refrigerator and the ice-making chamber cold air supply duct for supplying cold air to the ice-making chamber is disposed adjacent to the other lateral surface of the refrigerator.

Accordingly, the refrigerator may provide a new cold air supply system capable of balancing the entire cold air inside the refrigerator.

Still further, the refrigerator according to the present disclosure may perform the deodorizing function for the refrigerator compartment by using the refrigerator compartment cold air auxiliary flow path branched from the refrigerator cold air flow path for supplying cold air to the refrigerator compartment, thereby having no need of a separate suction fan provided in the refrigerator compartment to deodorize the refrigerator compartment.

Accordingly, the area projected to the inside of the refrigerator compartment to install the suction fan may be reduced and then the inner volume of the refrigerator compartment may be increased. The deodorizing function for the refrigerator compartment may be performed without interfering with the circulation structure of the cold air inside the refrigerator compartment.

Specific effects are described along with the above-described effects in the section of Detailed Description.

DESCRIPTION OF REFERENCE NUMERALS

Figure 19A:
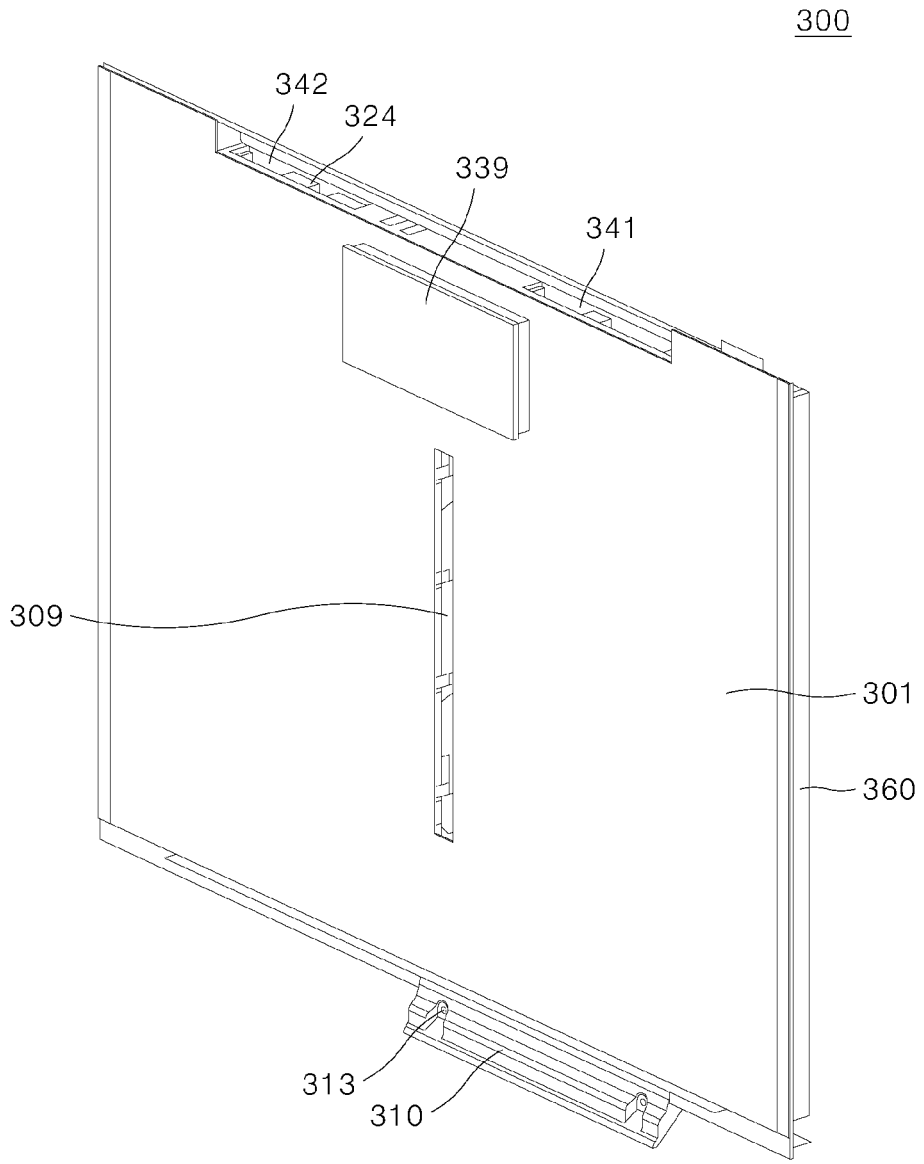
Figure 19B:
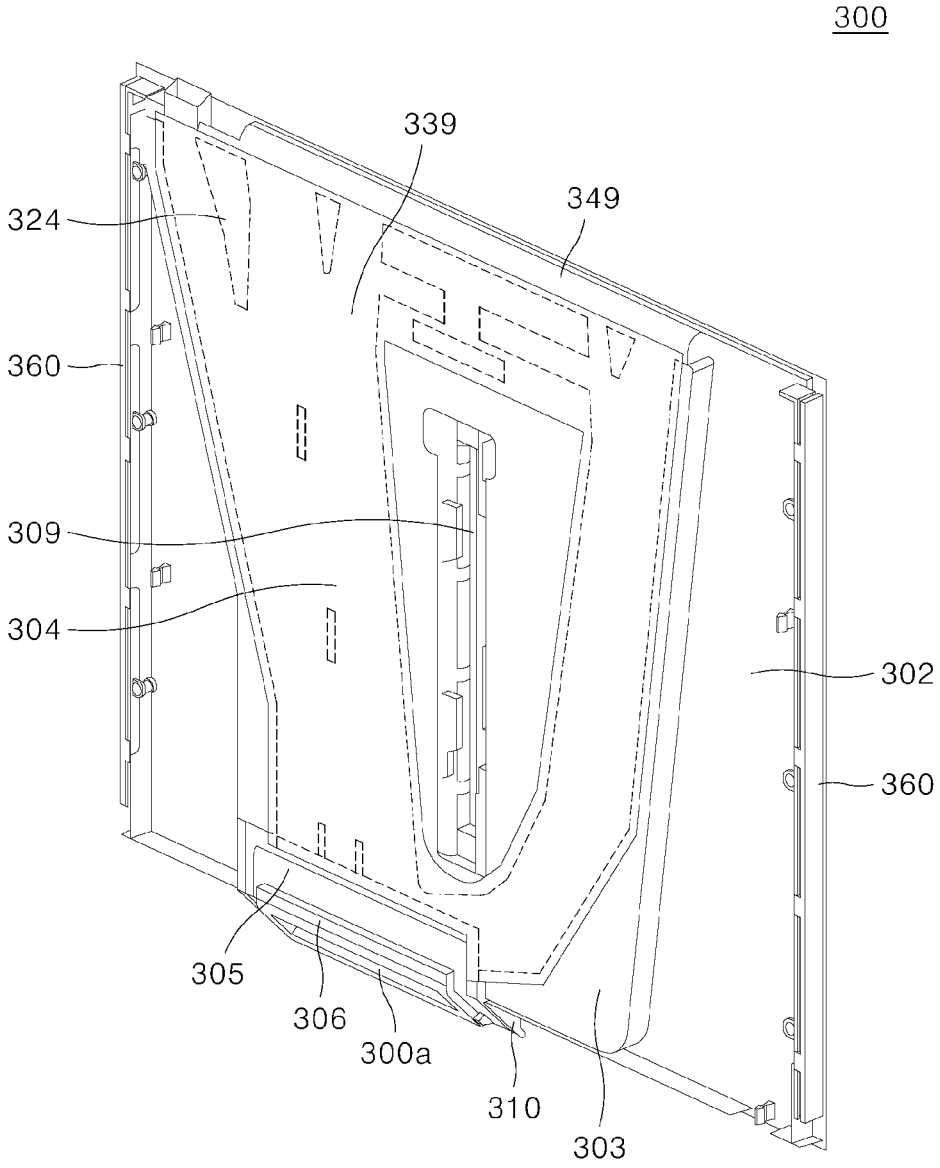
Figure 19C:
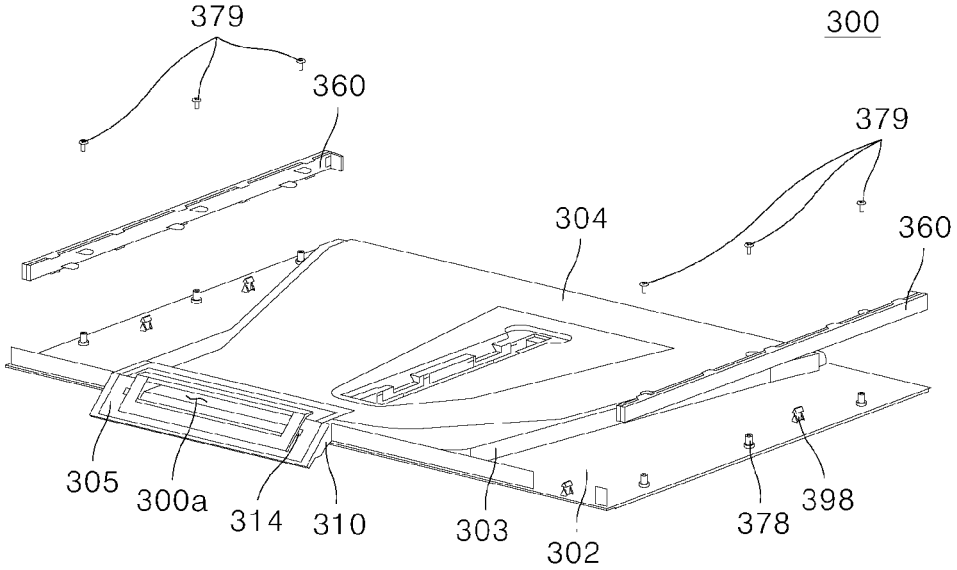
Figure 19D:
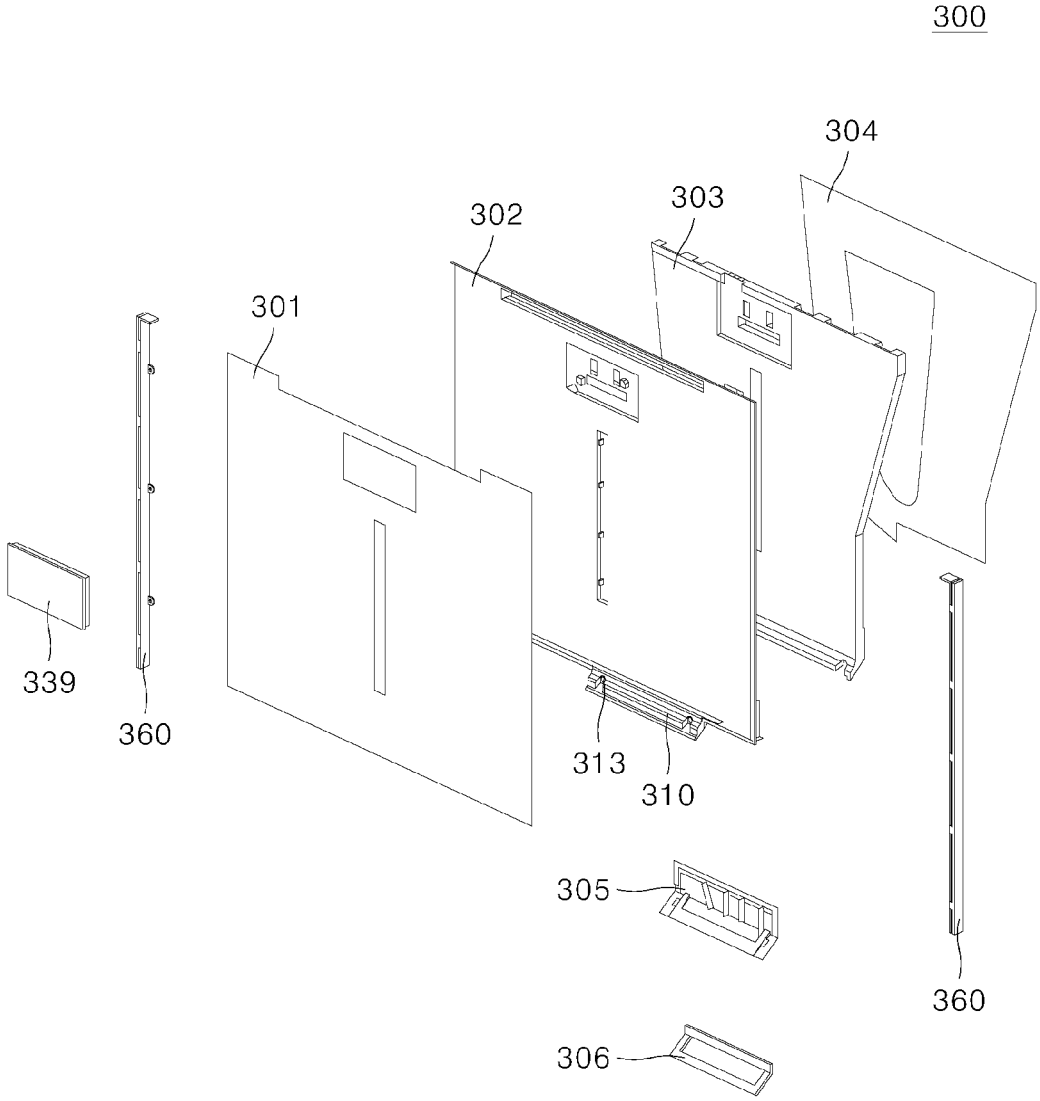
Figure 19E:
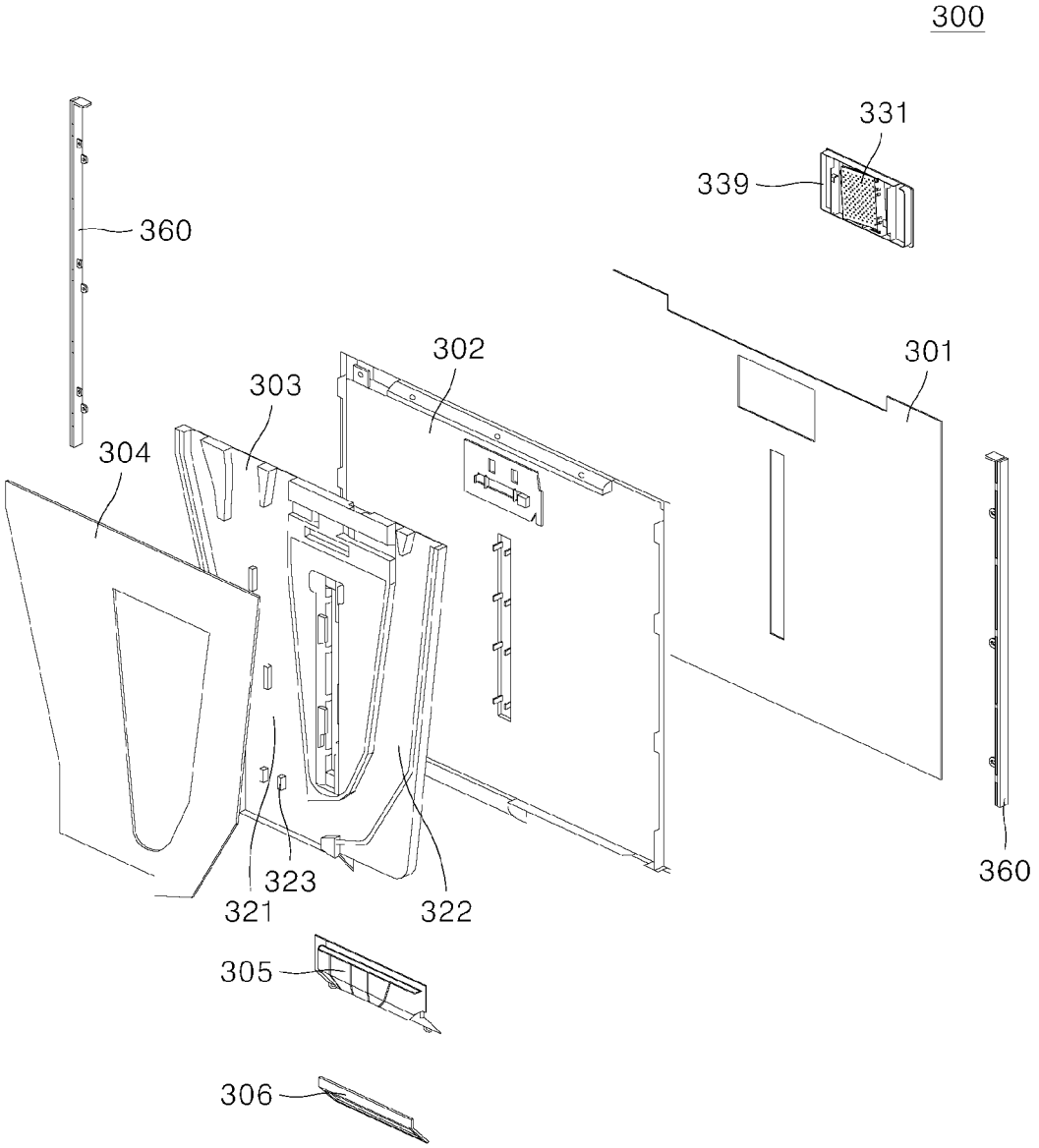

FIG. 19A is a front perspective view of a refrigerator compartment cold air supply duct, FIG. 19B is a rear perspective view of a refrigerator compartment cold air supply duct, FIG. 19C is a rear exploded perspective view showing some parts of a refrigerator compartment cold air supply duct, FIG. 19D is a front exploded perspective view of a refrigerator compartment cold air supply duct, and FIG. 19E is a rear exploded perspective view of a refrigerator compartment cold air supply duct.

Figure 20A:
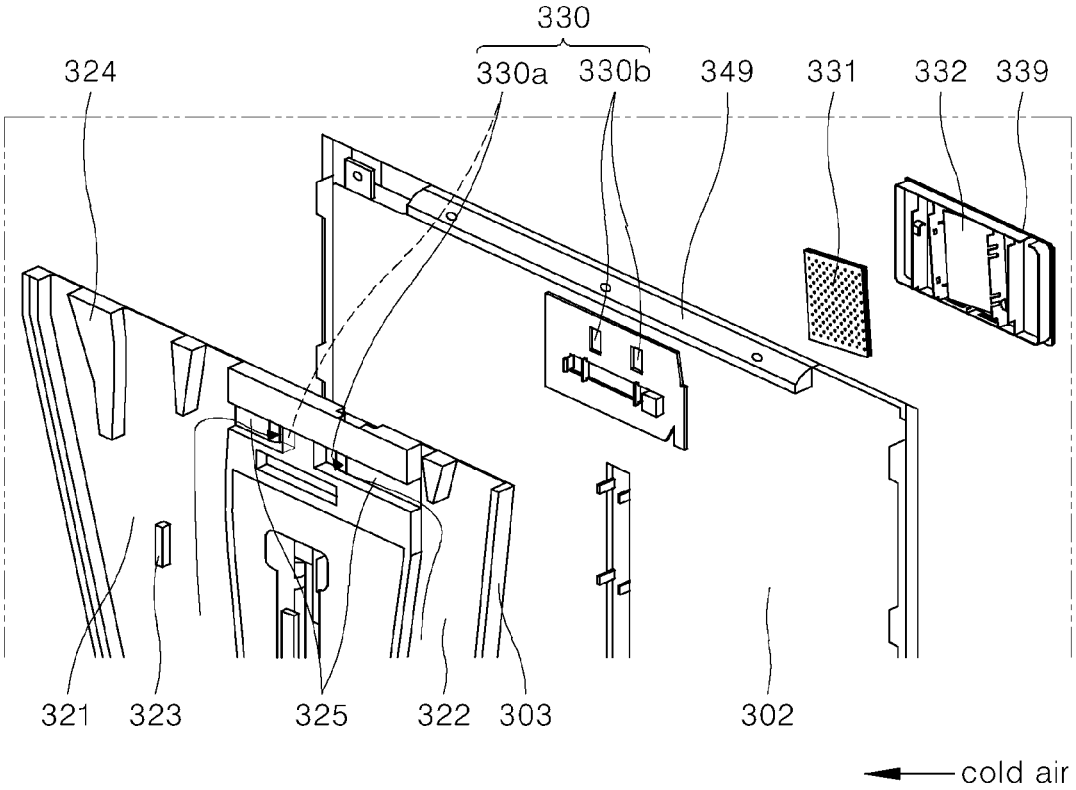
Figure 20B:
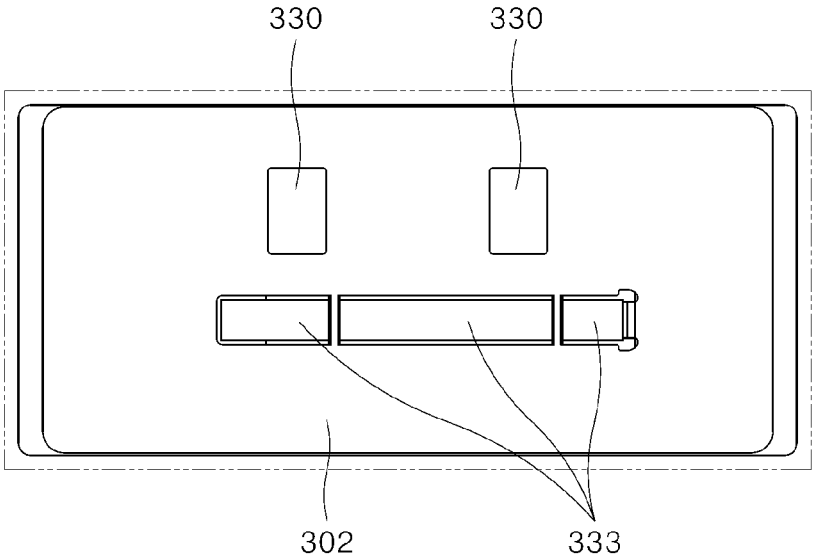
Figure 20C:
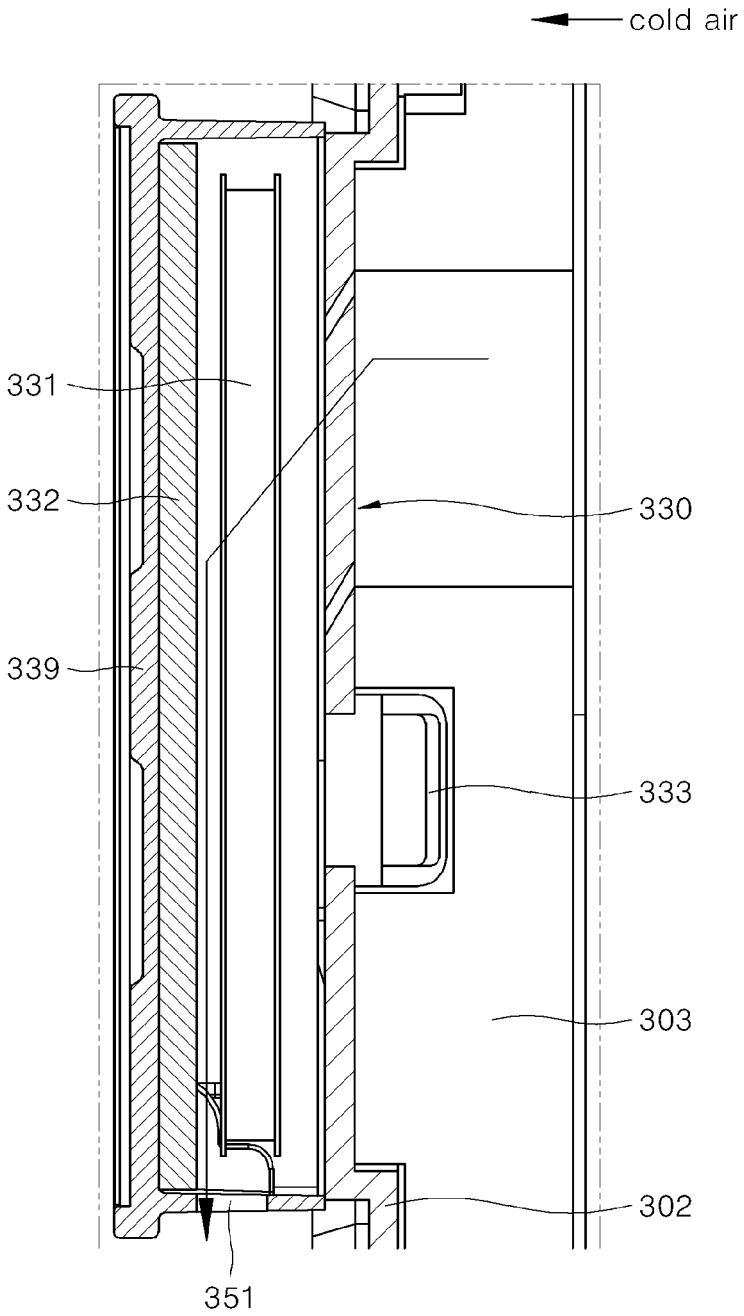
Figure 21A:
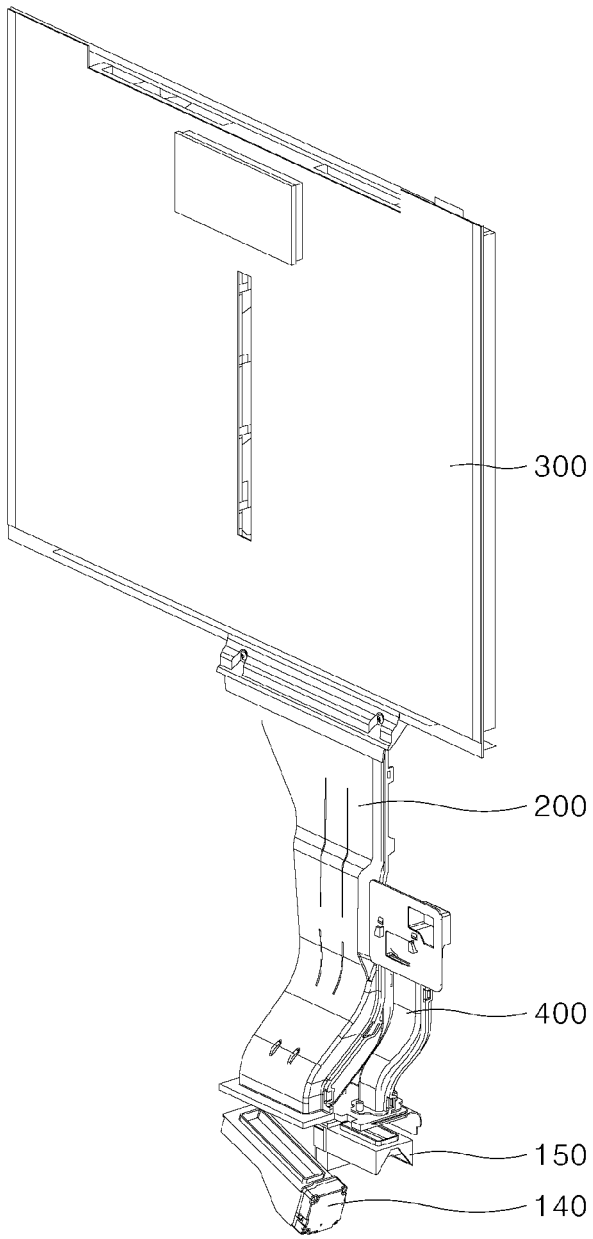
Figure 21B:
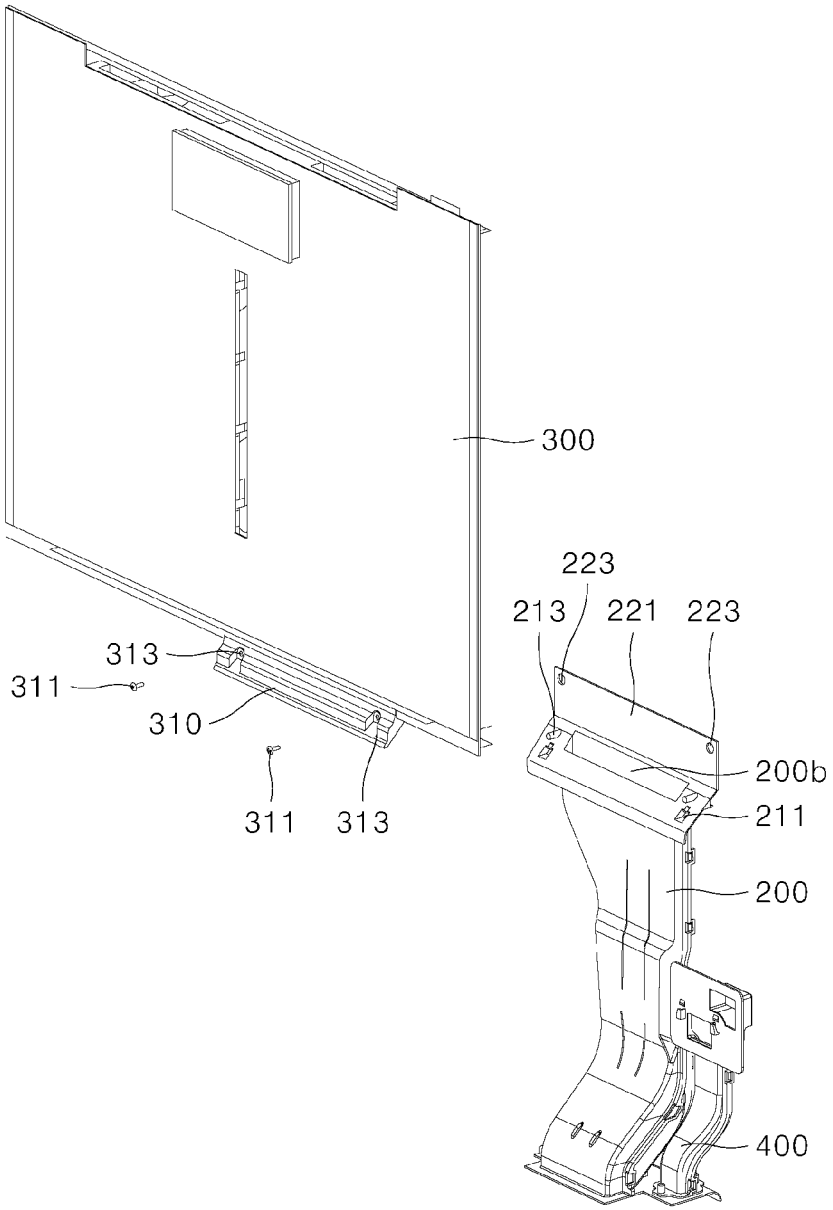
Figure 22A:
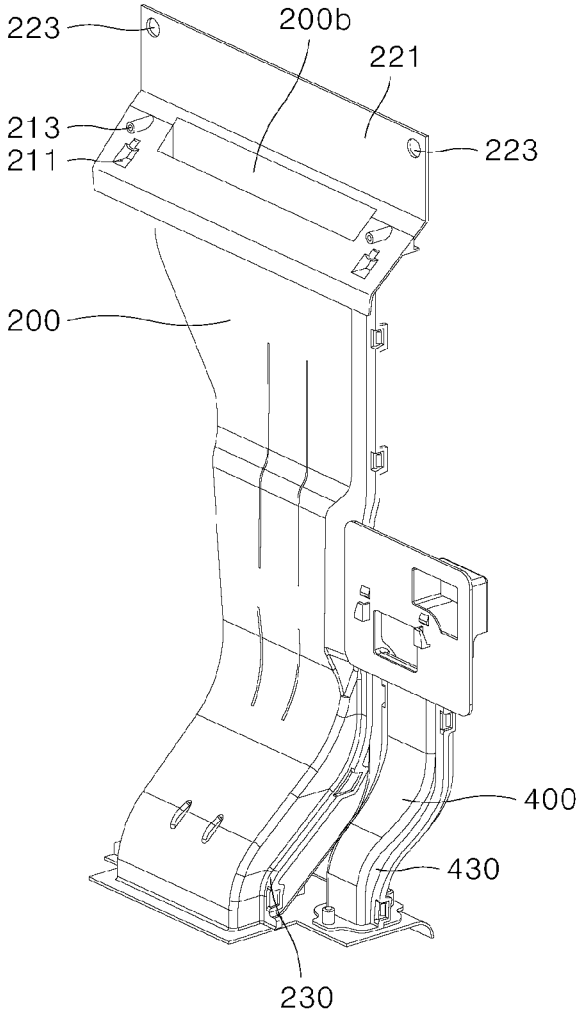
Figure 22B:
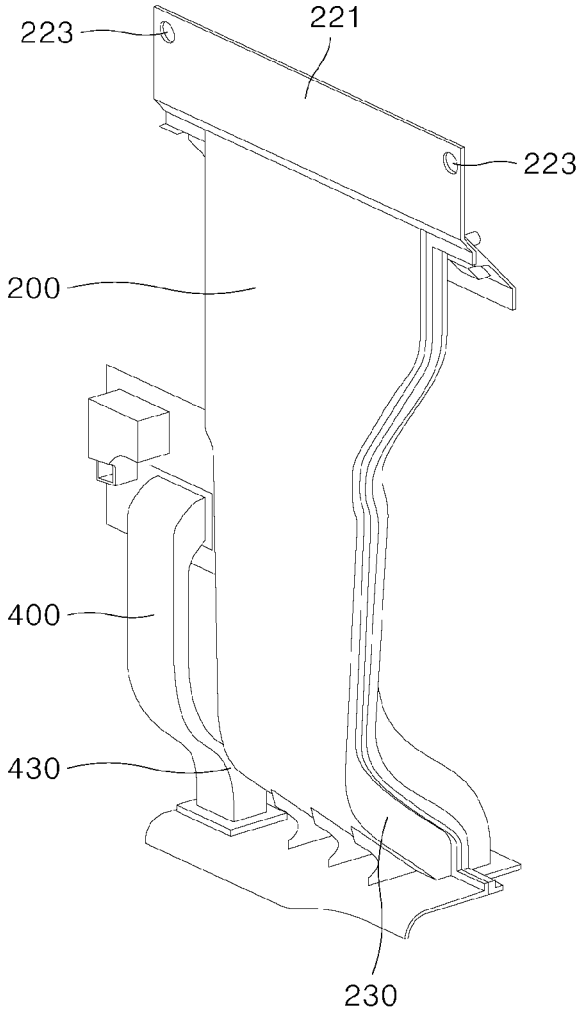
Figure 22C:
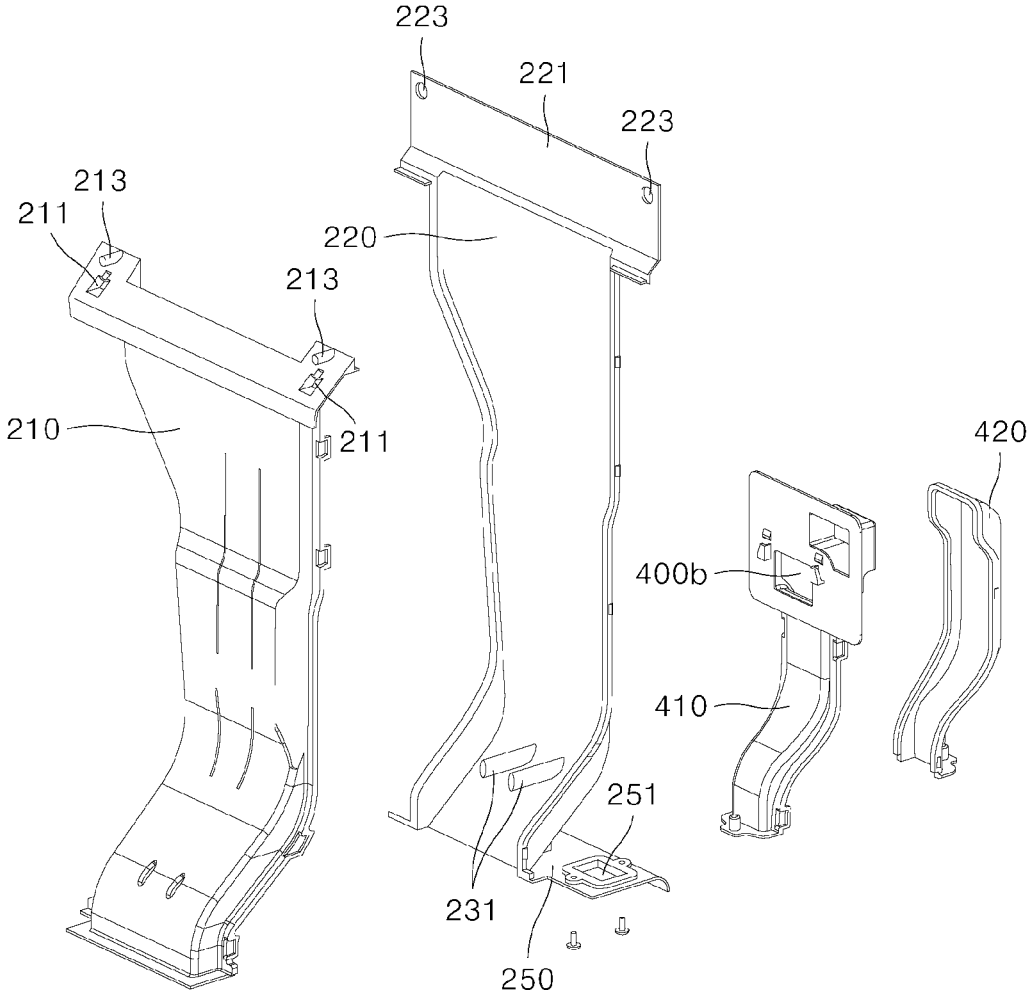
Figure 22D:
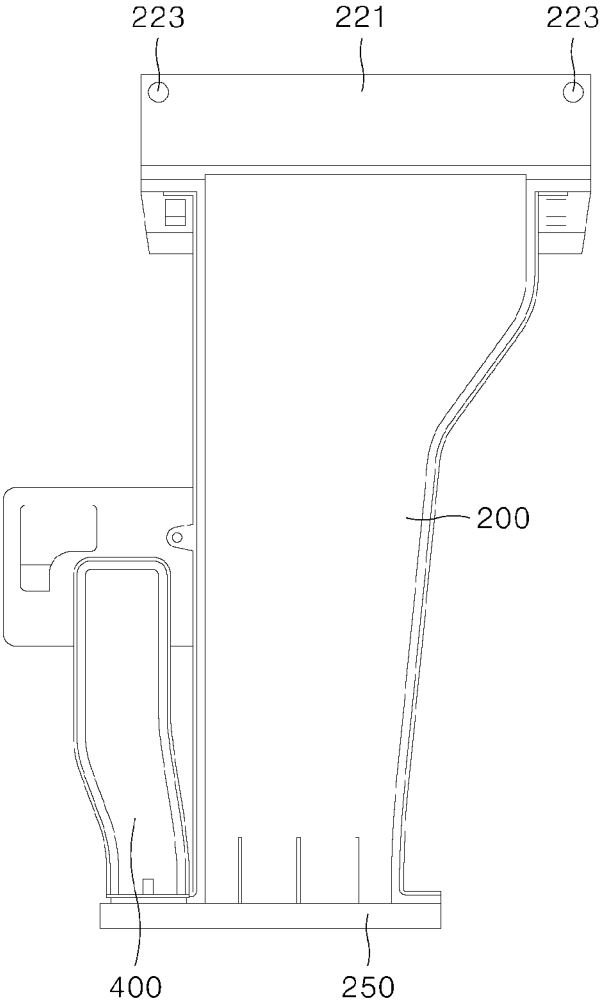
Figure 22E:
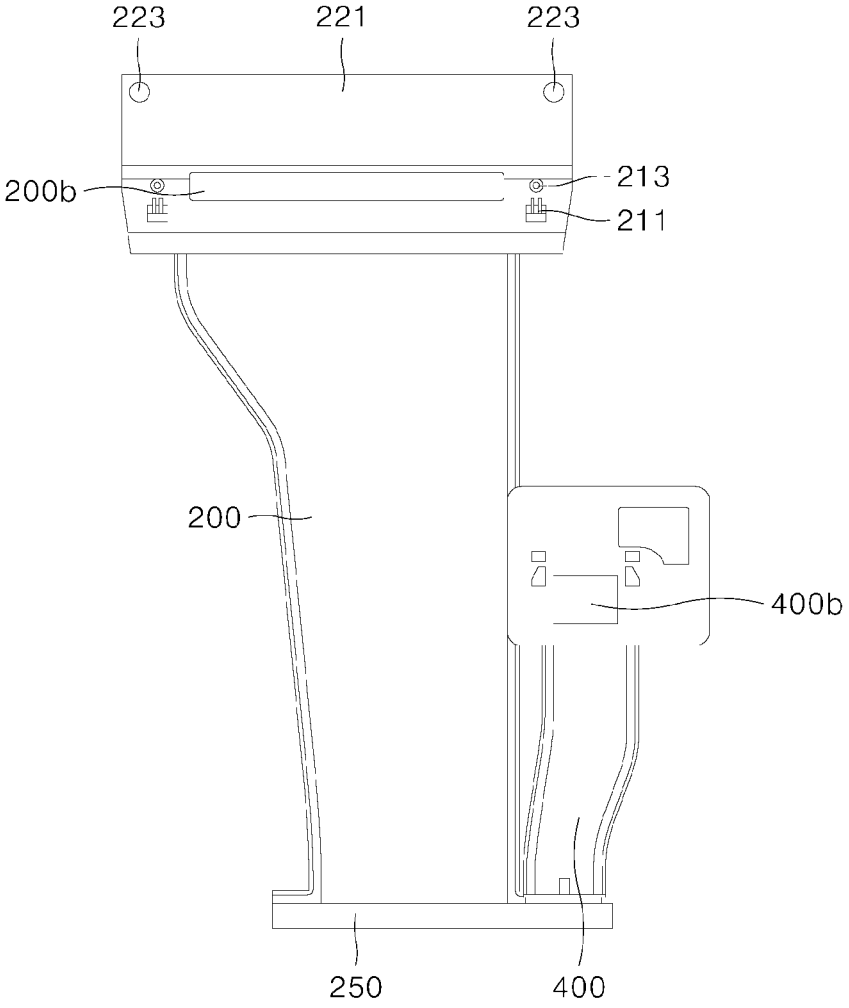
Figure 22F:
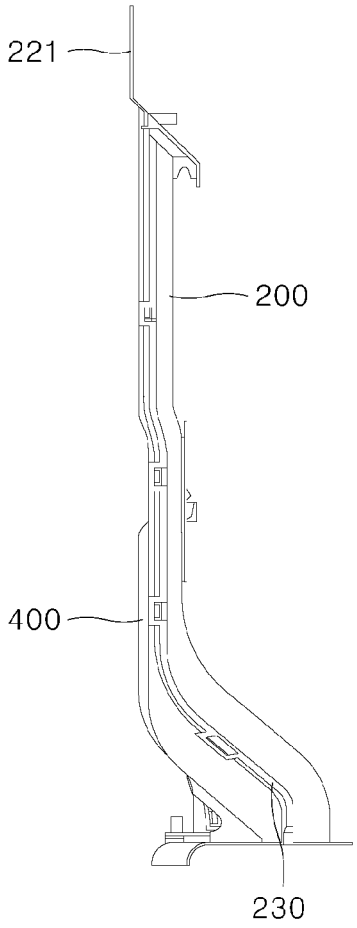
Figure 22G:
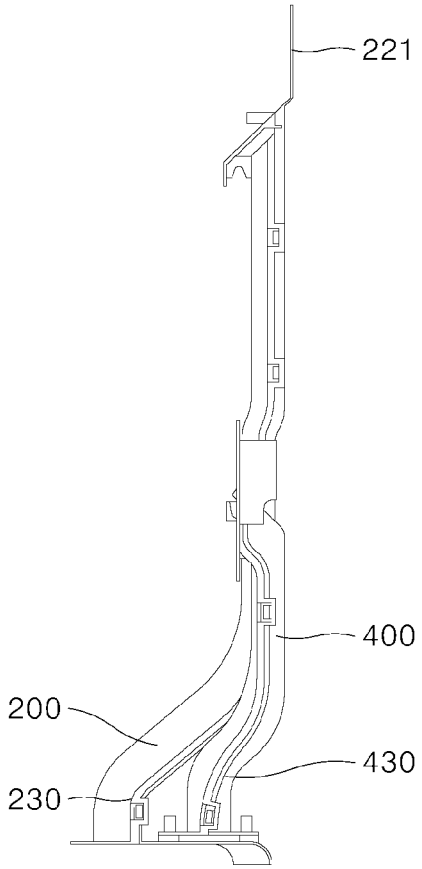
Figure 22H:
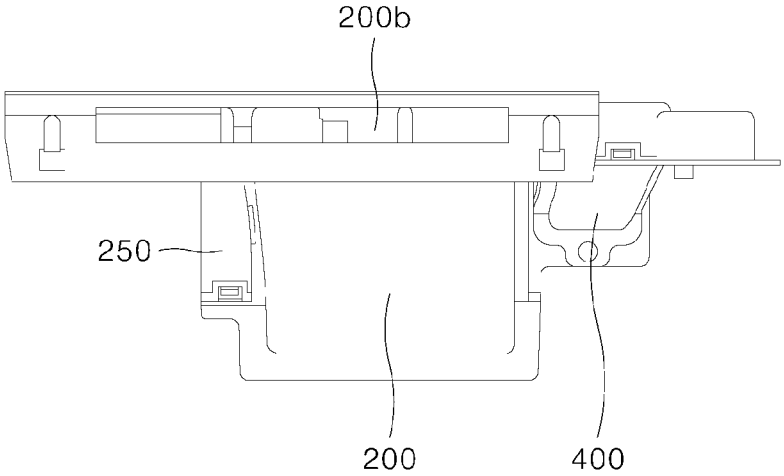
Figure 22I:
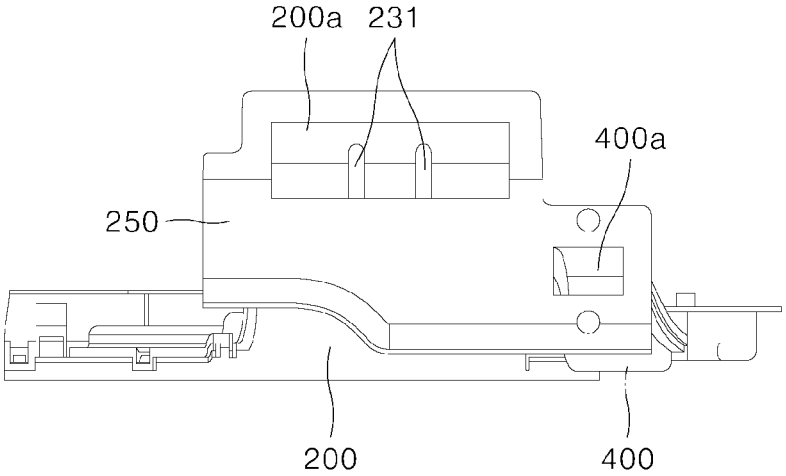
Figure 23A:
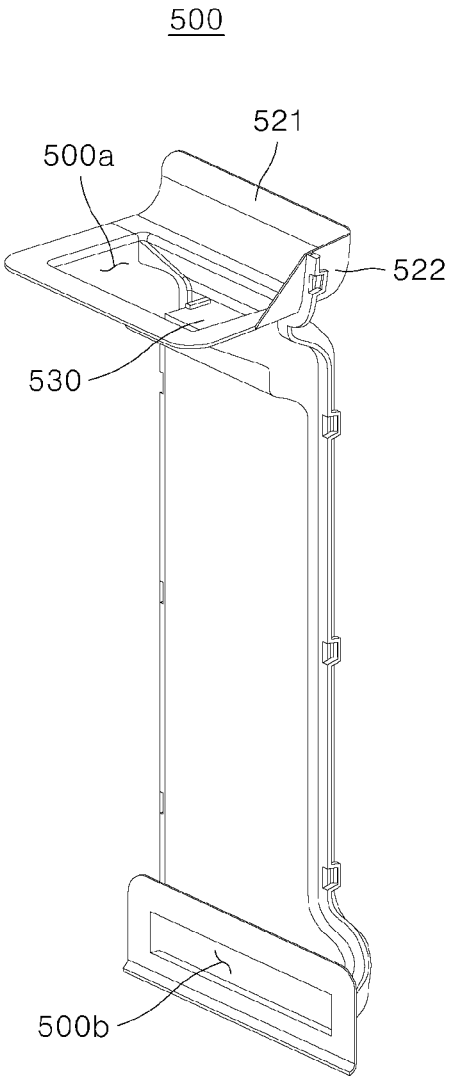
Figure 23B:
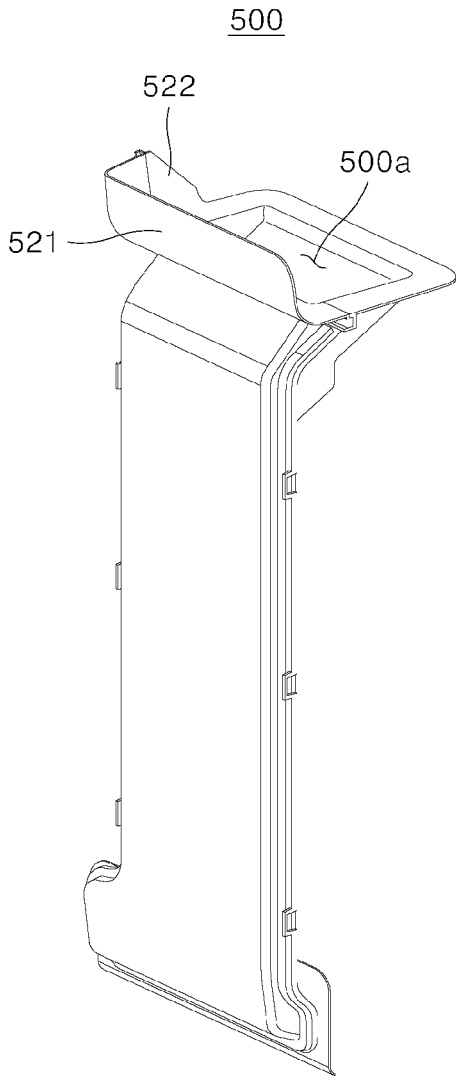
Figure 23C:
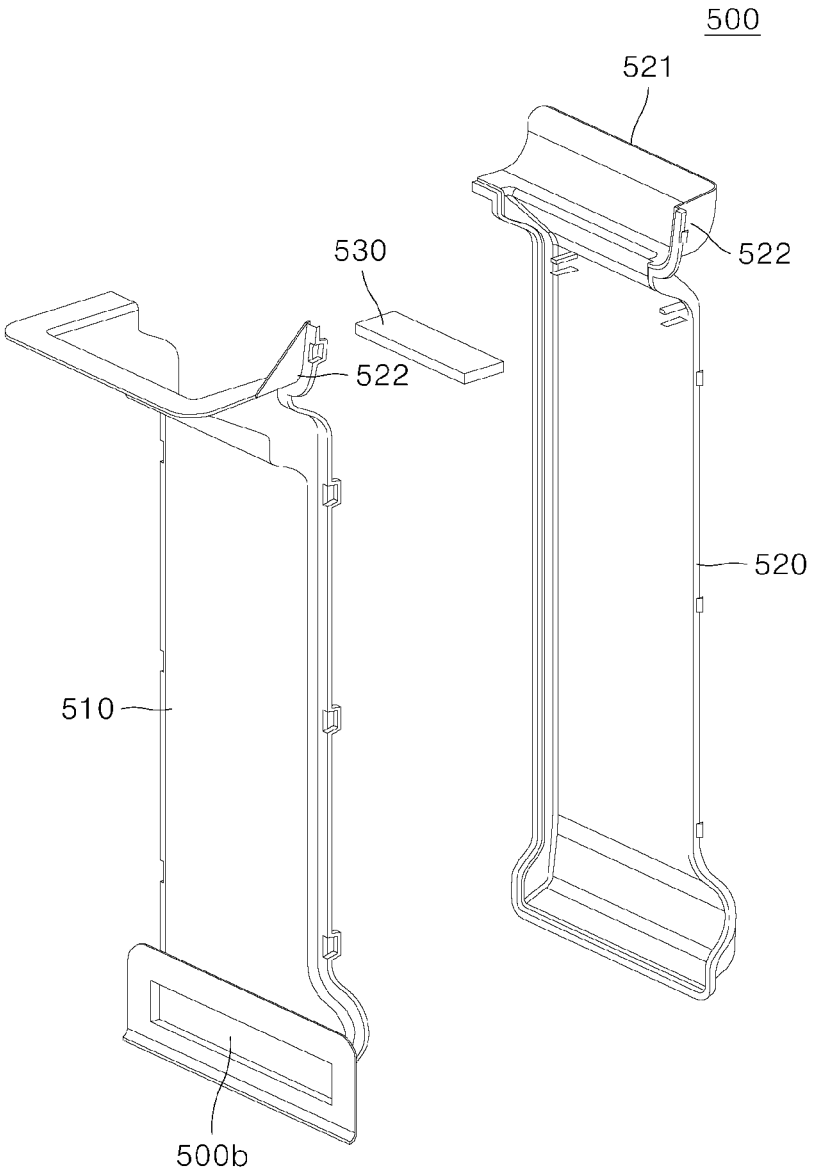
Figure 23D:
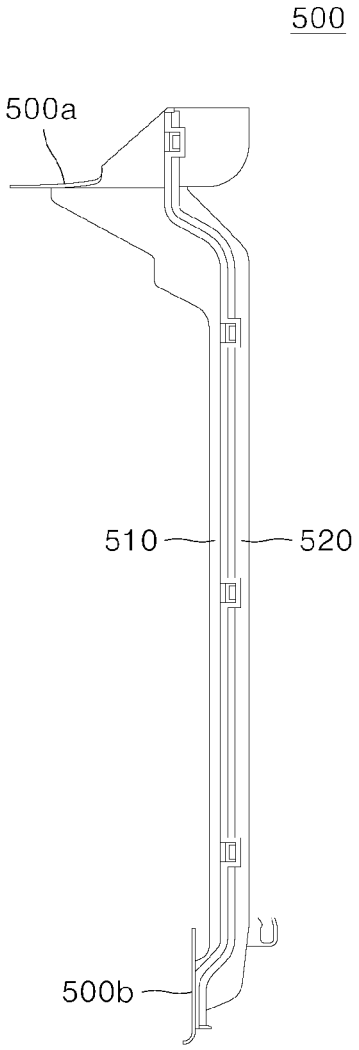
Figure 24A:
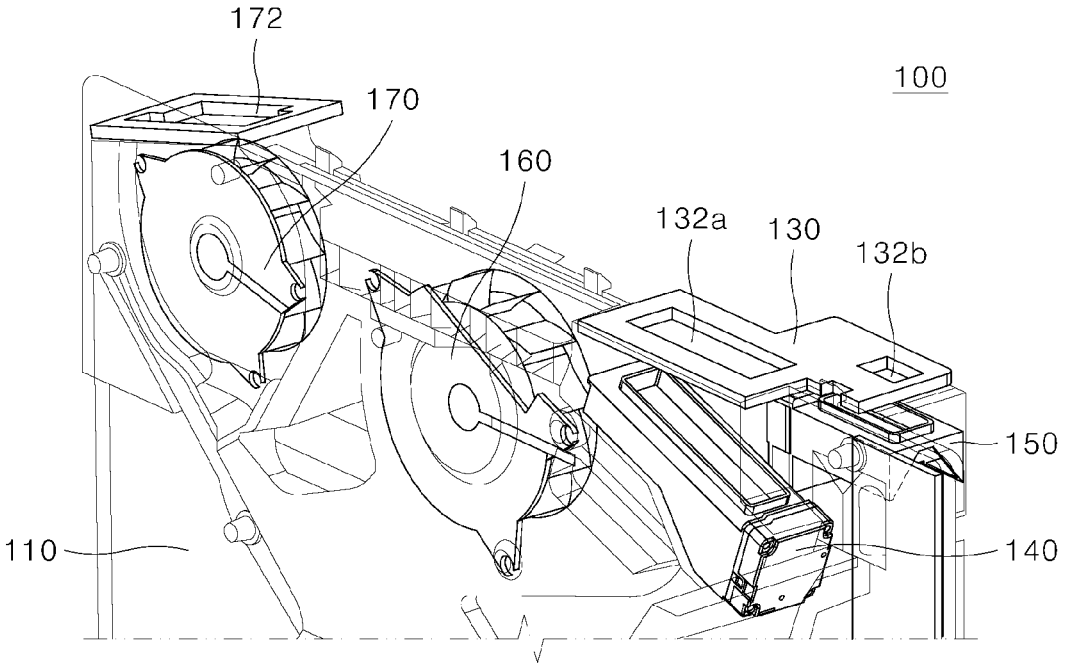
Figure 24B:
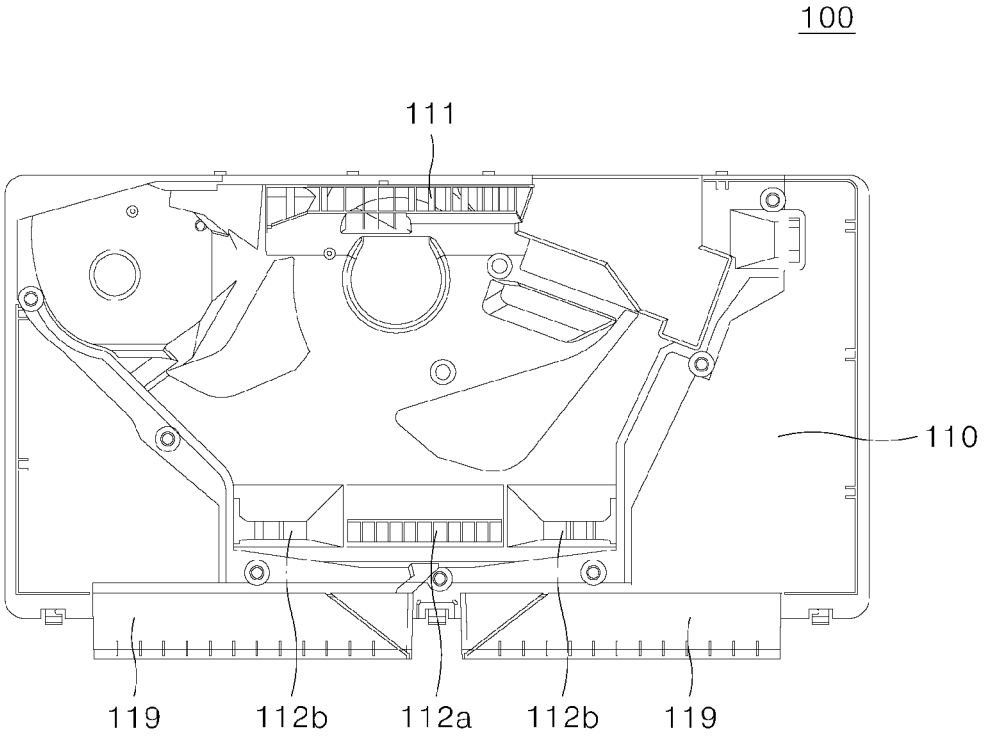
Figure 24C:
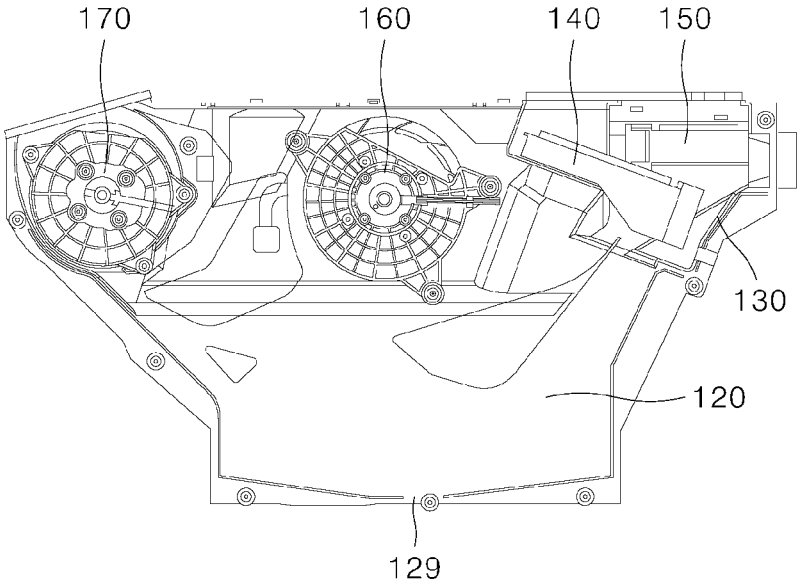
Figure 24D:
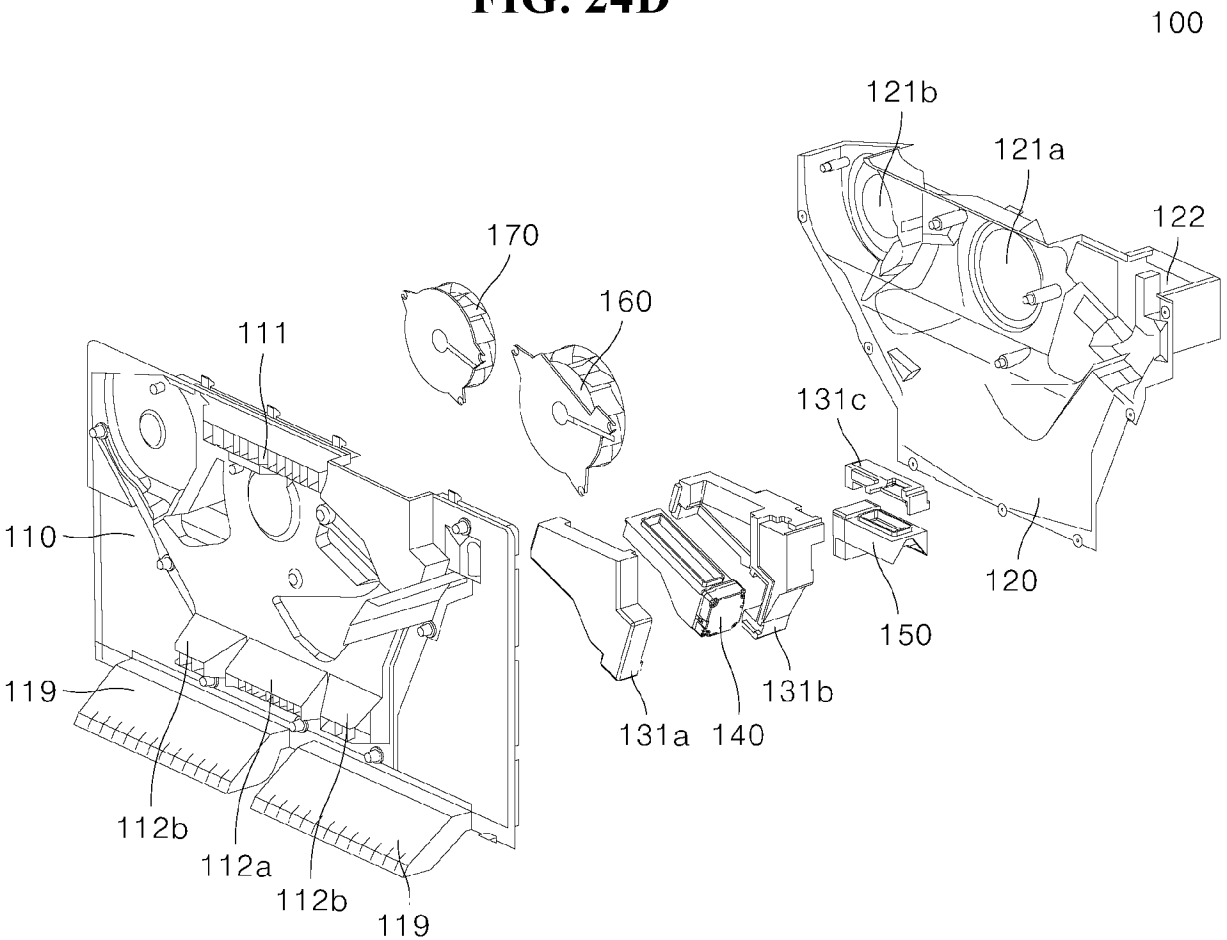
Figure 24E:
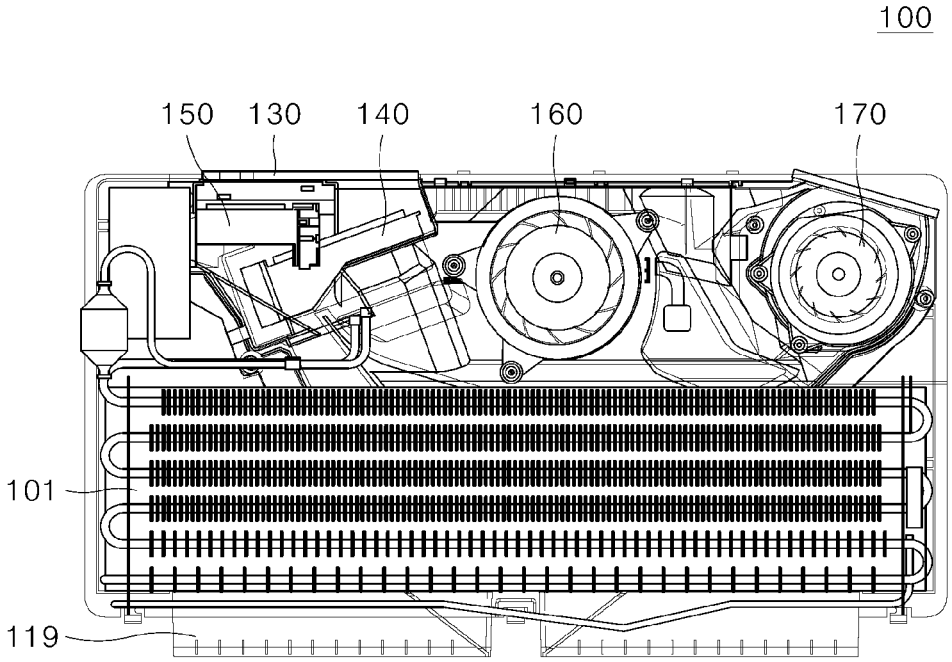
Figure 25:
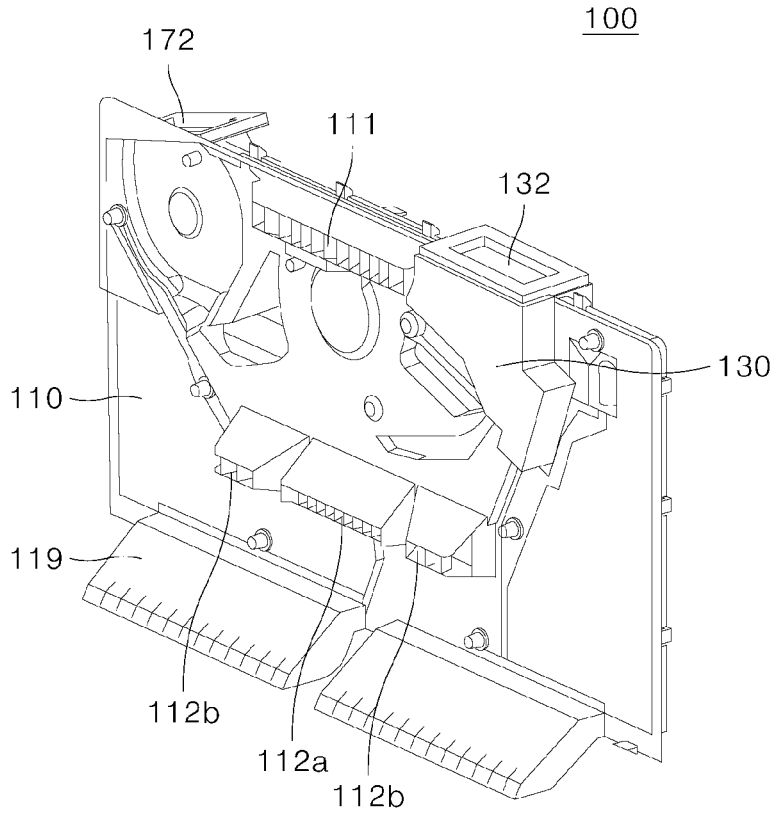
Figure 26A:
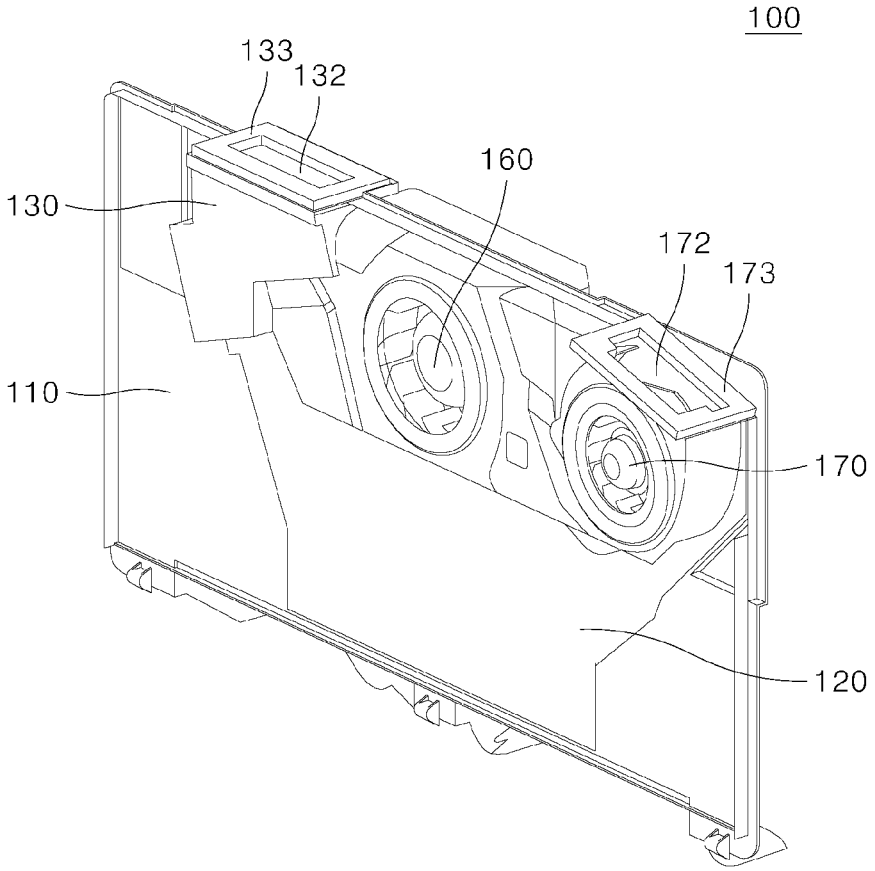
Figure 26B:
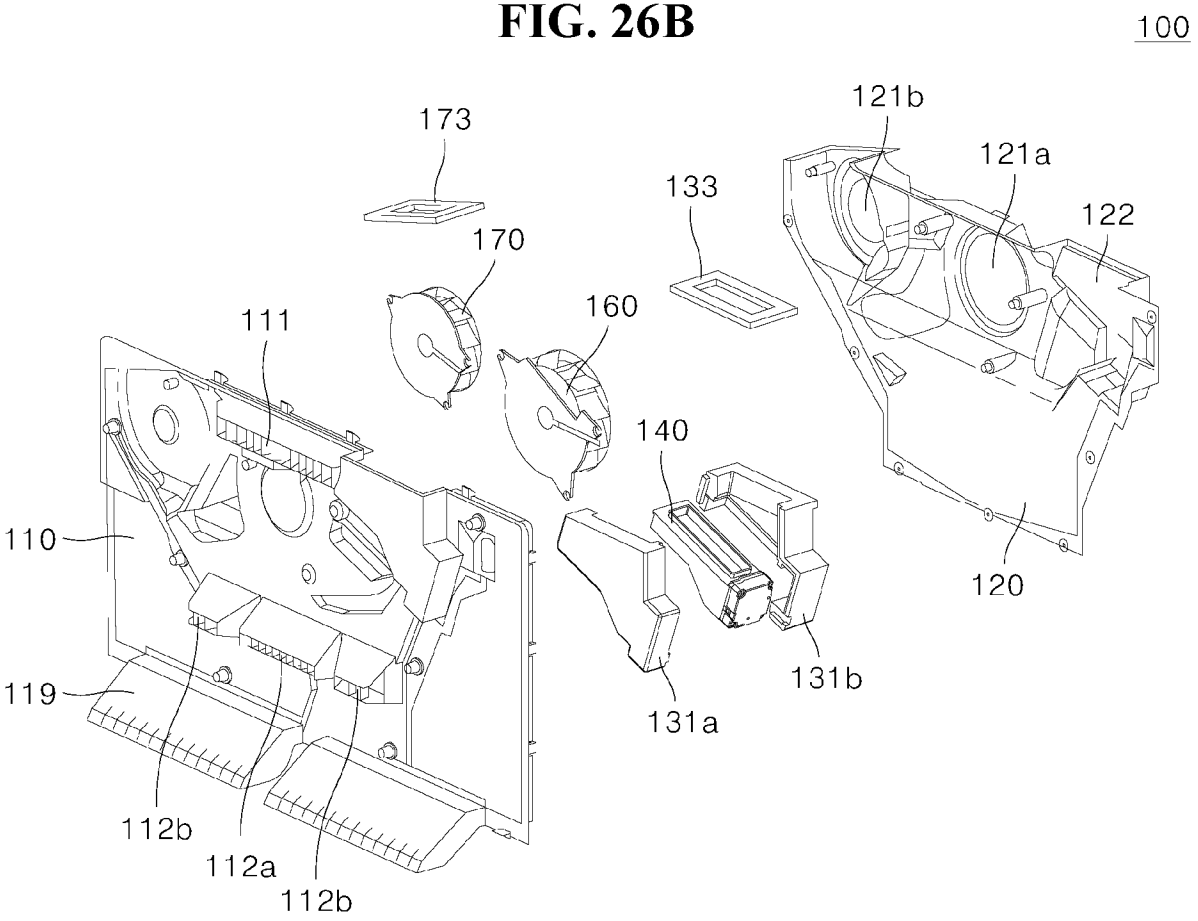
Figure 27A:
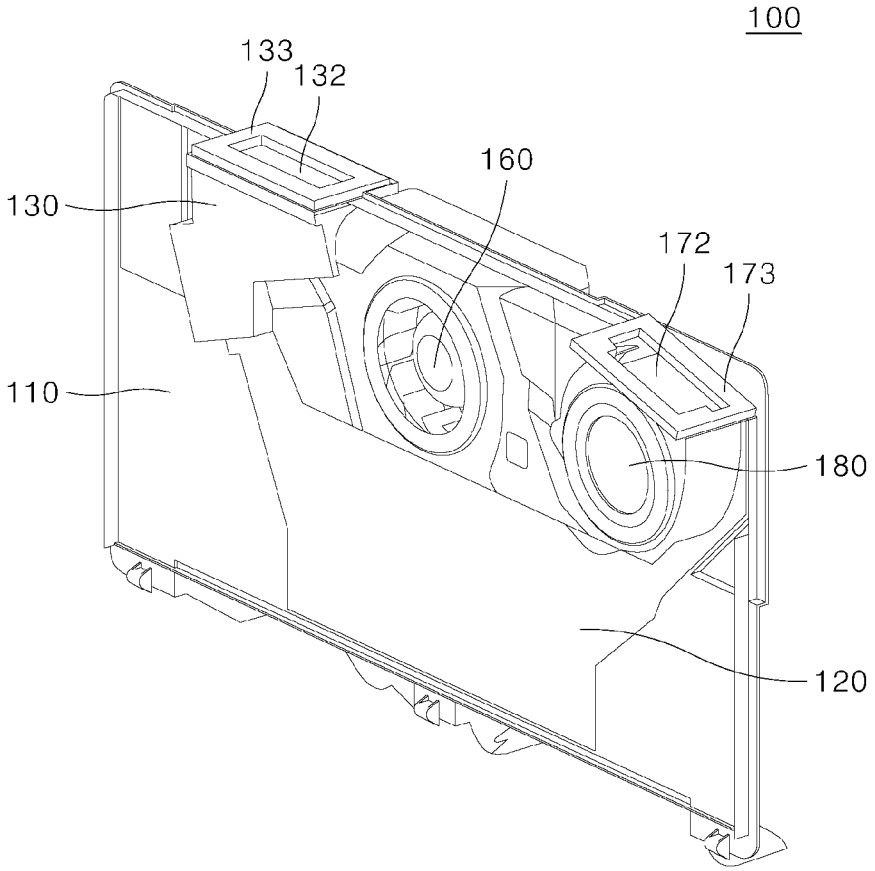
Figure 27B:
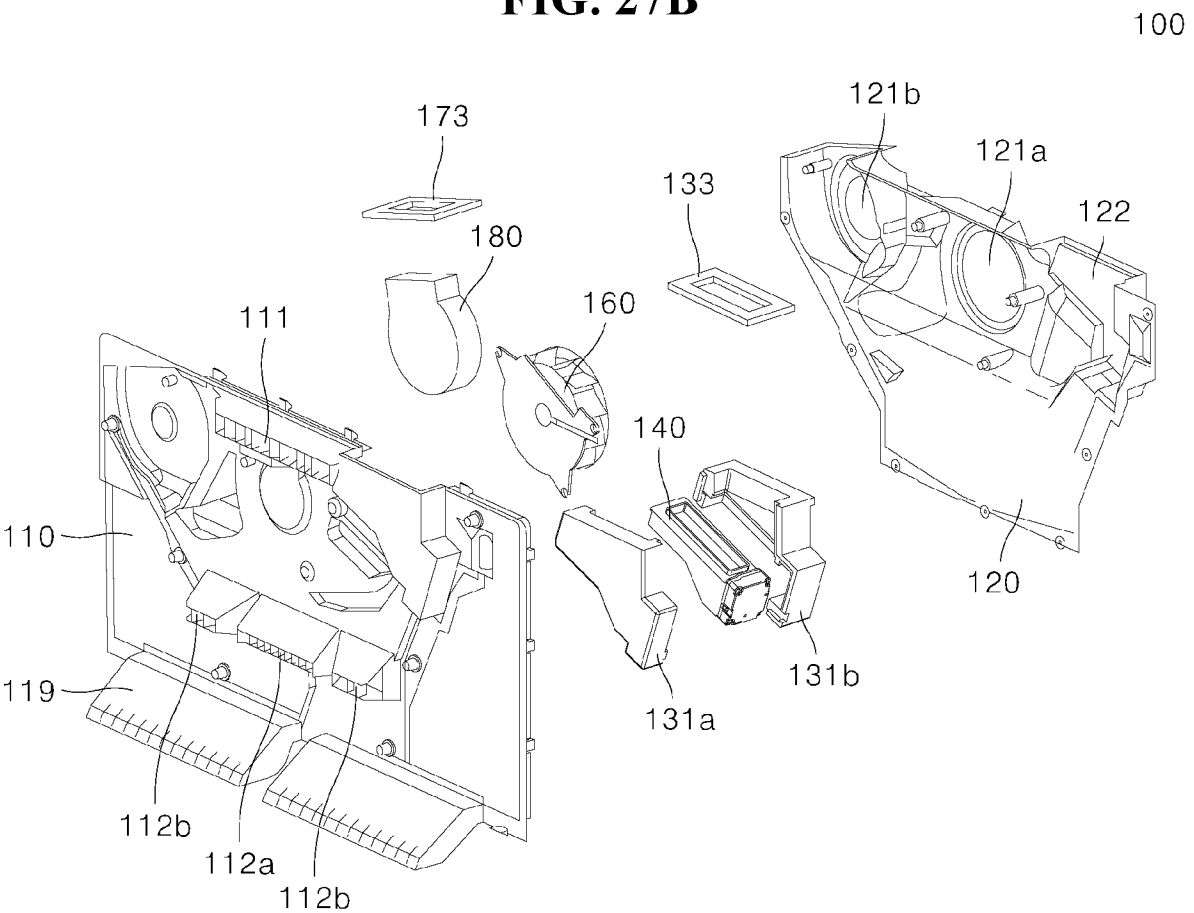

FIG. 20A is a rear exploded perspective view showing some parts of a refrigerator compartment cold air supply duct including a refrigerator compartment filter, FIG. 20B is a front view showing a refrigerator compartment cold air auxiliary outlet hole, and FIG. 20C is a side sectional view of a refrigerator compartment cold air auxiliary outlet hole to which a refrigerator compartment filter is coupled;

FIG. 21A is a perspective view showing a state where a refrigerator compartment cold air supply duct, a connection duct and a second storage chamber cold air supply duct are coupled to each other;

FIG. 21B is a perspective view showing a state where a refrigerator compartment cold air supply duct, a connection duct and a second storage chamber cold air supply duct are decoupled from each other;

FIGS. 22A and 22B are a front perspective view and a rear perspective view that show a connection duct and a second storage chamber cold air supply duct are coupled to each other;

FIG. 22C is an exploded perspective view showing a connection duct and a second storage chamber cold air supply duct;

FIGS. 22D and 22E are a rear view and a front view showing a state where a connection duct and a second storage chamber cold air supply duct are coupled to each other;

FIGS. 22F, 22G, 22H and 22I are a left sectional view, a right sectional view, a front view and a bottom view showing a state where a connection duct and a second storage chamber cold air supply duct are coupled to each other;

FIGS. 23A and 23B are a front perspective view and a rear perspective view showing a refrigerator compartment cold air returning duct;

FIG. 23C is an exploded perspective view of a refrigerator compartment cold air returning duct, and FIG. 23D is a right sectional view of a refrigerator compartment cold air returning duct;

FIG. 24A is a perspective view showing an upper area of a grill fan assembly including two flow path opening/closing dampers, FIG. 24B is a front view of a grill fan assembly, FIG. 24C is a front view of a grill fan assembly having a grill fan removed, FIG. 24D is an exploded perspective view of a grill fan assembly, and FIG. 24E is a rear view a state where an evaporator is disposed on a rear surface of a grill fan assembly;

FIG. 25 is a perspective view of a grill fan assembly including one flow path opening/closing damper;

FIGS. 26A and 26B are a rear perspective view and an exploded perspective view of a grill assembly including one flow path opening/closing damper and an ice-making chamber; and FIG. 27A and FIG. 27B are a rear perspective view and an exploded perspective view of a grill fan assembly including one flow path opening/closing damper and no ice-making chamber.

DESCRIPTION OF SPECIFIC EMBODIMENTS

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

[Overall Structure of Refrigerator]

Figure 1A:
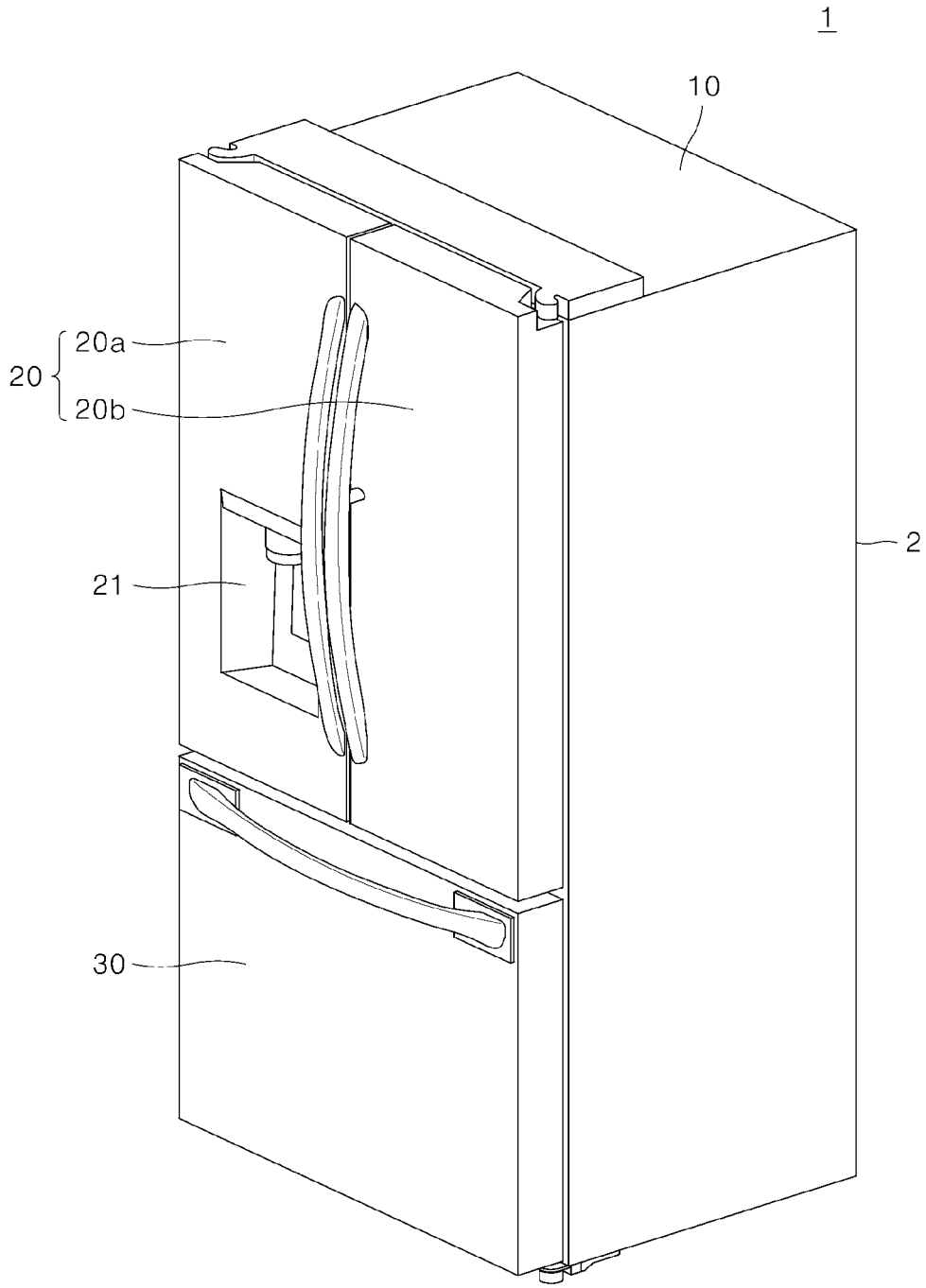
FIGS. 1A and 1B are front perspective views showing a state where a door of a refrigerator including an ice-making chamber is closed and a state where a door of a refrigerator including no ice-making chamber is closed.
Figure 1B:
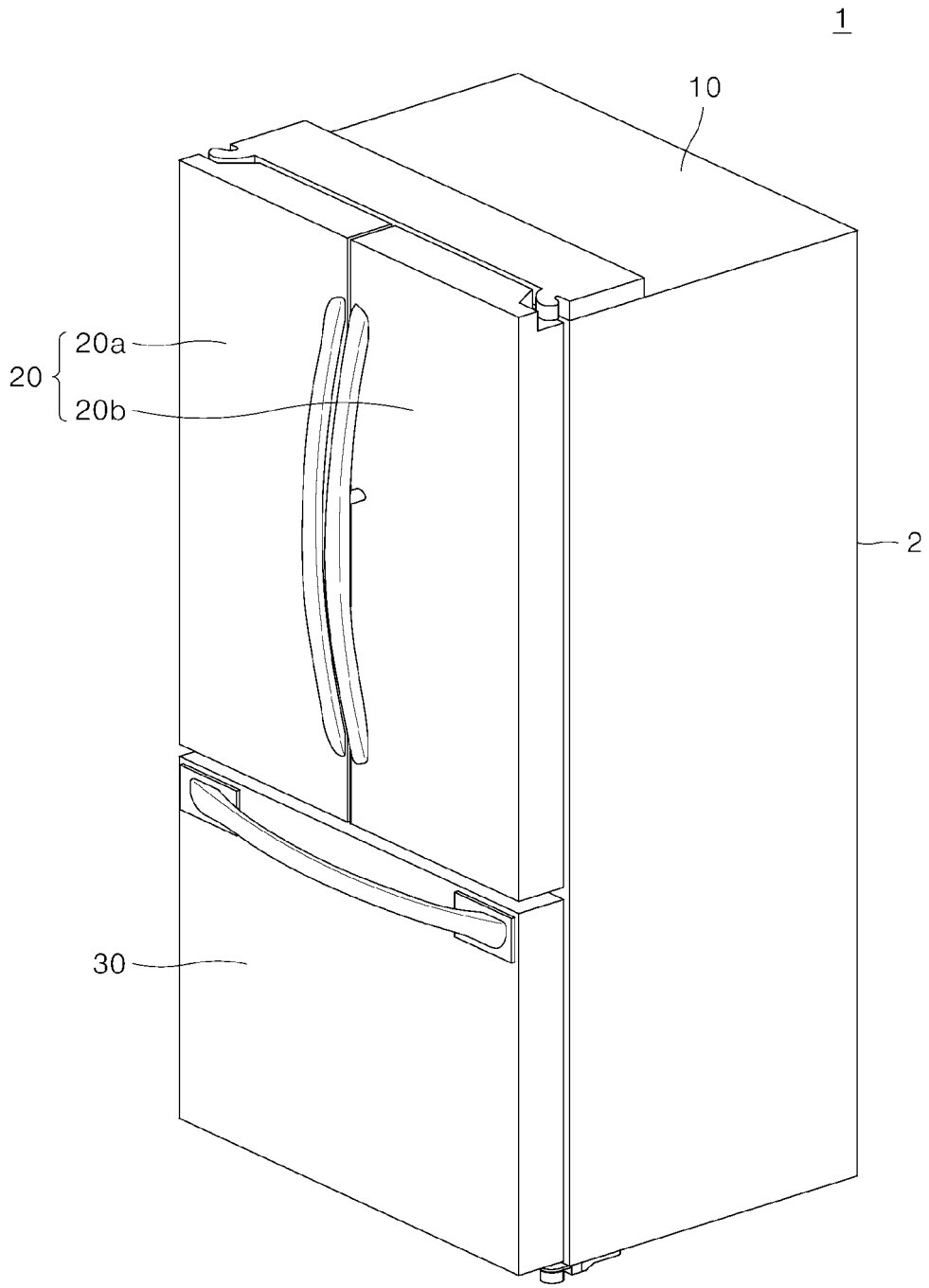
Figure 2:
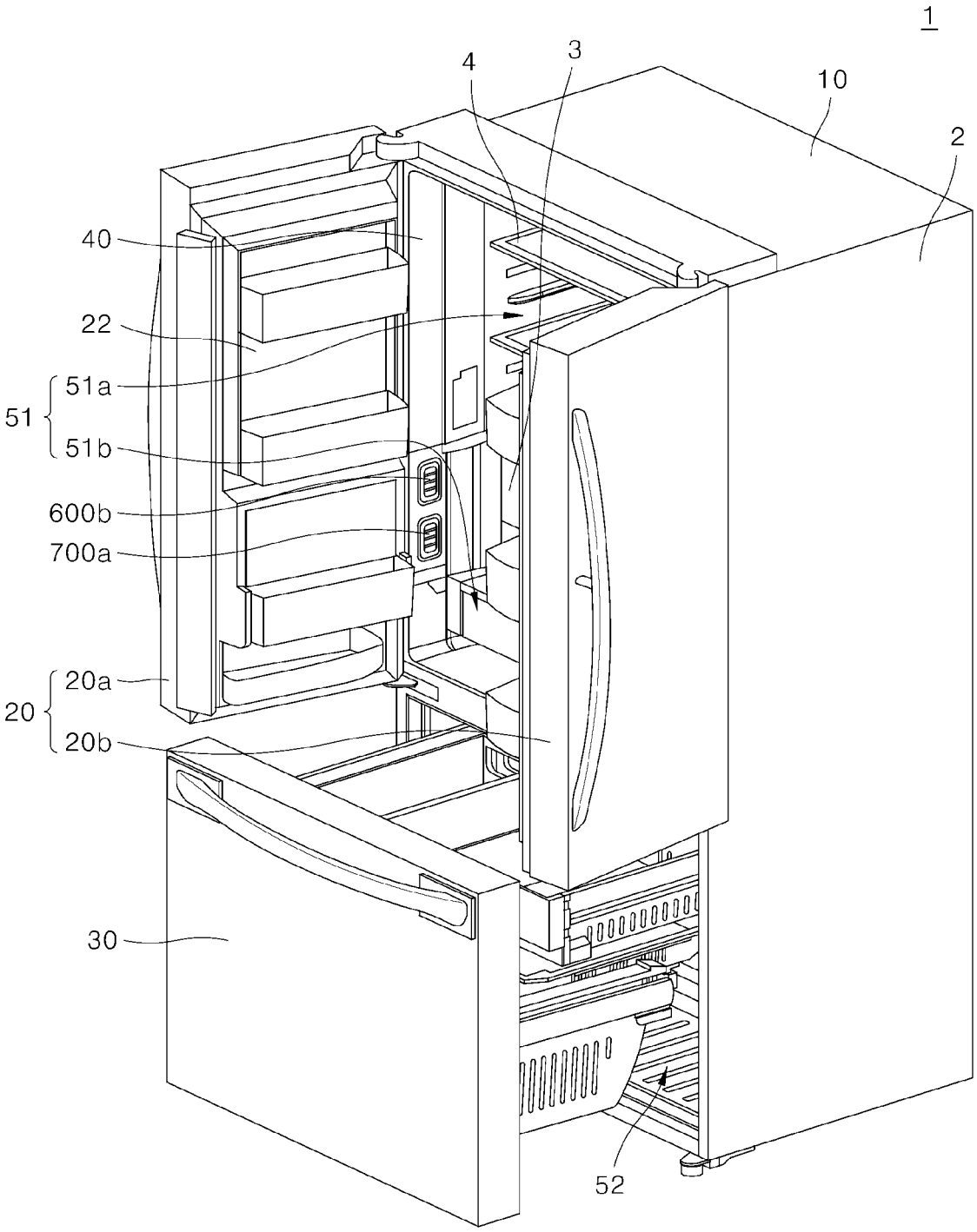
FIG. 2 is a front perspective view showing a state where a door of a refrigerator is open.

FIGS. 1A and 1B are front perspective views showing a state where a door of a refrigerator including an ice-making chamber is closed and a state where a door of a refrigerator including no ice-making chamber is closed. FIG. 2 is a front perspective view showing a state where a door of a refrigerator is open.

An exterior design of the refrigerator 1 may be defined by a cabinet 1 defining a storage space and a door configured to open and close an open front of the cabinet 2.

The cabinet 2 may include an outer case 10 forming an outer surface of the refrigerator 1 and an inner case 40 forming an inner surface of the outer case 10.

The outer case 10 and the inner case 40 may be spaced a preset distance apart from each other and an insulating material is foamed in the space between them to fill the empty space with the insulating material.

A storage space inside the cabinet 2 may be divided into a plurality of spaces, which are a refrigerator compartment 51 and a freezer compartment 52.

As one embodiment of the present disclosure, the freezer compartment 52 may be mounted in a lower space of the cabinet 2 and the refrigerator compartment 51 may be mounted in an upper space.

A door may be coupled to a front surface of the cabinet 2 to open and close the refrigerator 1.

An upper door 20 may be coupled to a front surface corresponding to the refrigerator compartment 51 and a lower door 30 may be coupled to a front surface corresponding to the freezer compartment 52.

For example, the upper door 20 may be a rotation type configured of a first upper door 20 and a second upper door 20*b* that are rotatable on shafts on both sides of the cabinet 2, respectively.

The lower door 30 may be a drawer type configured to slide inward or outward along a rail.

Referring to FIG. 1A, a dispenser 21 may be disposed in the first upper door 20*a* and configured to discharge water or ice even when the door is not opened.

Referring to FIG. 2, an ice-making chamber 22 may be disposed in the first upper door 20*a* in which the dispenser 21 is provided, and may be configured to make ice.

On an inner surface of the inner case 40 connected to the first upper door 20*a* may be formed an ice-making chamber cold air supply outlet hole 600*b* for supply cold air to the ice-making chamber 22 and an ice-making cold air returning inlet hole 700*a* for returning cold air from the ice-making chamber 22.

The ice-making chamber cold air supply outlet hole 600*b* and the ice-making cold air returning inlet hole 700*a* may be in communication with one surface of the ice-making chamber 22, in a state where the first upper door 20*a* is closed.

The refrigerator compartment 51 may be divided into a first storage chamber 51*a* and a second storage chamber 51*b*.

The second storage chamber 51*b* may be a pantry room that may control the temperature to accommodate a specific storage target such as vegetables or meat.

The first storage chamber 51*a* may refer the other space of the refrigerator compartment 51, except the second storage chamber 51*b*, and may be a main storage space.

For example, the second storage chamber 51*b* may be disposed below the first storage chamber 51*a*, and may be partitioned off as a separate space from the first storage chamber 51*a* by a partitioning member.

A storage drawer 3 may be provided in the second storage chamber 51*b* and configured to slide outward and inward along a rail.

In addition, a storage drawer 3 or a shelf 4 may be provided in the first storage chamber 51*a* to easily keep or preserve fresh storing targets.

Separate temperature sensors may be provided in the first storage chamber 51*a* and the second storage chamber 51*b*, respectively, and configured to independently adjust and keep different temperatures.

[Cold Air Supply System and Connection Relation Between Components]

Hereinafter, referring to FIGS. 3 to 10, a new cold air supply system formed by coupling the inner case, various ducts and a grill fan assembly to each other and the connection relation between them will be described.

Figure 3:
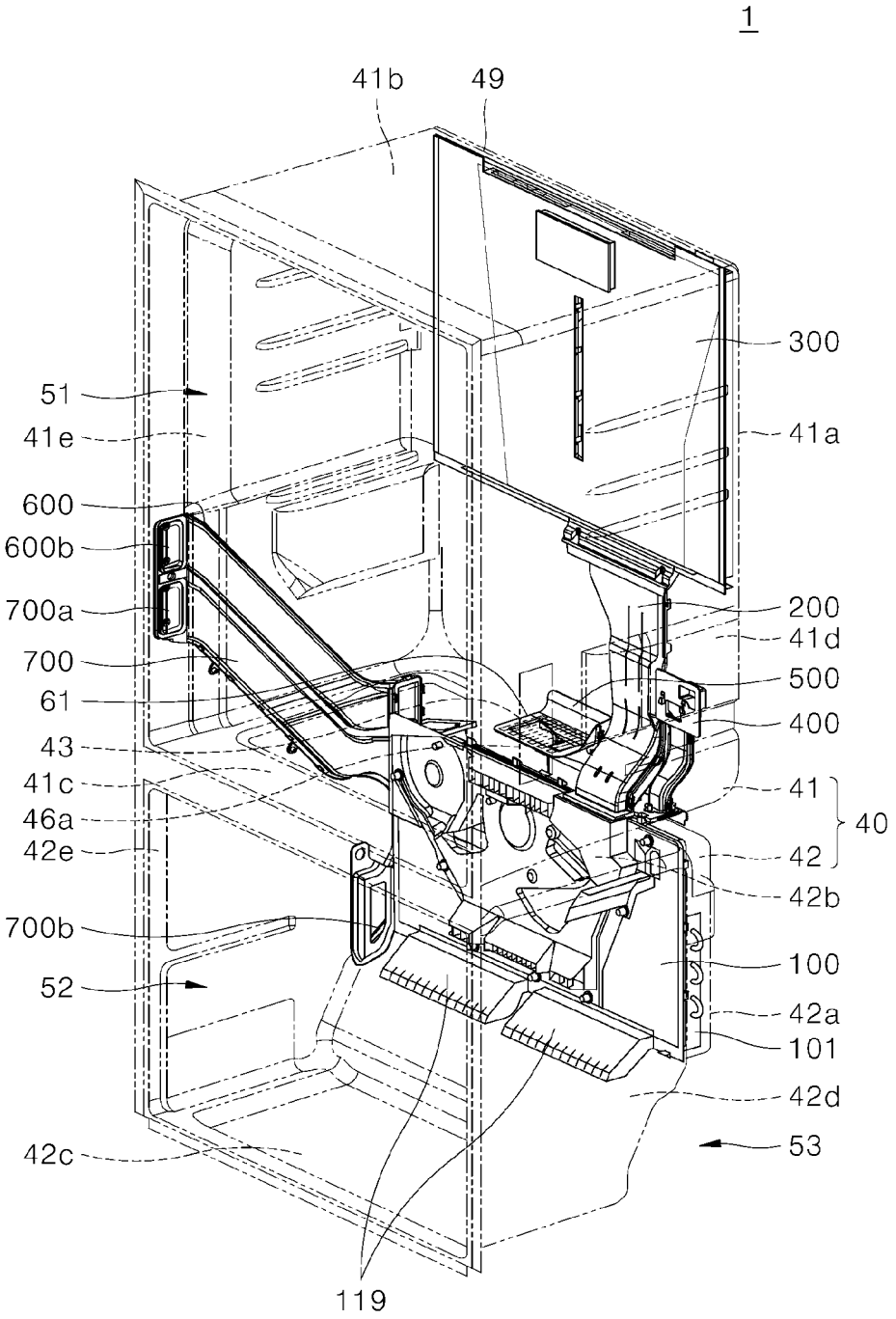
FIGS. 3 and 4 are front and rear perspective views showing a state where an inner case, various ducts and a grill fan assembly are coupled to each other.
Figure 4:
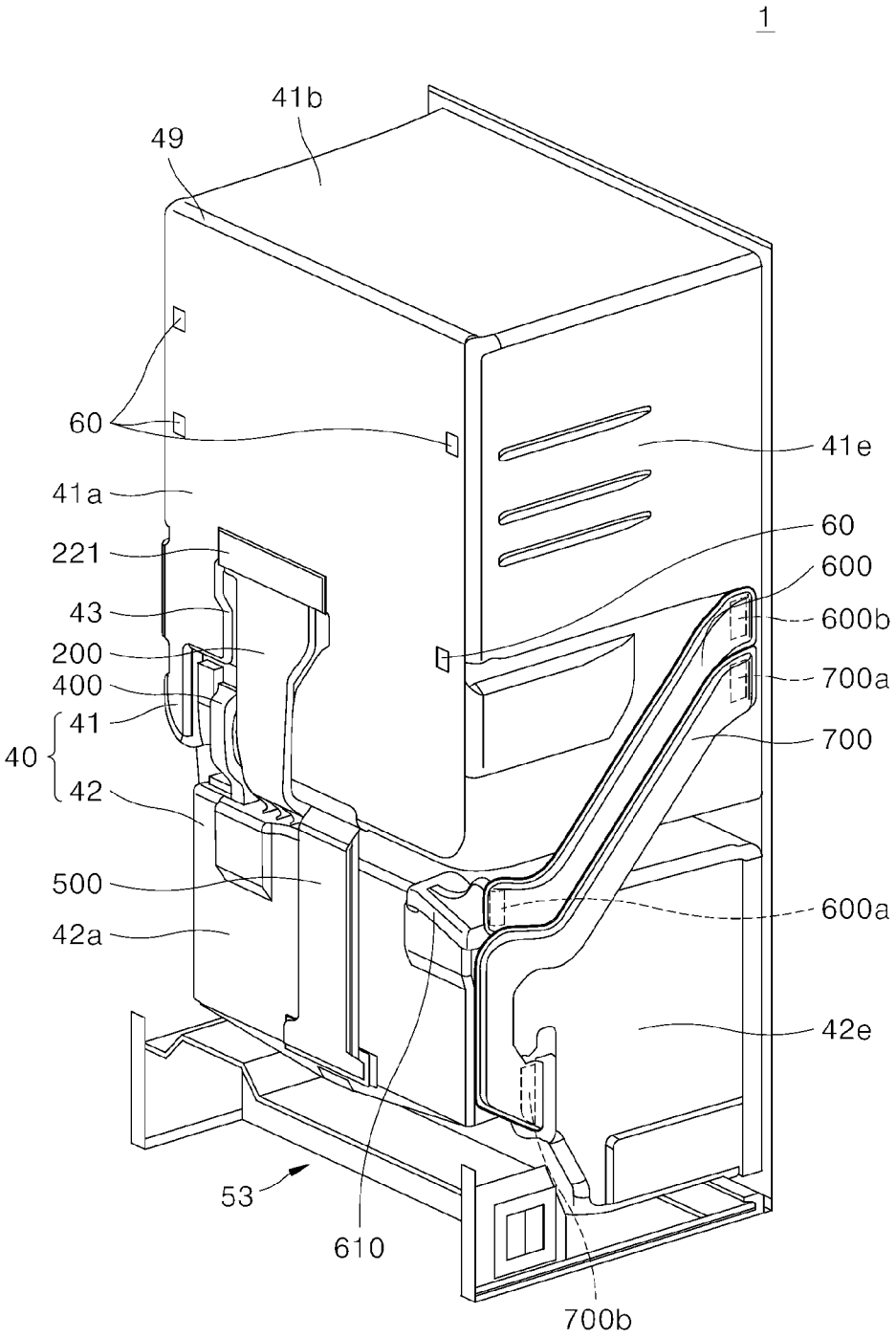
Figure 5:
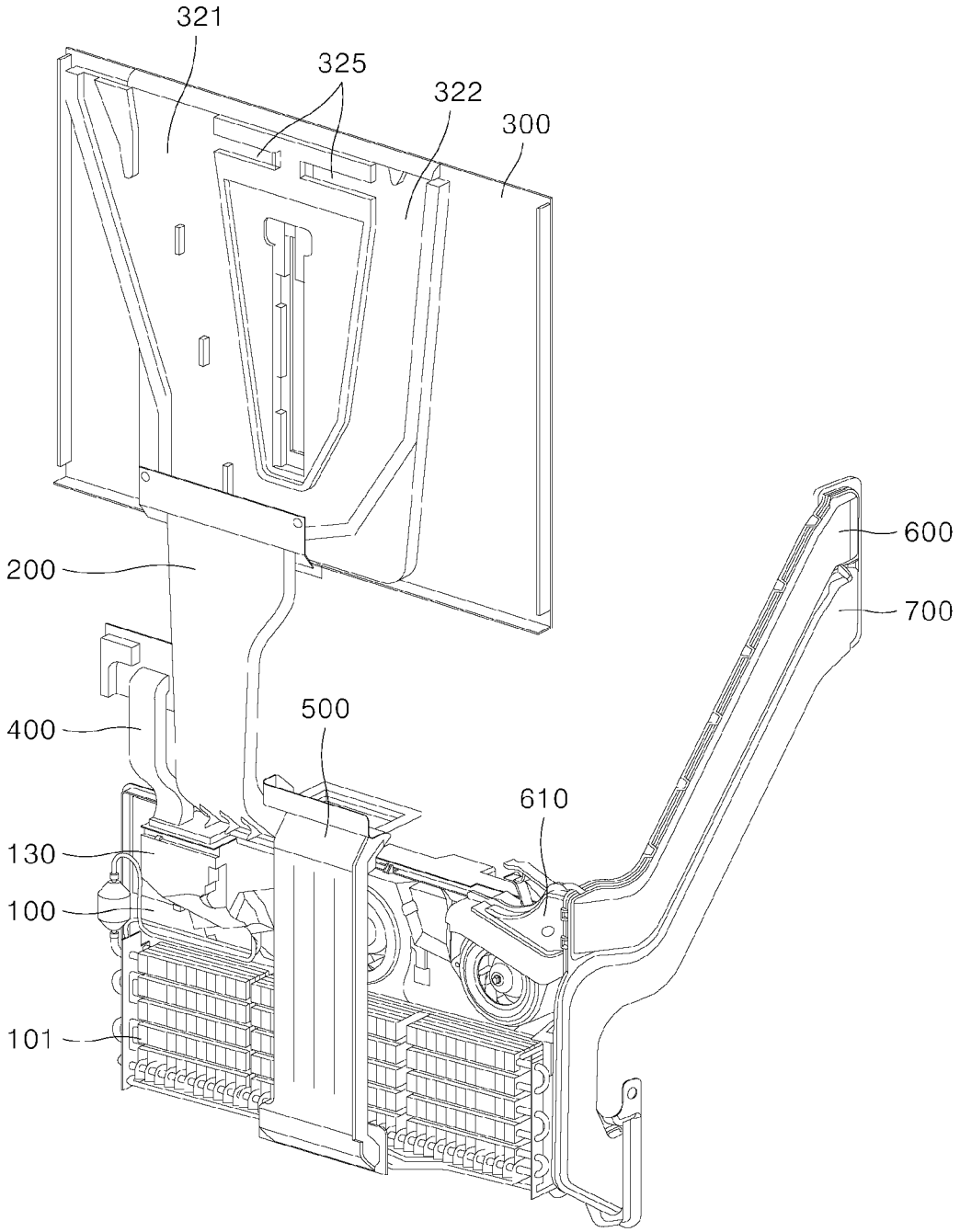
FIG. 5 is a rear perspective view showing a state where various ducts and a grill fan assembly are coupled to each other.
Figure 6:
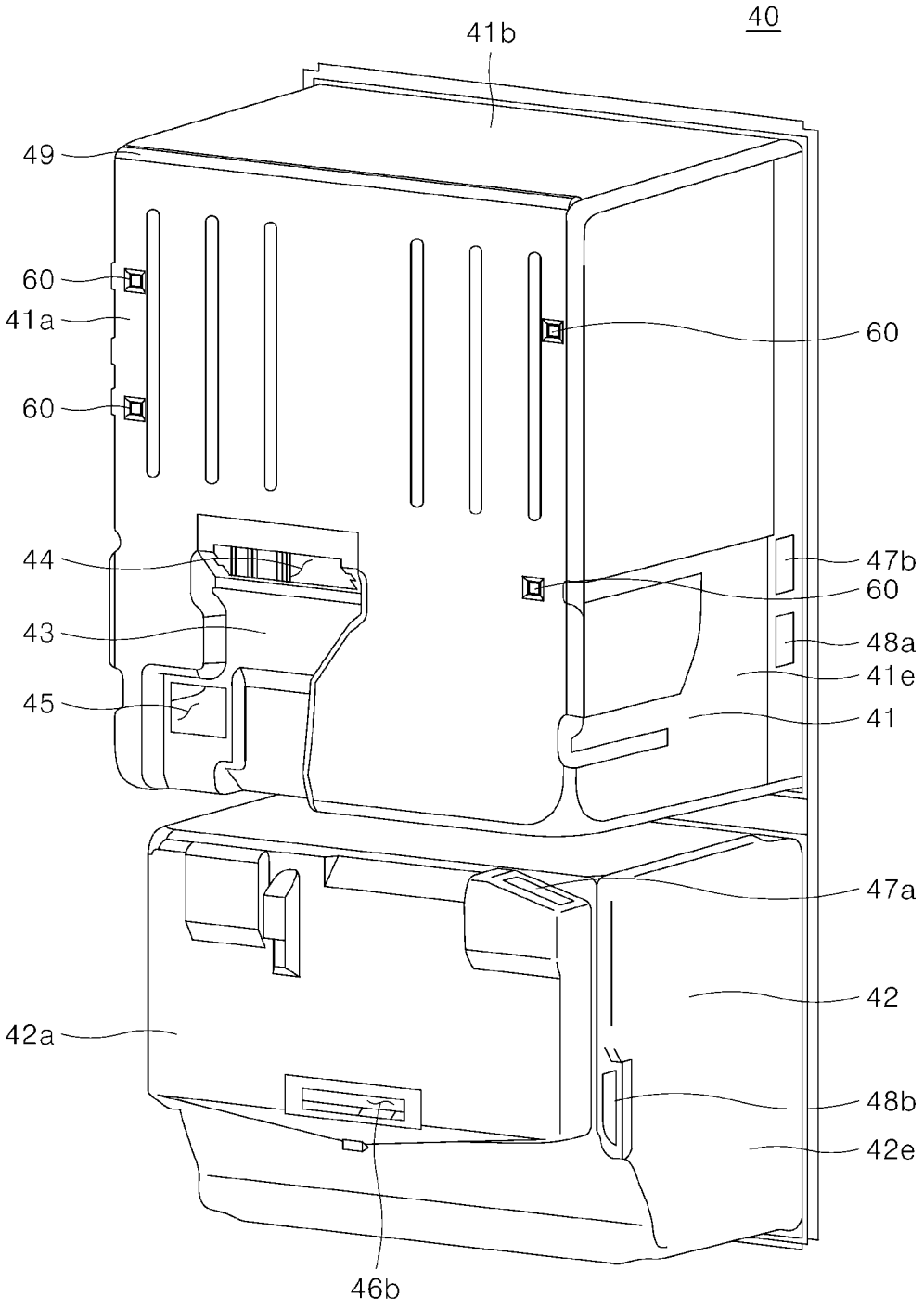
FIG. 6 is a rear perspective view of an inner case.

FIGS. 3 and 4 are front and rear perspective views showing a state where an inner case, various ducts and a grill fan assembly are coupled to each other. FIG. 5 is a rear perspective view showing a state where various ducts and a grill fan assembly are coupled to each other. FIG. 6 is a rear perspective view of an inner case.

Figure 7:
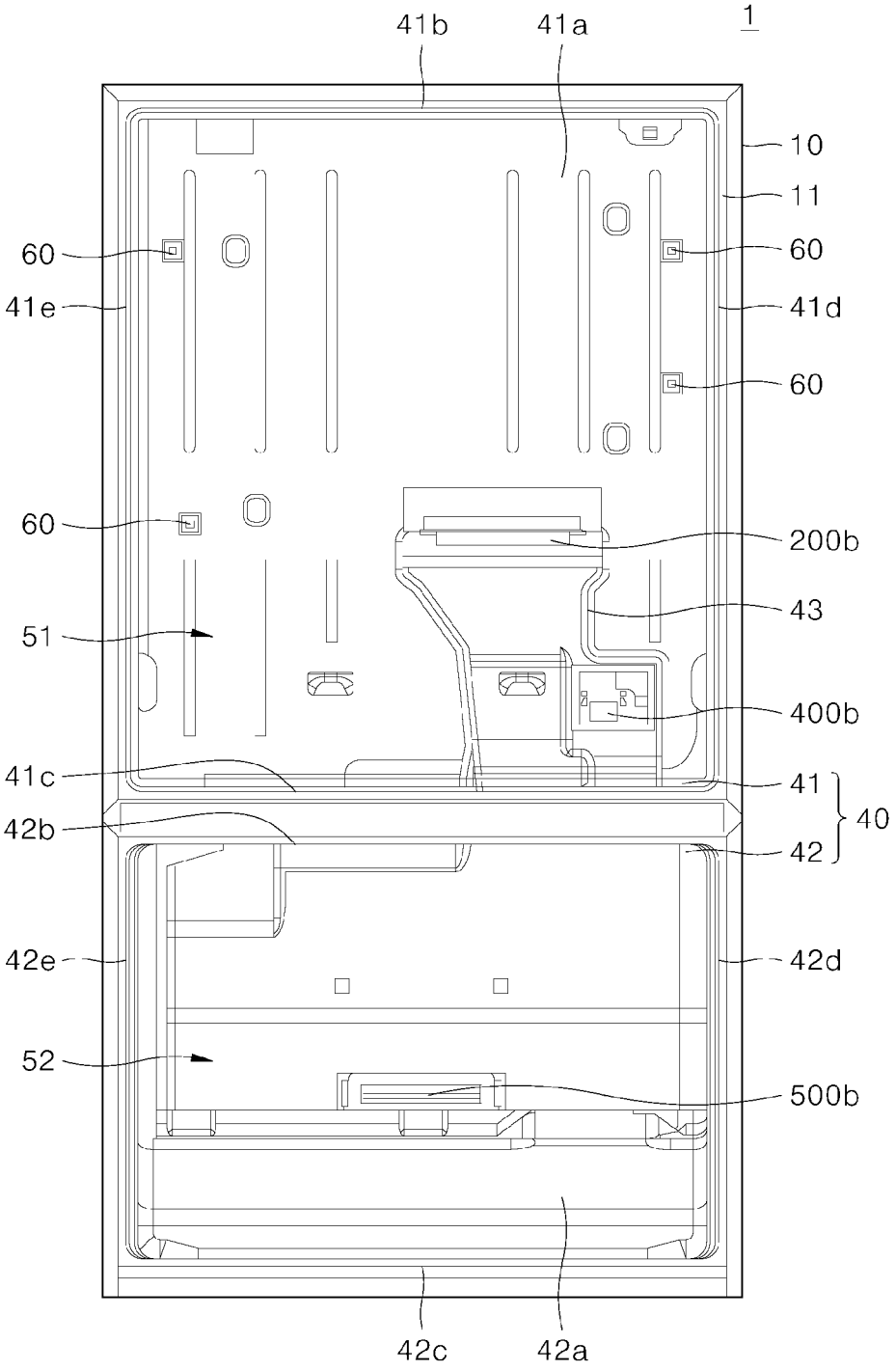
FIG. 7 is a front view of a refrigerator having internal components removed.
Figure 8:
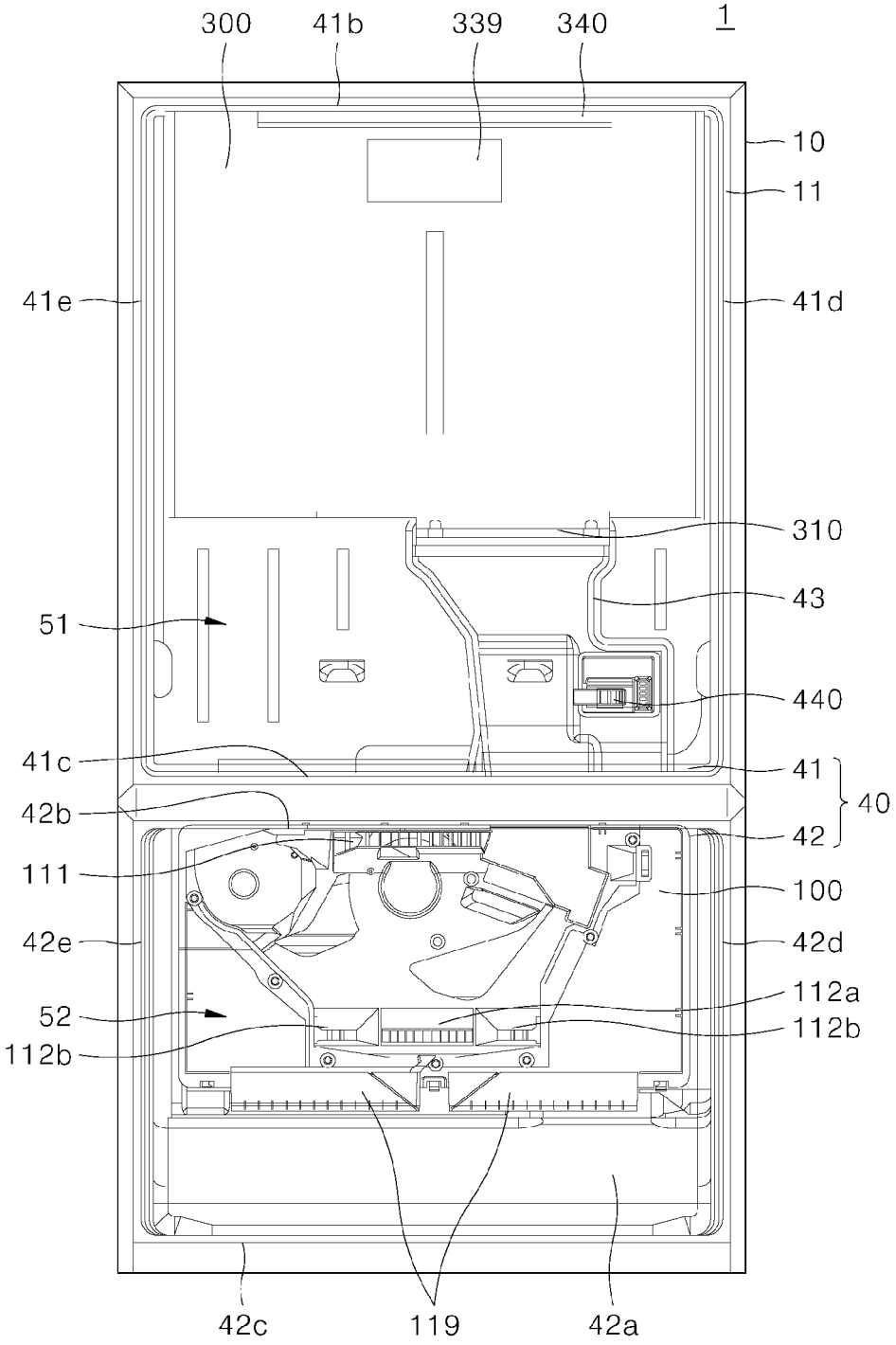
FIG. 8 is a front view of a refrigerator including a grill fan assembly and a refrigerator compartment cold air duct.
Figure 9:
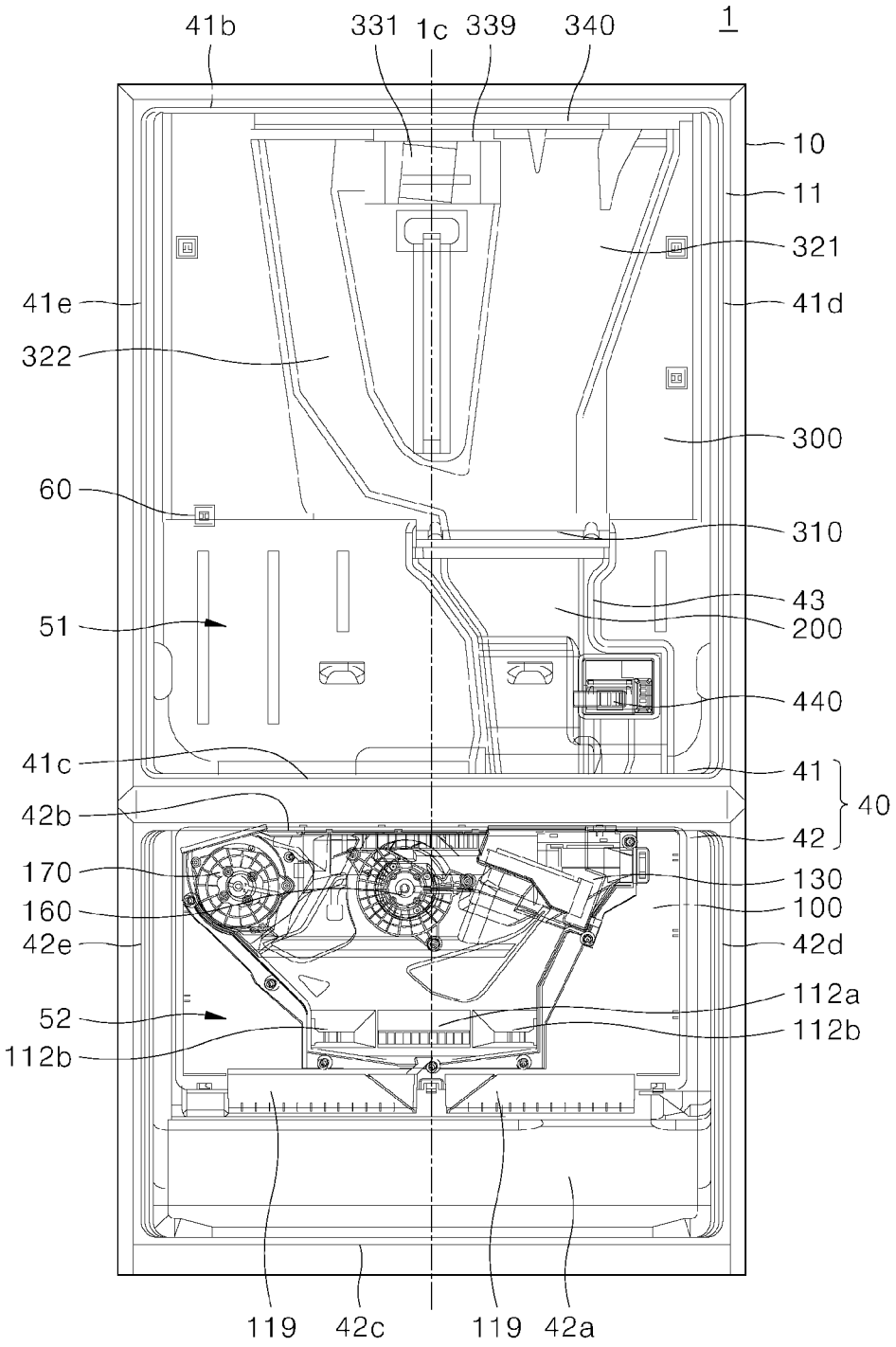
FIG. 9 is a front view of a refrigerator including a grill fan assembly and a refrigerator compartment cold air supply duct, which shows a perspective-viewed inside.
Figure 10:
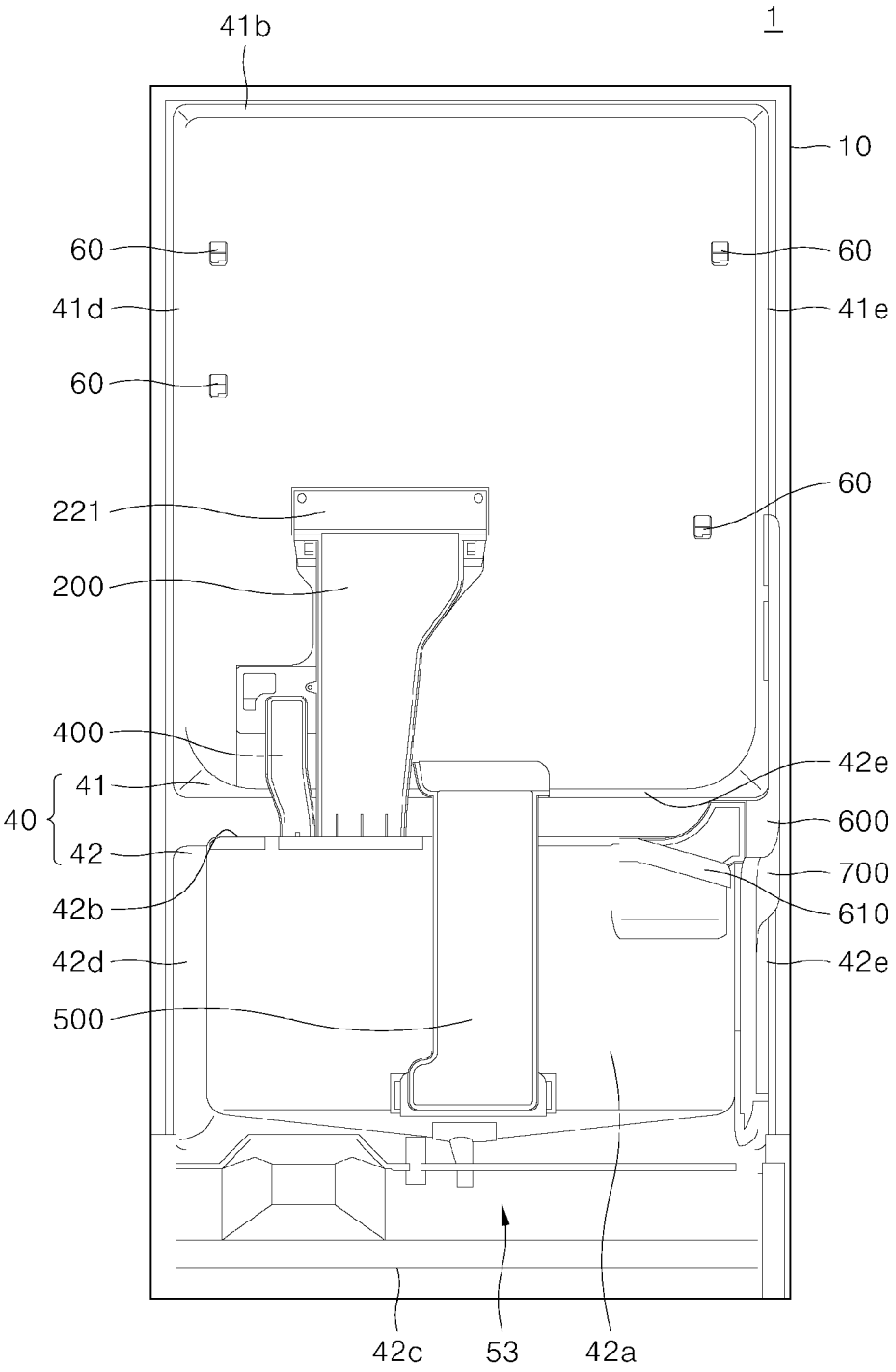
FIG. 10 is a rear view of a refrigerating case to which various ducts are coupled.

FIG. 7 is a front view of a refrigerator having internal components removed. FIG. 8 is a front view of a refrigerator including a grill fan assembly and a refrigerator compartment cold air duct. FIG. 9 is a front view of a refrigerator including a grill fan assembly and a refrigerator compartment cold air supply duct, which shows a perspective-viewed inside. FIG. 10 is a rear view of a refrigerating case to which various ducts are coupled.

The inner case 40 may include a refrigerating case 41 disposed in an upper area and constituting the refrigerator compartment 51, and a freezing case 42 disposed in a lower area and constituting the freezer compartment 52.

The cold air generated by one evaporator 101 may be supplied both of the refrigerator compartment 51 and the freezer compartment 52.

When the ice-making chamber 22 is additionally provided in the upper door 20 of the refrigerator 1, the cold air generated by one evaporator 101 may be supplied to all of the refrigerator compartment 51, the freezer compartment 52 and the ice-making chamber 22.

The evaporator 101 for generating cold air may be disposed inside the freezer compartment 52, specifically, on a rear surface 42*a* of the freezing case 42.

The evaporator 101 may be disposed in an upper area of a mechanical chamber 53.

The mechanical chamber 53 may be provided in a rear lower area of the freezing case 42, and configured to provide a space in which a compressor 54 and a condenser are installed.

The lower rear space inside the freezer compartment 52 may have a relatively narrower freezing space than an upper rear space inside the freezer compartment 52 by the space occupied by the mechanical chamber 53.

In other words, an upper surface 42*b* of the freezing case may have a larger area than a lower surface 42*c* of the freezing case.

Accordingly, an upper region of the freezer compartment 52 may more protrude rearward than a lower region of the freezer compartment 52, so that the evaporator 101 may be disposed in an upper rear space inside the freezer compartment 52.

A grill fan assembly 100 configured to blow the cold air generated by the evaporator 101 to the refrigerator compartment 51 and the freezer compartment 52 may be disposed on a front surface of the evaporator 101.

When the ice-making chamber 22 is provided in the upper door 20 of the refrigerator 1, the cold air generated by one evaporator 101 may be blown from one grill fan assembly 100 to all of the refrigerator compartment 51, the refrigerator compartment 51 and the ice-making chamber 22.

Accordingly, the refrigerator 1 according to the present disclosure may supply the cold air generated by one evaporator 101 not only to the freezer compartment 52 but also to the refrigerator compartment 51.

Since there is no need of securing the space in the refrigerator compartment 51 to accommodate a separate evaporator 101, the inner volume of the refrigerator compartment 51 may be increased.

To blow cold air to a refrigerator compartment cold air supply duct 300, a connection duct 200 may be further provided between the grill fan assembly 100 and the refrigerator compartment cold air supply duct 300.

One end of the connection duct 200 may be connected to the grill fan assembly 100 and the other end of the connection duct 200, so that the cold air blown from the grill fan assembly 100 may be guided to the refrigerator compartment cold air supply duct 300.

The refrigerator compartment cold air supply duct 300 may be disposed on an inner surface the refrigerating case 41, and the connection duct 200 may be disposed on an outer surface of the refrigerating case 41. The refrigerator compartment cold air supply duct 300 and the connection duct 200 may be in communication at a rear surface 41*a* of the refrigerating case.

An insulating material 11 may be foamed in a space between the inner case 40 and the outer case 10 to fill in the space.

The connection duct 200 may be embedded in the space between the inner case 40 and the outer case 10 by passing through the space foamed and filled with the insulating material 11.

Accordingly, when the upper door 20 of the refrigerator 1 is opened, the refrigerator compartment cold air supply duct 300 disposed on the inner surface of the refrigerating case 41 may be exposed to the outside but the connection duct 200 disposed on the outer surface of the refrigerating case 41 may not be exposed.

A rear projected portion 43 protruding to the inside of the refrigerating case 41 may be provided on a rear surface 41*a* of the refrigerating case so that at least predetermined area of the connection duct 200 may be inserted from the outside of the refrigerating case 41.

The rear projected portion 43 may be formed in a shape corresponding to the connection duct 200 to receive the connection duct 200.

The rear projected portion 43 may have a shape extending from a lower surface 41*c* toward an upper surface 41*b* of the refrigerating case along the rear surface 41*a* of the refrigerating case.

The refrigerator compartment cold air supply duct 300 may be disposed in the refrigerating case 41. Accordingly, as the area occupied by the refrigerator compartment cold air supply duct 300 increases, the inner volume of the refrigerating case 41 may decrease.

In particular, the refrigerator compartment cold air supply duct 300 has a cold air flow path for cold air. When the cold air flow path passes through the refrigerator compartment 51 having a relatively humid environment, dew condensation could occur. Accordingly, the refrigerator compartment cold air supply duct 300 may include an insulating material with a predetermined thickness.

To increase the inner volume of the refrigerating case 41, it is necessary to reduce the area occupied by the refrigerator compartment cold air duct 300 disposed on the inner surface of the refrigerating case 41.

The refrigerator compartment cold air supply duct 300 according to the present disclosure may extend to the upper surface 41*b* from the lower surface 41*c* of the refrigerating case, not to be disposed on the rear surface 41*a* of the refrigerating case.

The rear projected portion 43 having a shape extending along the rear surface 41*a* of the refrigerating case may be disposed from the lower surface 41*c* of the refrigerating case to a predetermined height toward the upper surface 41*b* of the refrigerating case.

Since the connection duct 200 is disposed on a rear surface of the rear projected portion 43, the connection duct 200 may be disposed on an outer surface not an inner surface of the refrigerating case 41.

Accordingly, an additional area protruding toward the inside of the refrigerating case 41 except the rear projected portion 43 may be reduced up to the height of the rear projected portion 43 in which the connection duct 200 is inserted, so that the inner volume of the refrigerating case 41 may be increased by that much.

The rear projected portion 43 may extend up to a height near a center area with respect to a vertical direction of the refrigerating case 41, but the present disclosure is not limited thereto.

For example, the rear projected portion 43 may extend to from the lower surface 41*c* of the refrigerating case to a height at which the rear projected portion 43 can be covered by the storage drawer 3.

Alternatively, the rear projected portion 43 may be covered by the second storage chamber 51*b* formed in a lower region of the refrigerating case 41.

The rear projected portion 43 may be extended from the lower surface 41*c* of the refrigerating case up to the height to be covered by the second storage chamber 51*b* formed in the lower region of the refrigerating case 41.

The rear projected portion 43 may be projected in the shape corresponding to the connection duct 200, not a shape protruding evenly from the rear surface 41*a* of the refrigerating case, which is not an aesthetically pleasing shape.

Accordingly, up to the height at which the rear projected portion 43 is formed, the second storage chamber 51*b* and the storage drawer 3 may be disposed in front of the rear projected portion 43 not to expose the rear projected portion 43 even when the upper door 20 is open, thereby increasing the aesthetic effect of the inside of the refrigerator 1.

In addition, since the connection duct 200 is configured to pass through the space between the inner case 40 and the outer case 10 that is formed and filled with the insulating material 11, there is no need of an additional insulation material for preventing heat exchange between the refrigerator compartment 51 and the connection duct 200 through cold air passes.

In order to provide a thermal insulation effect to the refrigerator 1, an insulating material 11 having very low heat conductivity may be foamed between the inner case 40 and the outer case 10 and the space between the inner case 40 and the outer case 10 may be filled.

If the connection duct 200 is provided in the refrigerating case 41, the connection duct 200 may be insulated by providing an insulating material with a predetermined thickness.

Alternatively, the connection duct 200 may be embedded to pass through the space foamed and filled with the insulating material 11 between the inner case 40 and the outer case 10 as described in the embodiment of the present disclosure.

Accordingly, according to the embodiment, a sufficient insulation effect may be provided by using the insulating material 11 already foamed in the space between the inner case 40 and the outer case 10, without adding a separate insulating material for the heat insulation of the connection duct 200.

As a result, according to the embodiment of the present disclosure, no separate heat insulating material for providing the terminal insulation effect to the connection duct 200 is required so that the thickness of the connection duct 200 may be greatly reduced.

Accordingly, the thickness of the rear projected portion 42 protruding toward the inside of the refrigerating case 41 may be greatly reduced, thereby increasing the inner volume of the refrigerator compartment 51.

Accordingly, since the connection duct 200 and the refrigerator compartment cold air supply duct 300 are in communication at the rear surface of the refrigerating case, while having the refrigerating case 41 disposed between them, the refrigerator 1 according to the embodiment of the present disclosure may reduce the area occupied by the refrigerator compartment cold air supply duct 300 disposed on the inner rear surface 41*a* of the refrigerating case.

Due to this structure, the refrigerator according to the embodiment may greatly increase the inner volume of the refrigerator compartment 51.

Figure 12:
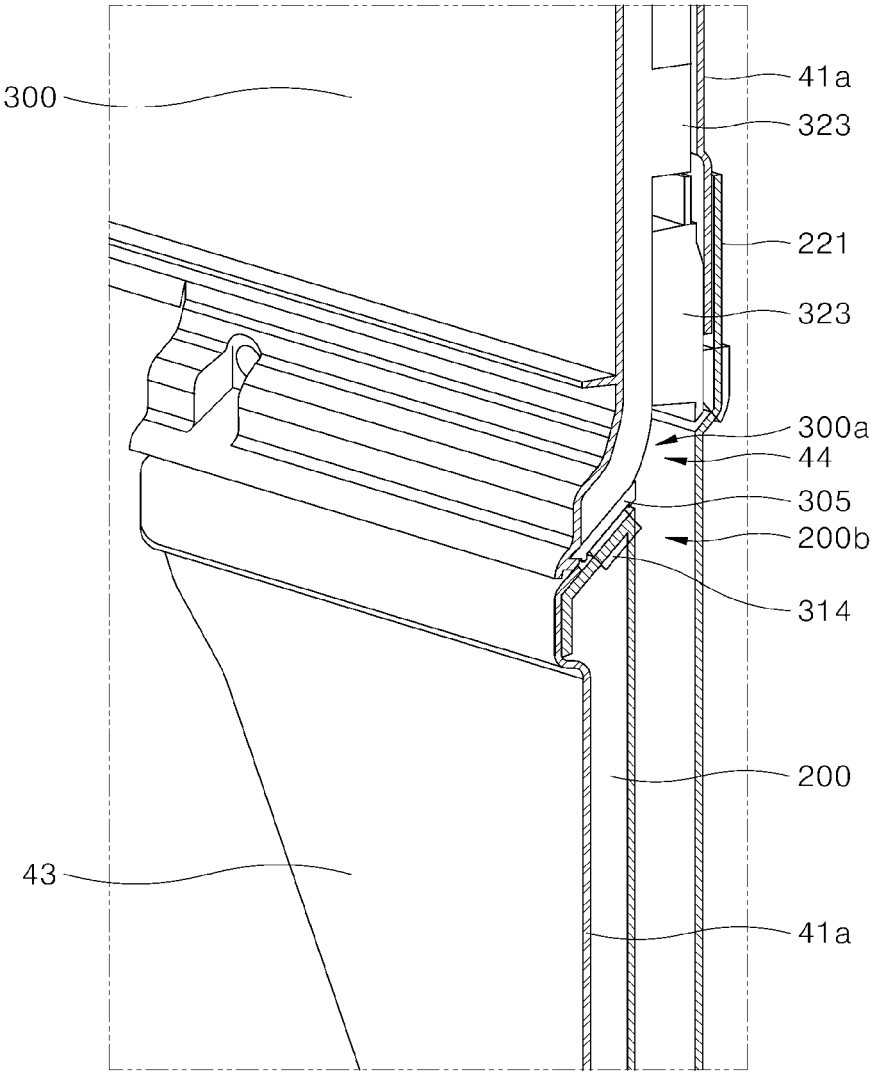
FIGS. 12 and 13 are a side sectional perspective view and a side sectional view that show a connection structure between a refrigerator compartment cold air supply duct and a connection duct.
Figure 13:
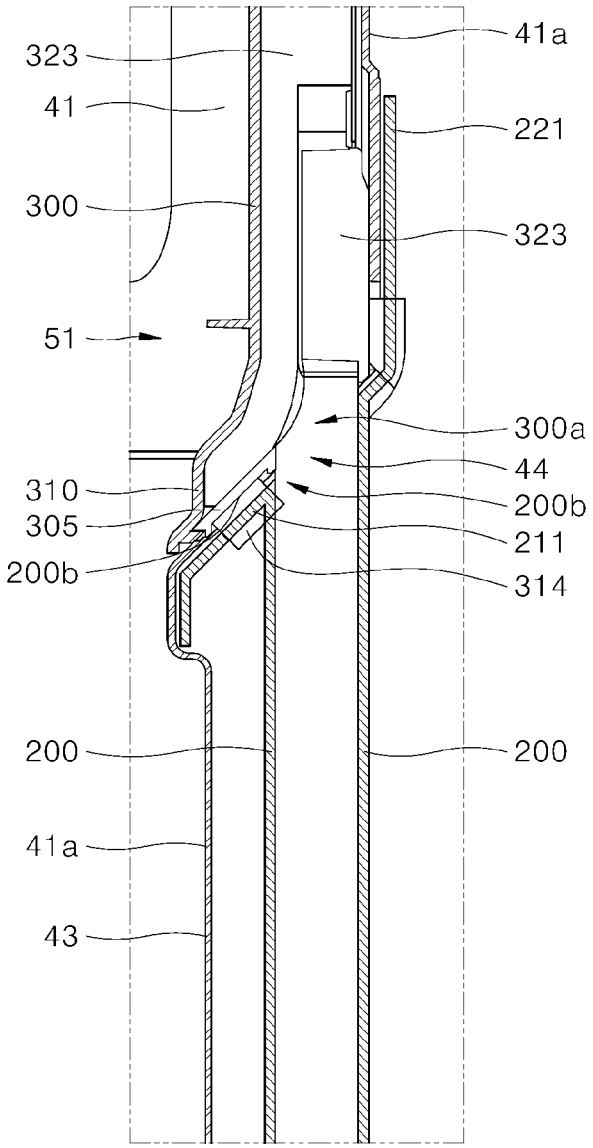

Hereinafter, additionally referring to FIGS. 12 and 13, the connection relationship between the refrigerator compartment cold air supply duct 300 and the connection duct 200 will be described in detail.

The connection duct 200 may be fixed to the refrigerating case 41 to support the rear surface of the rear projected portion 43 and the rear surface 41*a* of the refrigerating case.

A rear extended portion 221 may be vertically extended from a rear end of an upper end of the connection duct 200.

The rear extended portion 221 may be configured to support the rear surface 41*a* of the refrigerating case.

A connection duct securing through hole 223 for securing the connection duct 200 to the rear surface 41*a* of the refrigerating case by using a fastening member such as a bolt may be formed in each side of the rear extended portion 221.

The connection duct 200 may be primarily fixed to the refrigerating case 41 through the connection duct securing through hole 223 by using the fastening member.

Hence, as the insulating material 11 is additionally foamed and filled in the space between the refrigerating case 41 and the outer case 10, the connection duct 200 may be secondarily fixed to the refrigerating case 41 to have a stronger fixing force.

The upper surface of the connection duct 200 may be configured to support a rear surface of the rear projected portion 43, and the rear extended portion 2221 of the connection duct 200 may be configured to support the rear surface 41*a* of the refrigerating case.

Accordingly, the connection duct 200 may provide the refrigerating case 41 with a strong supporting force at the lower surface and the rear surface of the refrigerating case 41 simultaneously.

As described above, the connection duct 200 according to the embodiment may serve not only to transfer the cold air generated by the evaporator 101 to the refrigerator compartment cold air supply duct 300 but also to strongly support the refrigerating case 41 as a support member.

The rear projected portion 43 may include a refrigerator compartment cold air supply communication hole 44 for facilitate communication between the connection duct 200 and the refrigerator compartment cold air supply duct 300.

The connection duct 200 and the refrigerator compartment cold air supply duct 300 may be in communication through the refrigerator compartment cold air supply communication hole 44, with the refrigerating case disposed therebetween.

The refrigerator compartment cold air supply communication hole 44 may be provided on the upper surface of the rear projected portion 43, and the upper surface of the rear projected portion 43 may have an inclined surface that descends in a direction to the front surface of the refrigerator compartment 51.

A refrigerator compartment cold air guide outlet hole 200*b* may be provided on the upper surface of the connection duct 200 and the upper surface of the connection duct 200 may have an inclined surface that descends in a direction to the front surface of the refrigerator compartment 51.

A refrigerator compartment cold air inlet hoe 300*a* may be disposed on the lower surface of the refrigerator compartment cold air supply duct 300, and the lower surface of the refrigerator compartment cold air supply duct 300 may have an inclined surface that descends in a direction to the front surface of the refrigerator compartment 51.

A refrigerator compartment cold air supply connecting portion 310 may be extended downward from a lower surface of the refrigerator compartment cold air supply duct 300.

The refrigerator compartment cold air supply connecting portion 310 may have a shape corresponding to the upper surface of the connection duct 200 to be coupled to the upper surface of the connection duct 200.

The refrigerator compartment cold air supply connecting portion 310 may have a left-and-right width narrower than the entire left-and-right width of the refrigerator compartment cold air supply duct 300, and may have a shape protruding downward.

The left-and-right width of the refrigerator compartment cold air supply connecting portion 310 may be substantially equal to that of the upper surface of the connection duct 200 coupled to the refrigerator compartment cold air supply connecting portion.

The refrigerator compartment cold air inlet hole 300*a* formed on the lower surface of the refrigerator compartment cold air supply duct 300 may be formed in the refrigerator compartment cold air supply connecting portion 310 extended downward with respect to the refrigerator compartment cold air supply duct 300.

An inclined surface that descends in a direction to the front surface of the refrigerator compartment 51, so that the inclined surface of the rear projected portion 43, the inclined surface of the upper surface of the connection duct 200 and the inclined surface of the lower surface of the refrigerator compartment cold air supply duct 300 may have substantially the same angle.

The upper surface of the connection duct 200 and the lower surface of the refrigerator compartment cold air supply duct 300 may be coupled to each other so that the inclined surfaces may face each other with the rear projected portion 43 of the refrigerating case 41 interposed therebetween.

Specifically, the inclined surface of the upper surface of the connection duct 200 and the inclined surface of the lower surface of the refrigerator compartment cold air supply duct 300 may be fixedly coupled to each other with the inclined surface of the rear projected portion 43 interposed therebetween.

In this instance, the lower surface of the refrigerator compartment cold air supply duct 300 fixedly coupled to the inclined surface of the upper surface of the connection duct 200 may be the lower surface of the refrigerator compartment cold air supply connecting portion 310.

A duct bottom cover 305 configured to cover the lower surface of the refrigerator compartment cold air supply connecting portion 310 may be further disposed underneath the refrigerator compartment cold air supply connecting portion 310.

The lower surface of the refrigerator compartment cold air supply duct 300 fixedly coupled to the inclined surface of the upper surface of the connection duct 200 may be a duct bottom cover 305.

A refrigerator compartment cold air inlet hole 300*a* may be formed even on the duct bottom cover 305 and configured to receive the cold air guided from the connection duct 200 into the refrigerator compartment cold air supply duct 300.

The inclined surface of the rear projected portion 43, the inclined surface of the upper surface of the connection duct 200 and the inclined surface of the lower surface of the refrigerator compartment cold air supply duct 300 may be fixed coupled to each other, so that the refrigerator compartment cold air guide outlet hole 200*b*, the refrigerator compartment cold air supply communication hole 44 and the refrigerator compartment cold air inlet hole 300*a* may be disposed in communication with each other.

Due to the above-described cold air flow path communication structure, the cold air generated by the evaporator 101 may be supplied to the refrigerator compartment 51 from the freezer compartment 52.

Meanwhile, a duct inserting groove 49 in which some upper region of the refrigerator compartment cold air supply duct 300 is fixedly inserted may be provided on the upper surface 41*b* of the refrigerating case.

The duct inserting groove 49 may be provided along an area in which the upper surface 41*b* meets the rear surface 41*a* of the refrigerating case.

The duct inserting groove 49 may be formed in a protrusion shape protruding upward, viewed above the upper surface 41*b* of the refrigerating case, or a concave shape recessed upward, viewed below the upper surface 41*b* of the refrigerating case.

The front-rear width of the duct inserting groove 49 may be formed slightly longer than the front-rear width of the upper region of the refrigerator compartment cold air supply duct 300, so that the upper region of the refrigerator compartment cold air supply duct 300 may be smoothly inserted and fixed in the duct inserting groove 49.

The upper region of the refrigerator compartment cold air supply duct 300 may be strongly fixed by being inserted in the duct inserting groove 49 to be in surface-to-surface contact.

As described above, the upper surface of the connection duct 200 and the lower surface of the refrigerator compartment cold air supply duct may have the respective inclined surfaces coupled to each other, the inclined surfaces may descend in the direction to the front surface of the refrigerator compartment 51.

Due to the coupling structure of the inclined surfaces, the upper region of the refrigerator compartment cold air supply duct 300 may be first inserted in the duct inserting groove 49, and may then couple the refrigerator compartment cold air supply duct 300 while pushing the refrigerator compartment cold air supply duct 300 upward.

In this instance, the lower surface of the refrigerator compartment cold air supply duct 300 coupled to the upper surface of the connection duct 200 may be the lower surface of the refrigerator compartment cold air supply connecting portion 310.

Accordingly, after some area of the upper region of the refrigerator compartment cold air supply duct 300 is inserted in the duct inserting groove 49, the upper surface of the connection duct 200 and the lower surface of the refrigerator compartment cold air supply connecting portion 310, which have the respective surfaces, may be fixedly coupled to each other in a sliding manner while pushing the refrigerator compartment cold air supply duct 200 upward.

As described above, the upper surface of the connection duct 200 and the lower surface of the refrigerator compartment cold air supply duct 300 may be coupled to each other to make the respective inclined surfaces face each other with the rear projected portion 43 of the refrigerating case 41 interposed therebetween.

Accordingly, some area of the upper region of the refrigerator compartment cold air supply duct 300 may be smoothly inserted in the duct inserting groove 49 disposed on the upper surface 41*b* of the refrigerating case to be strongly fixed.

Since the refrigerator compartment cold air supply duct 300 is easily and quickly coupled to the inside of the refrigerator compartment 51 as a module assembly type, workability may be greatly improved.

In addition, the upper region of the refrigerator compartment cold air supply duct 300 may be inserted and strongly fixed in the duct inserting groove 49 to be in surface-to-surface contact, even without separate fastening means, thereby greatly improving process simplification and workability.

A hook securing portion 211 may be formed on the upper surface of the connection duct 200 slidingly coupled to the lower surface of the refrigerator compartment cold air supply duct 300, and configured to guide the sliding-coupling.

A hook 314 may be formed on the lower surface of the refrigerator compartment cold air supply connecting portion 310 and configured to be guided and secured to the hook securing portion 211 of the connection duct 200.

When the duct bottom cover 305 is further disposed on the lower surface of the refrigerator compartment cold air supply connecting portion 310, a hook 314 may be formed on the duct bottom cover 305 to be guided and secured to the hook securing portion 211 of the connection duct 200.

A connection duct securing member 213 may protrude from the upper surface of the connection duct 200 in a direction to the front surface of the refrigerator 51.

A fastening member through hole 313 through which a fastening member 311 such as a bolt passes to be fastened to the connection duct securing member 213 may be formed on the lower surface of the refrigerator compartment cold air supply connecting portion 310.

As the hook securing portion 211 is formed on the upper surface of the connection duct 200, it may be possible to guide an accurate coupling position in the process of coupling connection duct to the refrigerator compartment cold air supply duct 300.

Since the connection duct securing member 213 is formed on the upper surface of the connection duct 200, the stronger securing force with the refrigerator compartment cold air supply duct 300 may be provided.

Accordingly, the upper region of the refrigerator cold air supply duct 300 according to the embodiment of the present disclosure may have some area inserted in the duct inserting groove 49 even without separate fastening means, thereby strongly fixing the upper region.

The lower region of the refrigerator compartment cold air supply duct 300 may be strongly fixed by using only the fastening member 311 such as a bolt. Accordingly, the workability of workers who assemble in the form of module assembly may be greatly improved.

The refrigerator 1 according to the present disclosure may include a refrigerator compartment cold air returning duct configured to return and supply the cold air of the refrigerator compartment to the evaporator 101.

The refrigerator compartment cold air returning duct 500 may have one end connected to the freezer compartment 52 and the other end connected to the refrigerator compartment 51. The both ends of the refrigerator compartment cold air returning duct 500 may overlap with each other in a vertical direction.

One end of the refrigerator compartment cold air returning duct 500 may be configured to communicate with the freezer compartment 52 through a refrigerator compartment returning communication outlet hole 46*b*.

The refrigerator compartment cold air returning duct 500 may pass through the rear surface of the evaporator 101.

If the refrigerator compartment cold air returning duct 500 is disposed too close to the evaporator 101, dew condensation could occur. Accordingly, the refrigerator compartment cold air returning duct 500 may be spaced apart a preset distance apart from the evaporator 101.

In particular, since the refrigerator compartment cold air returning duct 500 may have a cold air flow path, frost could be more likely to occur.

Accordingly, one end and the other end of the refrigerator compartment cold air returning duct 500 may be disposed to overlap with each other in the vertical direction in order to have a cold air flow path as short as possible.

In addition, both lateral surfaces of the refrigerator compartment cold air returning duct 500 may be formed in a straight line shape parallel to each other by reducing curvature as much as possible. Accordingly, the refrigerator compartment cold air returning duct 500 may allow the cold air flow path corresponding to the area overlapping the evaporator 101 to have the shortest distance.

Accordingly, the refrigerator compartment cold air returning duct 500 may the shortest length of the area overlapping the evaporator 101, so that the possibility of frost may be reduced.

In addition, the refrigerator compartment cold air returning duct 500 can uniformly form frost without biasing the cold air passing through the refrigerator compartment cold air returning duct, or can reduce the formation of frost.

One end and the other end of the refrigerator compartment cold air returning duct 500 may be disposed to pass through the center of the refrigerator compartment 51 and the center of the freezer compartment 52 with respect to the left-right direction.

A refrigerator compartment cold air returning communication hole 61 in communication with the other end of the refrigerator compartment cold air returning duct 500 may be provided on the lower surface 41*c* of the refrigerating case. The refrigerator compartment cold air returning communication hole 61 may be disposed to pass through the center 1*c* of the refrigerator compartment 51.

It is possible to balance the overall cold air of the refrigerator 1, because one end and the other end of the refrigerator compartment cold air returning duct 500 are disposed to pass through the center of the refrigerator compartment 51 and the center of the freezer compartment 52 with respect to the left-right direction, thereby balancing the overall cold air inside the refrigerator 1.

The refrigerator compartment returning duct 500 may be configured to return the cold air circulating after supplied to the refrigerator compartment 51 to the freezer compartment 52.

The other end of the refrigerator compartment cold air returning duct 500 in communication with the refrigerator compartment cold air returning communication hole 61 for returning the cold air from the refrigerator compartment 51 may be disposed to pass through the center of the refrigerator compartment 51, thereby inducing the cold air returning pass flow as naturally as possible.

Referring to FIGS. 23A and 23B additionally, a returning duct rear extended portion 521 may be formed at the other end of the refrigerator compartment cold air returning duct 500. The returning duct rear extended portion 521 may be vertically extended along a rear end of the upper surface of the refrigerator compartment cold air returning duct 500.

In addition, a returning duct side extended portion 522 may be formed at the other end of the refrigerator compartment cold air returning duct 500. The returning duct side extended portion 522 may be vertically extended along one side end of the upper surface of the refrigerator compartment cold air returning duct 500.

The returning duct rear extended portion 521 and the returning duct side extended portion 522 may be connected to each other.

Accordingly, the other end of the refrigerator compartment cold air returning duct 500 may be fixed to the refrigerating case 41 to support the lower surface 41*c* and the rear surface 41*a* of the refrigerating case.

Specifically, the other end of the refrigerator compartment cold air returning duct 500 may be configured to support the lower surface 41*c* of the refrigerating case, and the returning duct rear extended portion 521 and the returning duct side extended portion 522 may be configured to support the rear surface of the refrigerating case 41.

In this instance, the returning duct side extended portion 522 may be configured to partially support a rear surface of the duct inserting groove 49.

The refrigerator compartment cold air returning duct 500 according to the embodiment of the present disclosure may serve not only to return the cold air of the refrigerator compartment 51 but also serve as a support member capable of strongly supporting the refrigerating case 41.

The connection duct 200 described above may be disposed between the refrigerator compartment cold air returning duct 500 and the lateral surface 41*d* of the refrigerating case that is one lateral surface of the refrigerator compartment 51 with respect to the left-right direction.

In the connection duct 200 having one end connected to the freezer compartment 52 and the other end connected to the refrigerator compartment 51, the width of the cold air flow path may increase from one end to the other end of the connection duct 200.

In this instance. The width of the cold air flow path of the connection duct 200 may increase in a direction toward the center of the refrigerating compartment 51.

The other end of the connection duct 200 may be disposed to pass through the center of the refrigerator compartment 51 in the left-right direction.

As mentioned above, the connection duct 200 may be disposed between the refrigerator compartment cold air returning duct 500 and one lateral surface of the refrigerator compartment 51, and the width of the cold air flow path may increase in the direction toward the center o the refrigerator compartment 51, so that it may be possible to balance the overall cold air of the refrigerator 1.

In addition, since the other end of the connection duct 200 is in communication with the refrigerator compartment cold air supply duct 300, the connection duct 200 and the refrigerator compartment cold air supply duct 300 may communicate with each other at the center of the refrigerator compartment 51 as much as possible.

The refrigerator compartment 51 may be divided into a first storage chamber Ma and a second storage chamber 51*b*.

A second storage chamber cold air supply duct 400 may be configured to supply cold air to the second storage chamber 51*b*, and the second storage cold air supply duct 400 may be disposed on the outer surface of the refrigerating case 41.

The heat insulating material 11 may be foamed and filled in the space between the inner case 40 and the outer case 10.

The second storage chamber cold air supply duct 400 may be disposed to pass through the space foamed and filled with the insulating material 11, to be embedded in the space between the inner case 40 and the outer case 10.

The second storage chamber cold air supply duct 400 disposed on the outside of the refrigerating case 41 may not be exposed when the upper door 20 of the refrigerator 1 is opened.

As described above, the rear projected portion 43 projected inward of the refrigerating case 41 may be provided on the rear surface 41*a* of the refrigerating case in order to receive at least predetermined area of the connection duct 200 from the outside o the refrigerating case 41.

In this instance, the rear projected portion 43 may be formed in a shape capable of receiving the at least predetermined area of the second storage chamber cold air supply duct 400 in addition to the shape capable of receiving the connection duct 200.

The connection duct 200 and the second storage chamber cold air supply duct 400 may be disposed adjacent to each other.

For example, the second storage chamber cold air supply duct 400 may be disposed between the connection duct 200 and the lateral surface 41*d* of the refrigerating case that is one surface of the refrigerator compartment 51.

Since the second storage chamber cold air supply duct 400 is configured to supply cold air to the second storage chamber 51*b*, with the shape embedded in the outer surface of the refrigerating case 41, the area projected toward the inside of the refrigerator compartment 51 may be reduced and the inner volume of the refrigerator compartment 51 may be then increased.

In addition, since the second storage chamber cold air supply duct 400 is disposed to pass through the space between the inner case 40 and the outer case 10, which is foamed with the insulating material 11, there is no need of providing an additional insulating material for preventing heat exchange between the second storage cold air supply duct 400 through which the cold air passes.

According to the embodiment of the present disclosure, sufficient insulation effect may be achieved by using the insulating material 11 foamed According to the embodiment of the present disclosure, a separate heat insulating member for imparting an insulating effect to the second storage chamber cold air supply duct 400 may not additionally required so that the thickness of the second storage chamber cold air supply duct 400 may be greatly reduced.

Accordingly, the thickness of the rear projected portion 43 projected toward the inside of the refrigerating case 41 may be greatly reduced so that the inner volume of the refrigerator compartment 51 may be increased.

Figure 11:
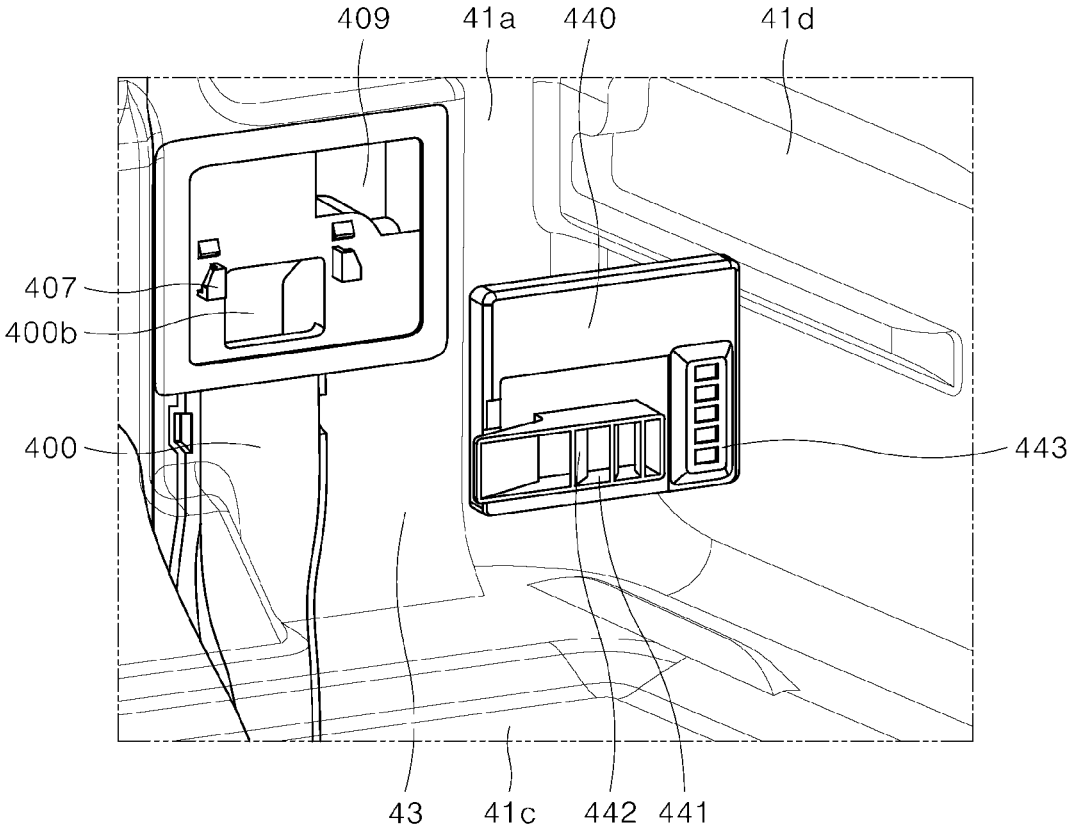
FIG. 11 is a view of a second storage chamber cold air outlet cover coupled to a second storage chamber cold air supply duct.

Referring to FIG. 11, a second storage chamber cold air outlet cover 440 may be provided on a front surface of the other end of the second storage chamber cold air supply duct 400 connected to the second storage chamber 51*b*.

The second storage chamber cold air outlet cover 440 may be disposed inside the refrigerating case 41.

The other end of the second storage chamber cold air supply duct 400 may have a flat plate shape directed toward the front surface of the refrigerator compartment 51 to communicate with the second storage chamber cold air supply communication hole 45 formed in the rear surface 41*a* of the refrigerating case.

Specifically, the second storage chamber cold air supply outlet 400*b* may be formed in the other end of the second storage chamber cold air supply duct 400 to be in communication with the second storage chamber cold air supply communication hole 45 formed in the rear surface 41*a* of the refrigerating case.

A temperature sensor inserting portion 409 for receiving a temperature sensor may be formed in the other end of the second storage chamber cold air supply duct 400 and configured to sense the temperature of the second storage chamber 51*b* in order to adjust cold air supply of cold air to the second storage chamber 51*b*.

In addition, a pair of second storage chamber cover coupling members may be formed in the other end of the second storage cold air supply duct 400 to facilitate the coupling and decoupling of the second storage chamber cold air outlet cover 440 disposed on the front surface.

The second storage chamber cover coupling member 407 may have a shape that may be hooked to the second storage chamber cold air outlet cover 440.

The second storage cold air outlet cover 440 may include a second storage chamber temperature sensor 443 configured to sense the temperature of the second storage chamber 51*b* by exposing the temperature sensor.

The second storage chamber cold air outlet cover 440 may include a second storage chamber cold air outlet guide 441 configured to guide a direction of discharging the cold air supplied to the second storage chamber 51*b*.

The second storage chamber cold air supply duct 400 may be disposed adjacent to the lateral surface 41*d* of the refrigerating case with respect to the center of the refrigerator compartment 51. Due to that, the cold air of the second storage chamber may be discharged in a state of being biased toward the lateral surface 41*d* of the refrigerating case.

Accordingly, the second storage chamber cold air outlet guide 441 may have a plurality of guide ribs 442 formed to guide the cold air in a direction as much as possible toward the other lateral surface 41*e* of the refrigerating case in order to guide the cold air toward the other lateral surface 41*e* of the refrigerating case.

Accordingly, the cold air inside the second storage chamber 51*b* may be circulated inside the second storage chamber 51*b* as uniformly as possible.

The second storage chamber cold air supply duct 400 may be embedded in the space between the inner case 40 and the outer case 10, which is foamed with the insulating material 11.

Accordingly, since only the second storage chamber cold air outlet cover 440 is disposed inside the inner case 40, the projected area inside the refrigerator compartment 51 for accommodating components related to the second storage chamber cold air supply system may be reduced only to increase the inner volume of the refrigerator compartment 51.

The refrigerator 1 according to the present disclosure may include the ice-making chamber 22 provided in the upper door 20 configured to open and the close the refrigerator compartment 51.

The cold air generated by the evaporator 101 may be supplied to the ice-making chamber 22 through an ice-making chamber cold air supply duct 600.

An ice-making chamber cold air supply inlet hole 600*a* may be formed in one end of the ice-making chamber cold air supply duct 600 to be in communication with the grill fan assembly 100 through an ice-making chamber cold air supply communication inlet hole 47*a* of the freezing case 42.

In this instance, an ice-making cold air guide duct 610 may be disposed between the ice-making chamber cold air supply duct 600 and the grill fan assembly 100 to facilitate communication between the cold air supply duct 600 and the frill fan assembly 100.

The ice-making chamber cold air supply duct 610 may be configured to switch a direction of the cold air discharged from the frill fan assembly 100.

For example, the ice-making chamber cold air supply communication inlet hole 47*a* for discharging the cold air from the grill fan assembly 100 may be formed as a through-hole formed upward to have an inclined surface toward the other lateral surface 42*e* of the freezing case.

The ice-making chamber cold air guide duct 610 may be in communication with the ice-making chamber cold air supply communication inlet hole 47*a* to switch a flow direction of the discharged cold air.

The other end of the ice-making chamber cold air supply duct 600 may be in communication with the ice-making chamber 22 through the ice-making chamber cold air supply communication outlet hole 47*b* formed on the other surface 41*e* of the refrigerating case.

The cold air circulated in the ice-making chamber 22 may return to the freezer compartment 52 through an ice-making chamber cold air returning duct 700.

An ice-making chamber cold air returning outlet hole 700*b* may be formed in one end of the ice-making chamber cold air returning duct 700 to communicate with the freezer compartment 52 through an ice-making chamber cold air returning communication outlet hole 48*b* formed on the other lateral surface 42*e* of the freezing case.

An ice-making returning inlet hole 700*a* may be formed in the other end of the ice-making chamber cold air returning duct 700 to communicate with the ice-making chamber 22 through an ice-making chamber cold air returning communication inlet hole 48*a* formed on the other lateral surface 42*e* of the freezing case.

As another example, when the ice-making chamber 22 is disposed in the second upper door 20*b*, the ice-making chamber cold air returning communication outlet hole 48*b* and the ice-making chamber cold air returning communication inlet hole 48*a* may be disposed on one lateral surface 42*d* of the freezing case.

As described above, the upper door 20 including the ice-making chamber 22 may be positioned on the front surface of the refrigerator 1.

Accordingly, the ice-making chamber cold air supply duct 600 and the ice-making chamber cold air returning duct 700 may be extended along the other lateral surface 41*e* of the refrigerating case to be facilitate communication between the ice-making chamber 22 and a cold air path of the refrigerating case 42.

In this instance, the other lateral surface 41*e* of the refrigerating case through which the ice-making chamber cold air supply duct 600 and the ice-making chamber cold air returning duct 700 pass may have a relatively low temperature, considering the overall temperature distribution of the refrigerator 1.

Accordingly, the lateral surface 41*d* and the other lateral surface 41*e* of the refrigerating case may have cold air imbalance.

To reduce cold air imbalance in a left-right direction, the connection duct 200 and the second storage chamber cold air supply duct 400 may be disposed adjacent to the surface 41*d* that faces the other lateral surface 41*e* of the refrigerating case, to balance cold air of the overall refrigerator 1.

In this regard, the refrigerator compartment cold air supply duct 300 may include a first refrigerator compartment cold air flow path 321 and a second refrigerator compartment cold air flow path 322 that are configured to branch the cold air guided from the connection duct 200.

The first refrigerator compartment cold air flow path 321 may be formed to have a wider cold air flow path width than the second refrigerator compartment cold air flow path 322, so as to induce more cold air toward the first refrigerator compartment cold air path 321.

The second refrigerator compartment cold air flow path 322 through which relatively less cold air is induced may be disposed closer to the other lateral surface 41*e* of the refrigerating case, on which the ice-making chamber cold air supply duct 600 is disposed, to the first refrigerator compartment cold air flow path 321.

As described above, the refrigerator compartment cold air supply duct 300 may have the first refrigerator compartment cold air flow path 321 having a larger cold air flow path width that is disposed father from the other lateral surface 41*e* of the refrigerating case where the ice-making chamber cold air supply duct 600 than the second refrigerator compartment cold air flow path 322, so that the overall cold air of the refrigerator 1 may be balanced.

Meanwhile, a flow path opening/closing module 130 for selectively cut off the supply of the cold air generated by the evaporator 101 to the refrigerator compartment 51 may be disposed in the freezer compartment 52.

Referring to FIG. 24A, the flow path opening/closing module 130 may include a first storage chamber flow path opening/closing damper 140, and may be configured to selectively cut off the cold air supplied to the first storage chamber 51*a* through the connection duct 200 and the refrigerator compartment cold air supply duct 300.

Unless the refrigerator 51 is divided into a plurality of spaces in which the temperatures are separately adjusted, the flow path opening/closing module 130 may include only the first storage chamber flow path opening/closing damper 140 and the cold air of the refrigerator compartment 51 may be supplied through the refrigerator compartment cold air supply duct 300.

As another example, when the refrigerator compartment 51 includes the first storage chamber 51*a* and the second storage chamber 51*b* that are adjusted to have different temperatures, respectively, the flow path opening/closing module 130 may include a first storage chamber flow path opening/closing damper 140 and a second storage chamber flow path opening/closing damper 150.

The first storage chamber flow path opening/closing damper 140 may be configured to selectively cut off the cold air supplied to the first storage chamber 51*a* through the connection duct 200 and the refrigerator compartment cold air supply duct 300.

The second storage chamber opening/closing damper 150 may be configured to selectively cut off the cold air supplied to the second storage chamber 51*b* through the second storage chamber cold air supply duct 400.

The first storage chamber flow path opening/closing damper 140 and the second storage chamber flow path opening/closing damper 150 for selectively cutting off the cold air supply to the first storage chamber 51*a* and the second storage chamber 51*b*, respectively, may be provided not in the refrigerator compartment 51 but in the freezer compartment 52.

If the flow path opening/closing dampers 140 and 150 are provided in the refrigerator compartment 51, the refrigerator compartment 51 could have a shape more projected inward as much as the area occupied by the first and second storage chamber flow path opening/closing dampers 140 and 150.

Due to this structure, the inner volume of the refrigerator compartment 51 may be reduced.

However, since the flow path opening/closing module 130 including the flow path opening/closing dampers 140 and 150 are disposed in the freezer compartment 52, not the refrigerator compartment 51, the area of the projected part projected to the inside of the refrigerator compartment 51 may be reduced only to increase the inner volume of the refrigerator compartment 51.

In the refrigerator 1 according to the present disclosure, the flow path opening/closing module 130 including the flow path opening/closing dampers 140 and 150 may be disposed in the freezer compartment 52, not the refrigerator compartment 51. Accordingly, even when the flow path opening/closing dampers 140 and 150 are closed, the cold air of the freezer compartment 52 may fail to rise to the refrigerator compartment but stay in the freezer compartment 52.

Accordingly, the refrigerator 1 according to the present disclosure may greatly reduce dew condensation near the flow path opening/closing dampers 140 and 150.

As described above, the refrigerator 1 according to the present disclosure may have cold air circulation flow below.

Figure 14:
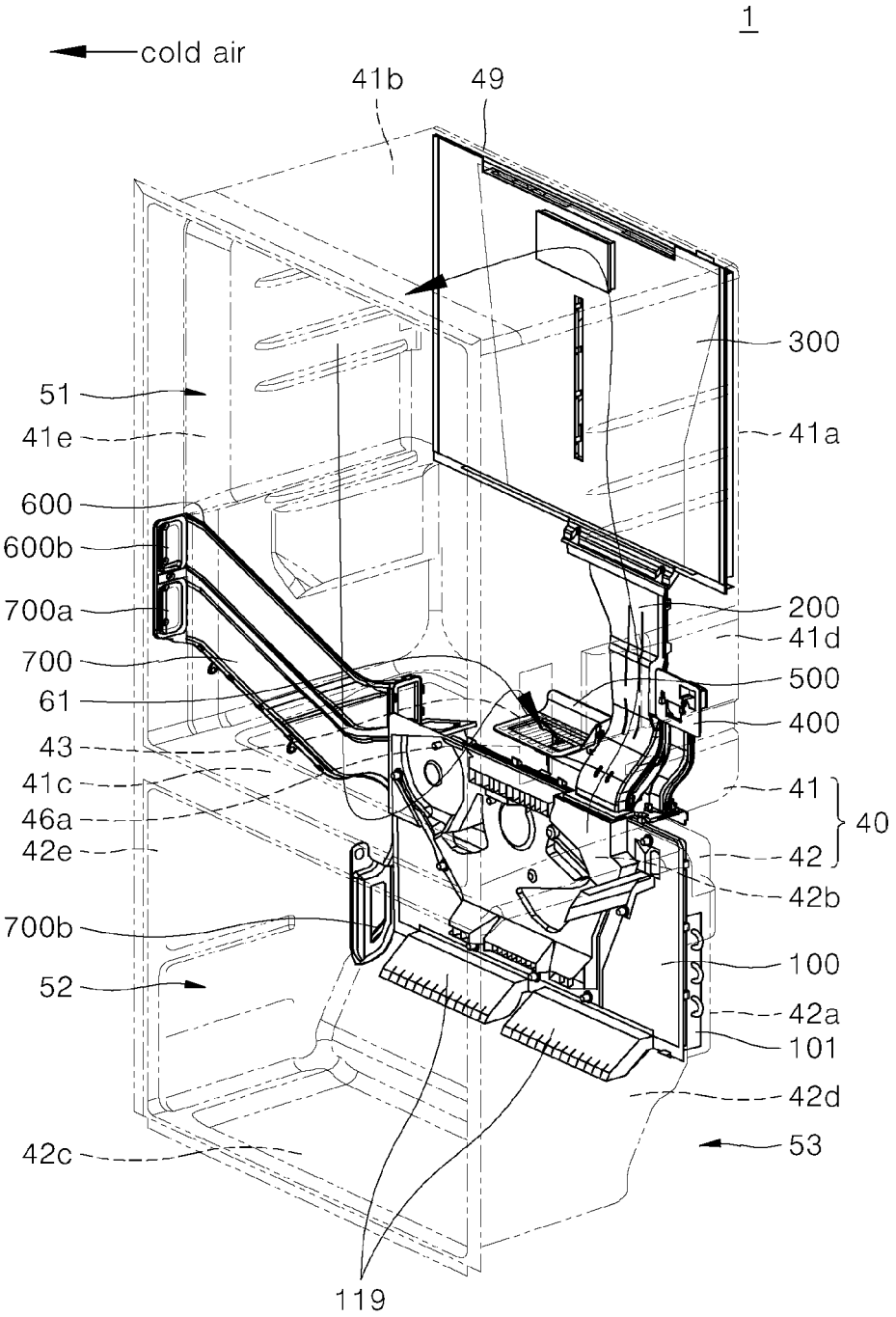
FIG. 14 is a front perspective view showing a cold air circulation structure of a refrigerator compartment.

Referring to FIG. 14, cold air supply flow to the first storage chamber 51*a* and cold air returning flow after circulating in the first storage chamber 51*a* will be described.

The cold air generated by the evaporator 101 disposed in the freezer compartment 52 may be blown to the connection duct 200 embedded in the rear outer surface of the refrigerator compartment 51 by a grill fan assembly 100 disposed in the freezer compartment 52.

The cold air blown to the connection duct 200 may communicate with the refrigerator compartment cold air supply duct 300 disposed on the rear surface of the refrigerator compartment 51 to be guided to the refrigerator compartment cold air supply duct 300.

The refrigerator compartment cold air supply duct 300 may be configured to discharge cold air forward from the upper region of the refrigerator compartment 51.

The cold air discharged forward from the upper region of the refrigerator compartment 51 may circulate inside the refrigerator compartment 51 and return to the rear surface in the lower region of the refrigerator compartment 51.

Since the refrigerator compartment cold air returning duct 500 is in communication with the lower region of the rear surface in the refrigerator compartment 51, the cold air circulated in the refrigerator compartment 51 may return to the freezer compartment 52 through the refrigerator compartment cold air returning duct 500.

Figure 15:
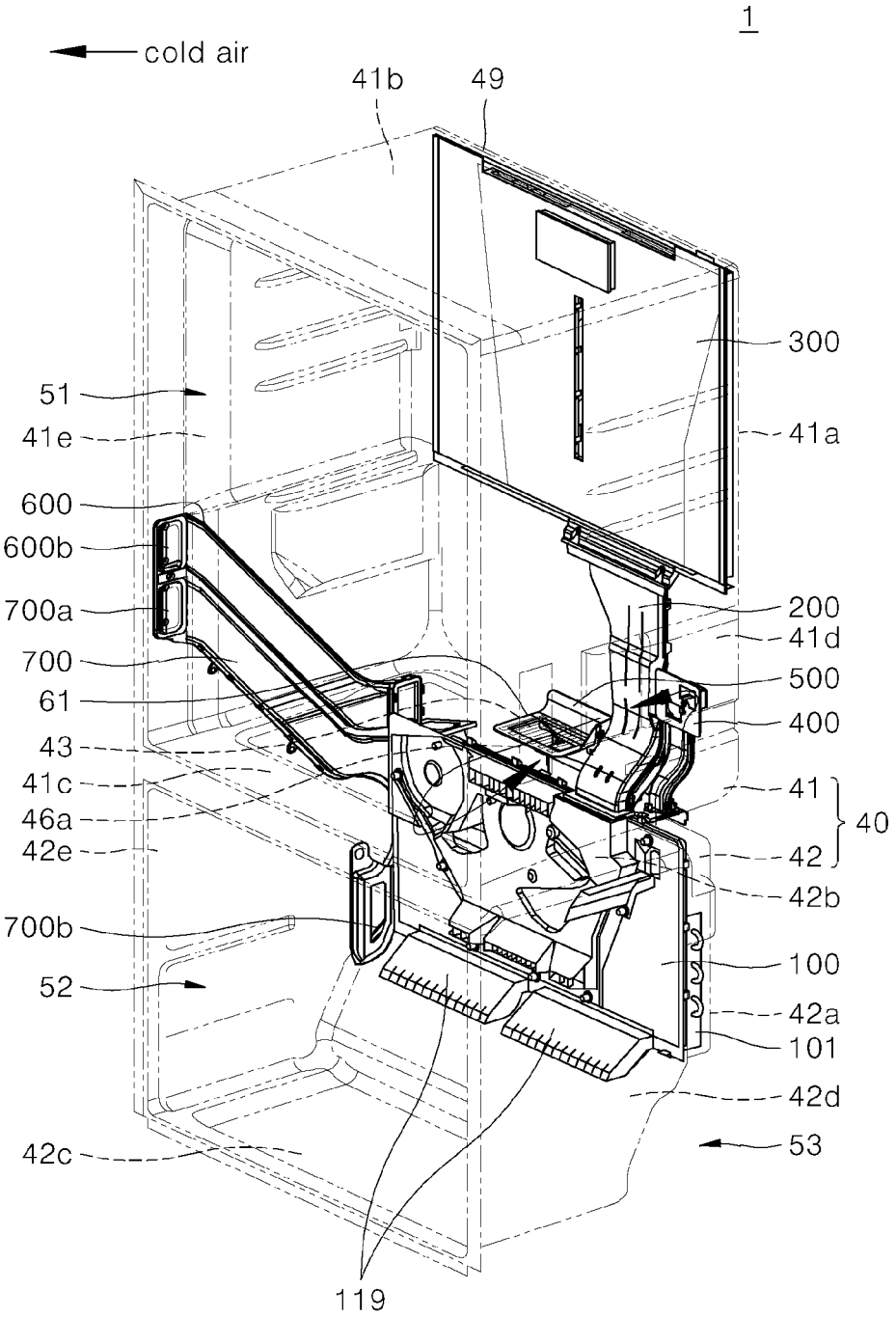
FIG. 15 is a front perspective view showing a cold air circulation structure of a second storage chamber.

Referring to FIG. 15, cold air flow to the second storage chamber 51*b* of the refrigerator compartment 51 and cold air returning flow after circulating inside the second storage chamber 51*b* will be described.

The cold air generated by the evaporator 101 disposed in the freezer compartment 52 may be blown to the connection duct 200 embedded in the rear outer surface of the refrigerator compartment 51 by the grill fan assembly 100 disposed in the freezer compartment 52.

The cold air blown to the second storage chamber cold air supply duct 400 may discharge cold air to the second storage chamber 51*b* from the rear surface of the refrigerator compartment 51.

The second storage chamber cold air supply duct 400 may discharge cold air forward from the upper region of the second storage chamber 51*b*.

The cold air discharged forward from the upper region of the second storage chamber 51*b* may circulate inside the second storage chamber 51*b* and return to the rear surface in the lower region of the second storage chamber 51*b*.

Since the refrigerator compartment cold air returning duct 500 is in communication with the lower region of the rear surface in the second storage chamber 51*b*, the cold air circulated in the second storage chamber 51 may return to the freezer compartment 52 through the refrigerator compartment cold air returning duct 500.

As described above, the cold air ducts for supplying cold air to the first storage chamber 51*a* and the second storage chamber 51*b*, respectively, are different from each other. However, the cold air circulating the first storage chamber 51*a* and the second storage chamber 51*b* may return through the same refrigerator compartment cold air returning duct 500.

Figure 16:
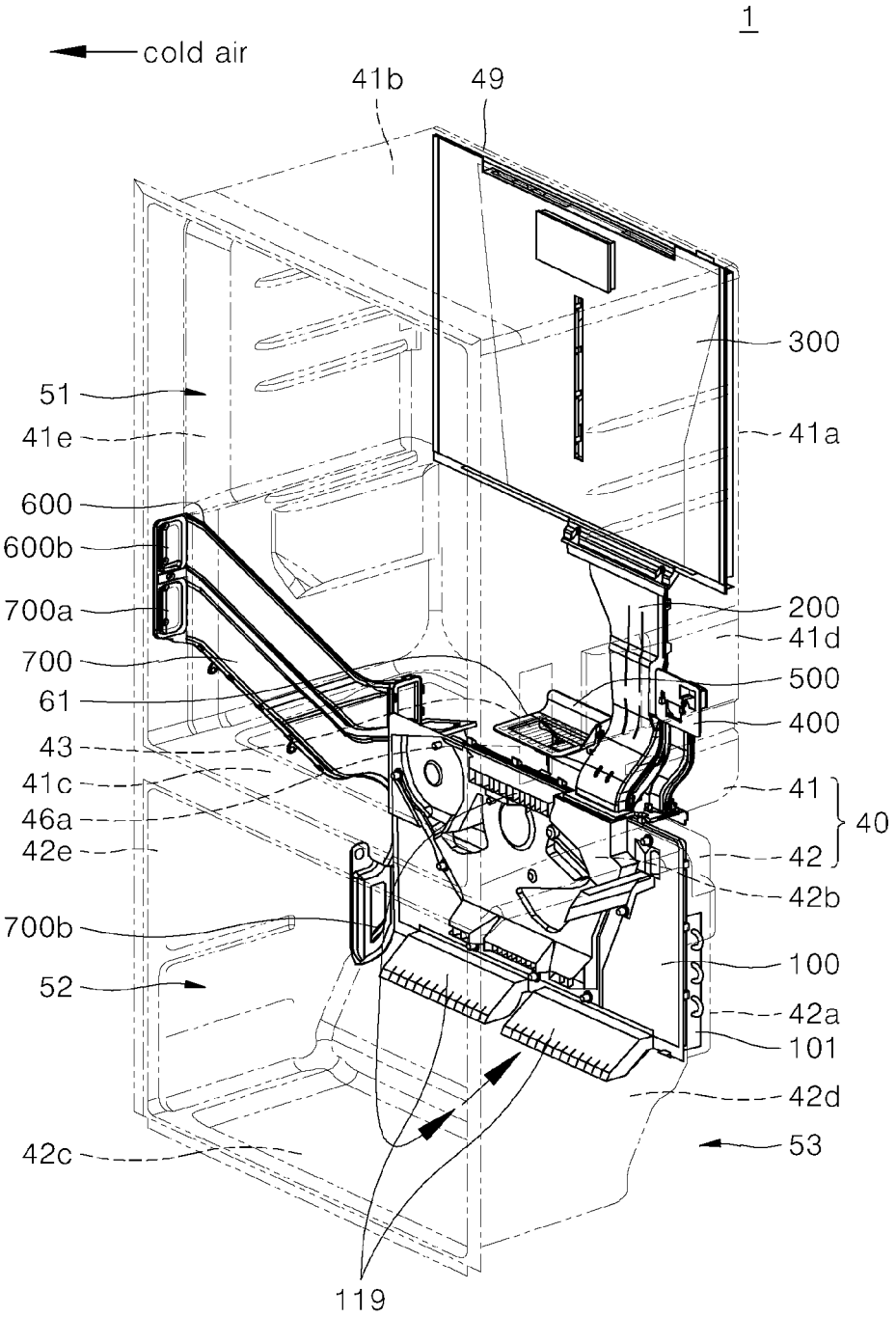
FIG. 16 is a front perspective view showing a cold air circulation structure of a freezer compartment.

Referring to FIG. 16, cold air supply flow to the freezer compartment 52 and cold air returning flow after circulating the freezer compartment 52 will be described.

The cold air generated by the evaporator 101 disposed in the freezer compartment 52 may be blown to the connection duct 200 embedded in the rear outer surface of the refrigerator compartment 51 by the grill fan assembly 100 disposed in the freezer compartment 52.

The grill fan assembly 00 may discharge cold air forward from the upper region of the freezer compartment 52.

The cold air discharged forward from the upper region of the freezer compartment 52 may circulate inside the freezer compartment 52 and return to the rear surface in the lower region of the freezer compartment 52.

Since the mechanical chamber 53 is provided in a lower rear area of the freezer compartment 52, a lower rear surface of the freezer compartment 52 may have an inclined surface that rises obliquely from a lower area.

The cold air returning to the rear surface of the freezer compartment 52 may flow into the freezer compartment cold air returning guide 119 of the grill fan assembly 100 along the inclined surface of the rear surface in the lower region of the freezer compartment 52.

Figure 17:
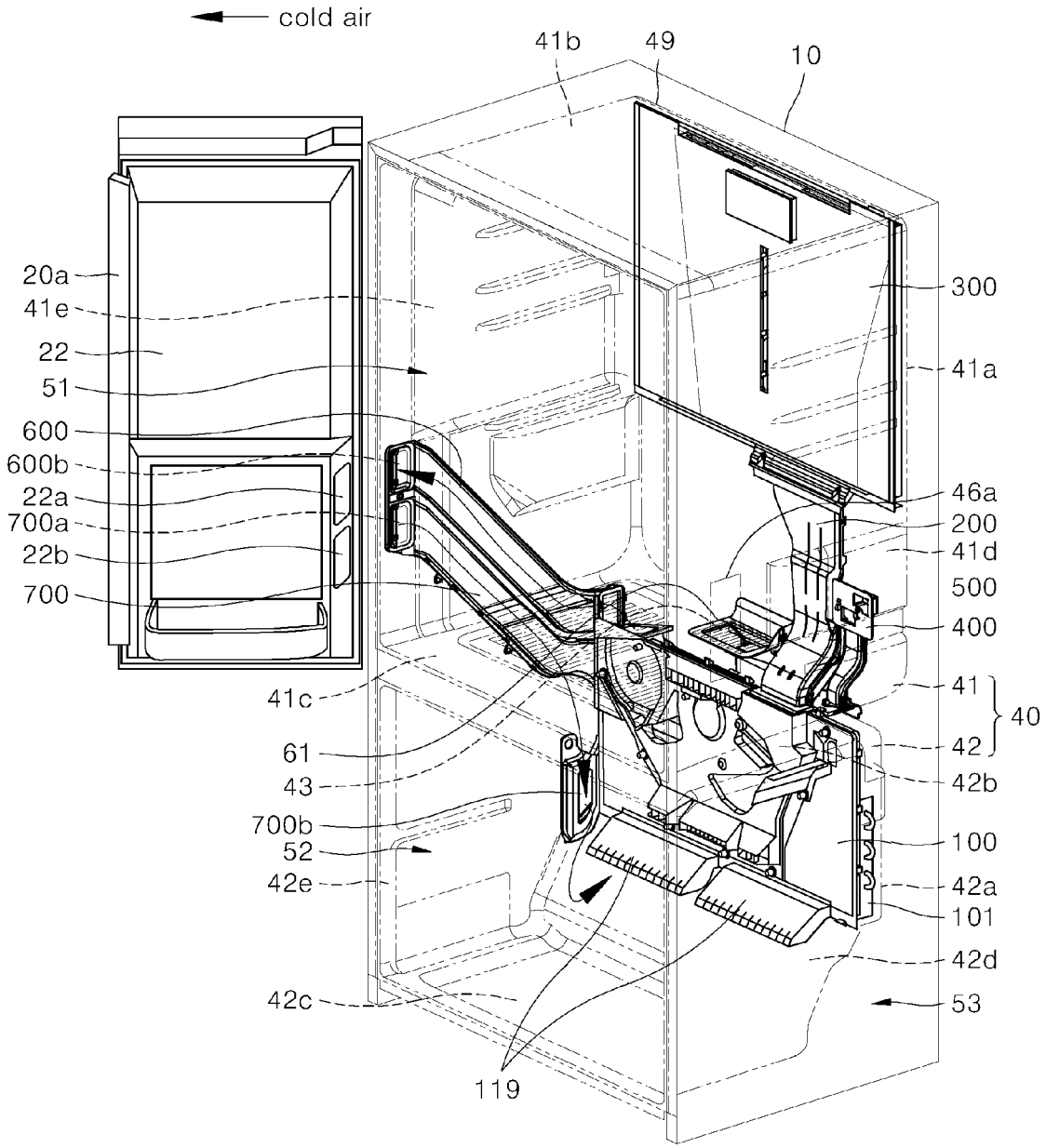
FIG. 17 is a front perspective view showing a cold air circulation and returning structure of an ice-making chamber.
Figure 18:
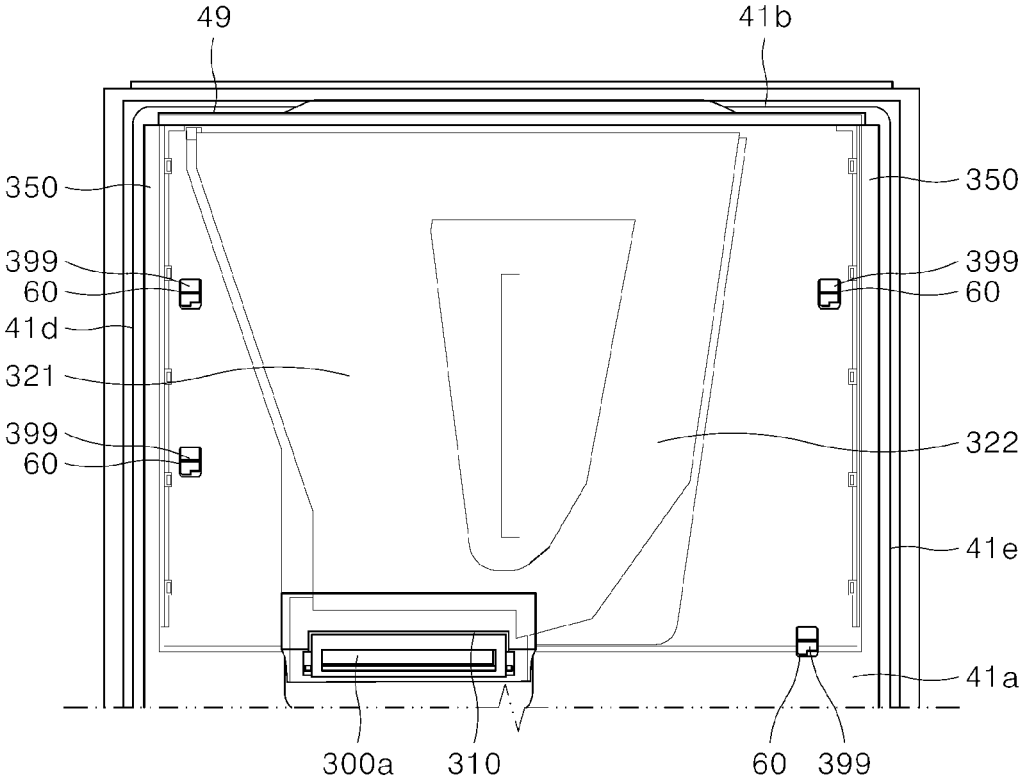
FIG. 18 is a rear perspective view showing a refrigerator compartment cold air supply duct coupled to a refrigerating case.

Referring to FIG. 17, cold air supply flow to the ice-making chamber 22 and cold air returning flow after circulating inside the ice-making chamber 22 will be described.

The cold air generated by the evaporator 101 may be supplied to the ice-making chamber 22 disposed in the first upper door 20*a* coupled to the front surface of the refrigerator 1 through the ice-making chamber cold air supply duct 600.

One end of the ice-making chamber cold air supply duct 600 may be in communication with the grill fan assembly 100 through the ice-making chamber cold air supply communication inlet hole 47*a* of the freezing case 42.

The other end of the ice-making chamber cold air supply duct 600 may be in communication with the ice-making chamber cold air inlet hole 22*a* of the ice-making chamber 22 through the ice-making chamber cold air supply communication outlet hole 47*b* provided on the other lateral surface 41*e* of the refrigerating case.

In addition, the cold air circulated inside the ice-making chamber 22 may returned to the freezer compartment 52 through the ice-making chamber cold air returning duct 700.

One end of the ice-making chamber cold air returning duct 700 may be in communication with the freezer compartment 52 through the ice-making chamber cold air returning communication outlet hole 48*b* disposed on the other lateral surface 42*e* of the freezing case.

The other end of the ice-making chamber cold air returning duct 700 may be in communication with the ice-making chamber cold air returning hole 22*b* of the ice-making chamber 22 through the ice-making chamber cold air returning communication inlet hole 48*a* disposed on the other lateral surface 42*e* of the freezing case.

The cold air returning to the freezer compartment 52 from the ice-making chamber 22 may be guided by the freezer compartment cold air returning guide 119 disposed in a lower area of the grill fan assembly 100 of the freezer compartment 52.

As described above, the cold air supply ducts for supplying cold air to the freezer compartment 52 and the ice-making chamber 22 are different from each other. However, the cold air circulating inside the freezer compartment 52 and the ice-making chamber 22 may return through the same freezer compartment cold air returning guide 119.

[Refrigerator Compartment Cold Air Supply Duct]

Hereinafter, referring to FIGS. 18 to 21, the refrigerator compartment cold air supply duct 300 will be described in detail.

The refrigerator compartment cold air supply duct 300 may include a duct body defining a front surface, a duct sheet 304 spaced apart behind the duct body 302, and a duct insulating portion 303 provided between the duct body 302 and the duct sheet 304 to form a first refrigerating chamber cold air flow path 321 and a second refrigerating chamber air flow 322.

A decorative panel 301 may be provided on a front surface of the duct body 302.

The decorative panel 301 may define an exterior design of a rear wall surface (or a rear lateral surface) of the first storage chamber 51*a*, and may be formed of metal (e.g., stainless steel).

A shelf securing portion 309 may be formed in a center area of the decorative panel 301 in a height direction.

Through holes corresponding to the shelf securing portion 309 may be formed in the duct body 302, the duct insulating portion 303 and the duct sheet 304, respectively, which are disposed on the rear surface of the decorative panel 301.

The duct body 302 may be formed in the same size and shape as the rear surface 41*a* of the refrigerating.

However, the duct body 302 may be formed narrower than the width of the rear surface 41*a* of the refrigerating case in the left-right direction to have a predetermined space spaced apart a preset distance from one lateral surface 41*d* and the other lateral surface 41*e* of the refrigerating case.

Accordingly, the duct body 302 may not be in contact with the lateral surface 41*d* and the other lateral surface 41*e* of the refrigerating case.

A pair of lighting units 360 may be disposed in both sides of a rear surface of the duct body 302 along a longitudinal direction of the duct body 302, respectively.

The pair of the lighting units 360 may be disposed to face the lateral surface 41*d* and the other lateral surface 41*e* of the refrigerating case to irradiate light toward the lateral surface 41*d* and the other lateral surface 41*e* of the refrigerating case.

The lighting units 360 may be fixedly coupled to the duct body 302 by using a lighting unit fixing member 378 and a lighting unit coupling member 379 (e.g., a bolt) that are disposed on both sides of the rear surface of the duct body 302.

An upper area of the refrigerator compartment cold air supply duct 300 may be inserted in a duct inserting groove 49 formed in the upper surface 41*b* of the refrigerating case to be fixed to the refrigerating case 41.

A refrigerator compartment cold air supply connecting portion 310 may be formed in a lower area of the duct body 302.

Referring to FIGS. 21A and 21B, the refrigerator compartment cold air supply connecting portion 310 of the refrigerator compartment cold air supply duct 300 may be connected to the connection duct 200 disposed below.

The refrigerator compartment cold air supply connecting portion 310 may have a pair of coupling member through holes 313, and a connection duct securing member 213 may be formed on the upper surface of the connection duct 200.

The coupling member 311 such as a bolt may be coupled to the connection duct securing member 213 through the coupling member through hole 313, to fixedly coupled the lower area of the refrigerator compartment cold air supply duct 300 to the connection duct 200.

A duct lower cover 305 may be disposed on a lower surface of the refrigerator compartment cold air supply connecting portion 310, and the refrigerator compartment cold air supply connecting portion 310 and the connection duct 200 may be in communication while having the duct lower cover 305 disposed therebetween.

A duct lower gasket 306 may be disposed on the lower surface of the duct lower cover 305 to improve the airtightness between the refrigerator compartment cold air supply connecting portion 310 and the connection duct 200.

A plurality of securing bosses 398 may be formed on a rear surface of the duct body 302.

Coupling through-holes 60 corresponding to the securing bosses 398 may be formed on the rear surface 41*a* of the refrigerating case.

A separate coupling bush 399 may be provided on the outer surface of the refrigerating case 41 to be coupled to the securing boss 398 through the coupling through hole 60.

Accordingly, the refrigerator compartment cold air supply duct 300 may be secured to the rear surface 41*a* of the refrigerating case by coupling the securing bosses 398 to the coupling bush 399 to have a strong coupling force.

A duct insulating portion 303 having a predetermined thickness may be disposed in a rear area of the duct body 302.

The duct insulating portion 303 may have a cold air flow path formed therein to form a protrusion pattern backward with respect to the duct insulating portion 303.

The duct sheet 304 having a shape corresponding to the cold air flow path of the duct insulating portion 303 to be coupled to the duct insulating portion 303 may be disposed on a rear area of the duct insulating portion 303 to airtight cover the cold air flow path formed in the duct insulating portion 303.

For example, the duct sheet 304 may be formed of a heat insulating material to reduce heat loss of the cold air flowing along the inside of the first refrigerating chamber cold air flow path 321 and the inside of the second refrigerating chamber cold air flow path 322.

The duct sheet 304 may have a thickness thin enough to airtight seal the first refrigerating chamber cold air flow path 321 and the second refrigerating chamber cold air flow path 322, so that the overall thickness of the refrigerator compartment cold air supply duct 300.

However, when the duct sheet 304 is formed with the thickness that is as thin as possible, the supporting force of the duct sheet 304 could be insufficient.

Accordingly, a plurality of cold air guide ribs 323 may be formed in a backward direction of the duct insulating portion 303 to support the duct sheet by inducing the cold air flow direction.

Due to the coupling structure between the duct insulating portion 303 and the duct sheet 304, the first refrigerating chamber cold air flow path 321 and the second refrigerating chamber cold air flow path 322 may be formed in the refrigerator compartment cold air supply duct 300.

The first refrigerating chamber cold air flow path 321 and the second refrigerating chamber cold air flow path 322 may be branched from a lower area of the duct insulating portion 303.

The cold air passing through the first refrigerating chamber cold air flow path 321 and the second refrigerating chamber cold air flow path 322 may be discharged from an upper area of the duct insulating portion 303 to the refrigerator compartment 51 through a first refrigerating chamber cold air main outlet hole 341 and a second refrigerating chamber cold air main outlet hole 342.

A refrigerator compartment cold air guide 324 may be formed on an upper end of the duct insulating portion 303 to uniformly discharge the cold air from the first refrigerator compartment cold air main outlet hole 342 and the second refrigerator compartment cold air main outlet hole 342.

The refrigerator compartment cold air guide 324 may be formed on a rear surface of the duct insulating portion 303 as an island shape, may have the same height as cold guide rib 323.

A refrigerator compartment cold air main outlet guide 349 may be formed in an upper end of the duct body 302 and configured to guide the cold air discharged from the second refrigerator compartment cold air main outlet hole 342 and the second refrigerator compartment cold air main outlet hole 342 to be discharged toward the front surface of the refrigerator compartment 51.

The refrigerator compartment cold air main outlet guide 349 may be configured to guide the cold air discharged to the refrigerator compartment 51 toward the front surface.

The first refrigerator compartment cold air flow path 321 disposed adjacent to the lateral surface 41*d* of the refrigerating case may have a greater cold air flow path width than the second refrigerator compartment cold air flow path 322 disposed adjacent to the other lateral surface 41*e* of the refrigerating case.

Accordingly, even when the ice-making chamber cold air supply duct 600 and the ice-making chamber cold air returning duct 700 are disposed along the other lateral surface 41*e* of the refrigerating case, more cold air may be sent toward the first refrigerator compartment cold air flow path 321 so that the overall cold air of the refrigerator 1 may be balanced.

The duct insulating portion 303 may include one or more refrigerator compartment cold air auxiliary flow path 325 branched from the first refrigerator compartment cold air flow path 321 and/or the second refrigerator compartment cold air flow path 322.

For example, the refrigerator compartment cold air auxiliary flow path 325 may be additionally branched from an upper area of the first refrigerator compartment cold air flow path 321 and/or the second refrigerator compartment cold air flow path 322 in a direction to the center of the duct insulating portion 303.

In an embodiment of the present disclosure, auxiliary cold air flow paths may be branched from the first refrigerator compartment cold air flow path 321 and the second refrigerator compartment cold air flow path 322, respectively, to form a pair of refrigerator compartment cold air auxiliary flow paths 235.

The duct insulating portion 303 may include a refrigerator compartment cold air auxiliary outlet hole 330 configured to discharge the cold air guided through the refrigerator compartment cold air auxiliary flow path 325.

The refrigerator compartment cold air auxiliary flow paths 325 may be branched from an upper area of the first refrigerator compartment cold air flow path 321 and an upper area of the second refrigerator compartment cold air flow path 322 with respect to the center of the refrigerator compartment 41 in a direction to the center of the refrigerator compartment 51.

Accordingly, the refrigerator compartment cold air auxiliary outlet hole 330 may be provided in an upper area with respect to the center of the refrigerator compartment 51.

The refrigerator compartment cold air auxiliary outlet hole 330 may be disposed in a lower area than the first refrigerator compartment cold air main outlet hole 341 and the second refrigerator compartment cold air main outlet hole 342.

A refrigerator compartment cold air auxiliary outlet guide 339 including a refrigerator compartment filter 331 may be disposed on a front surface of the refrigerator compartment cold air auxiliary outlet hole 330.

The cold air supplied from the refrigerator compartment cold air auxiliary outlet hole 330 may pass through the refrigerator compartment filter 331.

The refrigerator compartment cold air auxiliary outlet hole 330 may include a first refrigerator compartment cold air auxiliary outlet hole 330*a* and a second refrigerator compartment cold air auxiliary outlet hole 330*b*.

The refrigerator compartment filter 331 may be a deodorizing filter including activated carbon that removes odors.

Accordingly, the refrigerator 1 according to the present disclosure does not need to include a separate suction fan provided in the refrigerator compartment 51 in order to deodorize the refrigerator compartment 51.

The area projected toward the inside of the refrigerator compartment 51 by the suction fan may be reduced, thereby reducing the inner volume of the refrigerator compartment 51.

The refrigerator 1 according to the present disclosure may include a refrigerator compartment cold air auxiliary flow path 325 configured to discharge cold air instead of using the suction fan for sucking cold air from the refrigerator compartment 51.

Accordingly, the deodorizing function for the refrigerator compartment may be performed without disturbing the circulation structure of the cold air supplied and circulated inside the refrigerator compartment.

In addition, the refrigerator 1 according to the present disclosure may perform the deodorizing function by using the cold air supply circulation for continuously circulating cold air.

Accordingly, in preparation for performing the deodorizing function by intermittently operating the suction fan, the total amount of cold air passing through the refrigerator compartment filter 331 may be similar or increased to improve the deodorizing function.

The refrigerator compartment cold air auxiliary outlet guide 339 may further include an insulating member 332 disposed on a front surface of the refrigerator compartment filter 331.

The insulating member 332 may be spaced apart from the refrigerator compartment filter 331, so that a cold air flow path through which cold air passes may be formed between the insulating member 332 and the refrigerator compartment filter 331.

The refrigerator compartment cold air auxiliary outlet guide 339 may be configured to guide the cold air having passed through the refrigerator compartment filter 331 to be discharged downward inside the refrigerator compartment 51 through the space between the insulating member 332 and the refrigerator compartment filter 331.

Accordingly, the refrigerator compartment cold air auxiliary outlet guide 339 may have s shape covering the front surface of the refrigerator compartment cold air auxiliary outlet hole 330, and may have a guide cold air outlet hole 351 formed on a lower surface to discharge cold air.

The cold air discharged through the refrigerator compartment cold air auxiliary outlet hole 330 may not be directly discharged to the front surface of the refrigerator compartment 51, but the cold air may have a flow path direction changed from the front surface to the bottom by the refrigerator compartment cold air auxiliary outlet guide 339.

Accordingly, the cold air discharged through the refrigerator compartment cold air auxiliary outlet hole 330 may primarily collide with the refrigerator compartment cold air auxiliary outlet guide 339.

When the cold air collides with the refrigerator compartment cold air auxiliary outlet guide 339 having the surface exposed to the relatively humid refrigerator compartment 51, dew condensation might occur on the refrigerator compartment cold air auxiliary outlet guide 339.

According to the present disclosure, the refrigerator compartment cold air auxiliary outlet guide 339 may reduce occurrence of dew condensation, because the insulating material 332 is disposed on the front surface of the refrigerator compartment filter 331.

The refrigerator compartment cold air auxiliary outlet guide 339 described above may overlap with the refrigerator compartment cold air returning duct 500 disposed in the lower area of the refrigerator compartment 51 in a vertical direction.

Specifically, the refrigerator compartment cold air auxiliary outlet hole 330 of the refrigerator compartment cold air supply duct 300 may vertically overlap with one end and the other end of the refrigerator compartment cold air returning duct 500 disposed in the lower area of the refrigerator compartment 51.

Accordingly, the present disclosure may induce a cold air flow path that allows the cold air deodorized while passing through the refrigerator compartment filter 331 to easily escape to the refrigerator compartment cold air returning duct 500, without interfering with the flow of the cold air circulating inside the refrigerator compartment 51 as much as possible.

In addition, since the cold air discharged from the upper region of the refrigerator compartment 51 by the refrigerator compartment cold air main outlet guide 349 is directed to the front surface, the cold air discharged from the refrigerator compartment cold air main outlet guide 349 could be difficult to circulate toward the rear surface 41*a* of the refrigerating case.

According to the present disclosure, the cold air discharged through the refrigerator compartment cold air auxiliary outlet hole 330 may circulate toward the rear surface 41 of the refrigerating case. Due to this structure, the overall cold air supply of the refrigerator compartment 51 may be performed more uniformly and smoothly.

In addition, the duct body 302 may include a sterilization unit 333 including an ultraviolet sterilizing device.

The ultraviolet sterilizing device may use an ultraviolet LED.

For example, the sterilization unit 333 may be disposed below the first refrigerator compartment cold air auxiliary outlet hole 330*a* and the second refrigerator compartment cold air auxiliary outlet hole 330*b* in a bar shape that is long in the left-right direction.

The sterilization unit 333 may be disposed on the rear surface of the refrigerator compartment filter and configured to sterilize and discharge the cold air having passed through the refrigerator compartment filter 331 to the refrigerator compartment 51.

[Connection Duct and Second Storage Chamber Cold Air Supply Duct]

Hereinafter, referring to FIG. 22, the connection duct 200 and the second storage chamber cold air supply duct 400 will be described in detail.

The connection duct 200 and the second storage chamber cold air duct 400 may be coupled to each other to be one module.

Referring to FIG. 22C, the connection duct 200 may be formed by coupling a connection duct front plate 210 and a connection duct rear plate 220 to each other.

An upper surface of the connection duct front plate 210 may have an inclined surface that is inclined downward, and a connection duct securing member 213 and a hook securing portion 211 may be formed on the upper surface.

The connection duct securing member 213 and the hook securing portion 211 may be formed in shapes corresponding to the coupling member through hole 313 and the hook 314 of the refrigerator compartment cold air supply duct 300, respectively, to facilitate smooth coupling between the connection duct 200 and the refrigerator compartment cold air supply duct 300.

For example, the connection duct front plate 210 and the connection duct rear plate 220 may be easily coupled to each other without a separate coupling member by the hook coupling structure formed along the lateral surface. However, the coupling structure is not limited thereto.

The connection duct rear extended portion 221 may be extended upward from upper end of the connection duct rear plate 220 to be coupled to the refrigerating case 41.

The connection duct 200 may have one end connected to the grill fan assembly 100 and the other end connected to the refrigerator compartment 51.

One end of the connection duct 200 may include a refrigerator compartment cold air supply inlet hole 2001 configured to communicate with the grill fan assembly 100.

The other end of the connection duct 200 may be embedded between the inner case 40 and the outer case 10 on the rear surface of the refrigerator compartment 51, and configured to communicate with the refrigerator compartment cold air supply duct 300 on the rear surface of the refrigerating case 41.

Accordingly, the connection duct 200 disposed on the rear surface of the refrigerator compartment 51 may have a minimum thickness in the front-rear direction as possible.

Since one end of the connection duct 200 is connected to the grill fan assembly 100 provided in the freezer compartment 52, it may be preferred that the connection duct 200 has the minimum thickness in the left-right direction as possible rather than the front-rear direction, in terms of space utilization.

The connection duct 200 may be formed in a shape with the width that becomes narrower from one end to the other end, that is, from the bottom to the top in the front-rear direction.

However, when only the front-rear direction width of the connection duct 200 becomes narrower without changing the left-right direction width of the connection duct 200, the pressure difference of the cold air flow path might increase.

Accordingly, the connection duct 200 may be formed with the left-right direction width that increases from one end to the other end, that is, from the bottom to the top.

Due to the change in the front-rear direction width and the left-right direction width as described above, the area of the cold air flow path passing through one end of the connection duct 200 and the area of the cold air flow path passing through the other end may as similar as possible.

Since one end of the connection duct has the width that is greater than the other end, one or more flow path guides 231 may be formed on the connection duct rear plate 220 to prevent turbulence of the cold air flowing into one end and guide the flow of the cold air.

When the connection duct 200 is under pressure by foaming the insulating material, the flow path guide 231 may serve to support the coupling structure of the connection duct front plate 210 and the connection duct rear plate 220.

The connection duct 200 may include a curved portion that is curved rearward with respect to the front-rear direction so that the other end of the connection duct 200 may be positioned behind one end of the connection duct 200.

The connection duct 200 includes the curved portion 230 curved in the front-rear direction to pass the outside of the rear surface 41*a* of the refrigerating case, so that it may be embedded in the space between the inner case 40 and the outer case 10 smoothly.

Meanwhile, the second storage chamber cold air supply duct 400 may be formed by coupling a second storage chamber cold air supply duct front plate 410 and a second storage chamber cold air supply duct rear plate 420 to each other.

For example, the second storage chamber cold air supply duct front plate 410 and the second storage chamber cold air supply duct rear plate 420 may be smoothly coupled to each other by a hook coupling structure formed along a lateral surface, even without a separate coupling member, but the coupling type is not limited thereto.

The second storage chamber cold air supply duct 400 may be connected to a support plate 250 formed in a lower area of the connection duct 200 to form one module together with the connection duct 200.

For example, the support plate 250 may be horizontally extended from one end positioned in the lower area of the connection duct 200. The support plate 250 may include a second storage chamber duct through hole 251.

One end of the second storage compartment cold air supply duct 400 may be positioned to communicate with the second storage chamber duct through hole 251 and fixedly fastened to the support plate 250 by using fastening means such as a bolt.

A second storage chamber cold air supply inlet hole 400*a* may be formed in one end of the second storage chamber cold air supply duct 400 disposed to communicate with the second storage chamber duct through hole 251 of the supply plate 250, and may be configured to communicate with the second storage chamber cold air supply communication hole 45 of the refrigerating case 41 on the rear surface 41*a* of the refrigerating case.

The other end of the connection duct 200 may be connected to the refrigerator compartment 51.

The other end of the second storage chamber cold air supply duct 400 may be embedded between the inner case 40 and the outer case 10 on the rear surface of the refrigerator compartment 51, to become in communication with the second storage chamber cold air supply communication hole 45 of the refrigerating case 41 on the rear surface 41*a* of the refrigerating case.

The other end of the second storage chamber cold air supply duct 400 may be formed to direct the second storage chamber cold air supply outlet hole 400*b* supplying cold air to the second storage chamber 51*b* toward the front surface, so that the cold air may be discharged toward the front surface of the refrigerator compartment 51 from the rear surface 41*a* of the refrigerating case.

In addition, a pair of second storage chamber cover coupling members 407 for the coupling with a second storage chamber cold air outlet cover 440 and a temperature sensor inserting portion 409 for inserting a temperature sensor therein may be formed in the other end of the second storage chamber cold air supply duct 400.

The other end of the second storage chamber cold air supply duct 400 may be formed in a flat plate shape having a wide area toward the front surface so that the member having the various functions described above thereon may be disposed on the flat plate.

Accordingly, the second storage chamber cold air supply duct 300 may be formed in a shape having a tubular shape from one end toward the other end, that is the bottom to the top, and then having a flat shape at the other end.

The second storage chamber cold air supply duct 400 may be additionally coupled to the lateral surface of the connection duct 200 by using fastening means such as a bolt at the other end having the flat plate shape, to be more strongly coupled.

The second storage chamber cold air supply duct 400 disposed on the rear surface of the refrigerator compartment 51 may have a minimum thickness in the front-rear direction as possible.

However, since one end of the second storage chamber cold air supply duct 400 is connected to the grill fan assembly 100 provided in the freezer compartment 52, it may be preferred that the second storage chamber cold air supply duct 400 has the minimum thickness in the left-right direction as possible rather than the front-rear direction in terms of space utilization.

Accordingly, the second storage chamber cold air supply duct 400 may be formed in a shape having the front-rear direction width that becomes narrower from one end to the other end, that is, from the bottom to the top.

However, when only the front-rear direction width of the second storage chamber cold air supply duct 400 becomes narrower without changing the left-right direction width, the pressure difference of the cold air flow path might increase.

Accordingly, the second storage chamber cold air supply duct 400 may be formed with the left-right direction width that increases from one end to the other end, that is, from the bottom to the top.

Due to the change in the front-rear direction width and the left-right direction width as described above, the area of the cold air flow path passing through one end of the second storage chamber cold air supply duct 400 and the area of the cold air flow path passing through the other end may as similar as possible.

The second storage chamber cold air supply duct 400 may include a curved portion 430 that is curved rearward with respect to the front-rear direction so that the other end of the connection duct 200 may be positioned behind one end of the connection duct 200.

The second storage chamber cold air supply duct 400 includes the curved portion 430 curved in the front-rear direction to pass the outside of the rear surface 41*a* of the refrigerating case, so that it may be embedded in the space between the inner case 40 and the outer case 10 smoothly.

[Refrigerator Compartment Cold Air Returning Duct]

Hereinafter, referring to FIG. 23, the refrigerator compartment cold air returning duct 500 will be described in detail.

The refrigerator compartment cold air returning duct 500 may be formed by coupling a refrigerator compartment cold air returning duct front plate 510 and refrigerator compartment cold air returning duct rear plate 520 to each other.

For example, the refrigerator compartment cold air returning duct front plate 510 and the refrigerator compartment cold air returning duct rear plate 520 may be easily coupled to each other without a separate coupling member by a hook coupling structure formed along the lateral surface. However, the coupling structure is not limited thereto.

The refrigerator compartment cold air returning duct 500 may have one end connected to the rear surface 41*a* of the freezing case and the other end connected to the lower surface 41*c* of the refrigerating case.

Specifically, a refrigerator compartment cold air returning outlet hole 500*b* may be formed in one end of the refrigerator compartment cold air returning duct toward the front surface, to facilitate communication between the end and the rear surface 42*a* of the freezing case.

The refrigerator compartment cold air returning outlet hole 500*b* of the refrigerator compartment cold air returning duct 500 may be in communication with the refrigerator compartment cold air returning communication outlet hole 46*b* formed on the rear surface 42*a* of the freezing case.

A refrigerator compartment cold air returning inlet hole 500*a* may be formed upward in the other end of the refrigerator compartment cold air returning duct 500, to facilitate communication between the other end and the rear surface 41*a* of the refrigerating case.

The refrigerator compartment cold air returning inlet hole 500*a* of the refrigerator compartment cold air returning duct 500 may be in communication with the refrigerator compartment cold air returning communication inlet hole 46*a* formed on the lower surface 41*c* of the refrigerating case.

A returning duct rear extended portion 521 may be vertically extended from the other end of the refrigerator compartment cold air returning duct 500 along an upper rear end of the refrigerator compartment cold air returning duct 500.

In addition, a returning duct side extended portion 522 may be vertically extended from the other end of the refrigerator compartment cold air returning duct 500 along an upper end of the refrigerator compartment cold air returning duct 500.

The returning duct rear extended portion 521 and the returning duct side extended portion 522 may be connected to each other.

Accordingly, the other end of the refrigerator compartment cold air returning duct 500 may be fixed to the refrigerating case 41 to support the lower surface 41*c* and the rear surface 41*a* of the refrigerating case.

A returning duct filter 530 may be disposed in the refrigerator compartment cold air returning duct 500 and configured to allow the cold air returning by the refrigerator compartment cold air returning duct 500 to pass therethrough.

The returning duct filter 530 may be a deodorizing filter including activated carbon to remove odors.

In the present disclosure, no separate suction fan for sucking and deodorizing cold air in a target region is provided but the overall cold air flow path system circulating inside the refrigerator 1 may deodorize the cold air. Due to this structure, the smell of the refrigerator compartment 51 and the smell of the freezer compartment 52 could be mixed with each other.

Accordingly, the cold air flowing into the refrigerator compartment 51 may be primarily deodorized by the refrigerator compartment filter 331 provided in the refrigerator compartment cold air supply duct 300.

After that, the cold air re-flowing into the freezer compartment 52 after passing through the refrigerator compartment 51 may be secondarily deodorized by the returning duct filter 530 provided in the refrigerator compartment cold air returning duct 500, to reduce the mixture of the smells in the refrigerator compartment 51 and the freezer compartment 52.

With respect to the left-right direction of the refrigerator compartment cold air returning duct 500, the connection duct 200 may be disposed in an area next to the refrigerator compartment cold air returning duct 500 and the ice-making chamber cold air supply duct 600 may be disposed in other area.

Since the connection duct 200 may be disposed in the area next to the refrigerator compartment cold air returning duct 500 and the ice-making chamber cold air supply duct 600 is disposed on the other area with respect to the refrigerator compartment cold air returning duct 500, the entire cold air balance of the refrigerator 1 based on the refrigerator compartment cold air supply duct 500 may be maintained.

[Grill Fan Assembly]

Hereinafter, referring to FIGS. 24 to 27, the grill fan assembly 100 will be described in detail.

The grill fan assembly 100 according to the present disclosure may include a shroud 120 and a grill fan 110.

The shroud 120 may define a rear exterior design of the grill fan assembly 100 and the grill fan 110 may define a front exterior design of the grill assembly 100.

The grill fan 110 may be disposed toward the front surface of the freezer compartment 52, and the shroud 120 may be disposed toward the rear surface 42*a* of the freezing case, that is, the evaporator 101 provided on the rear wall of the freezing case.

The shroud 120 may include a first inlet hole 121*a* and a second inlet hole 121*b*.

The cold air heat-exchanged while passing through the evaporator 101 disposed behind the shroud 120 may flow into the space formed between the first inlet hole 121*a* and the second inlet hole 121*b*.

A freezing fan module 160 is disposed on a front surface of the first inlet hole 121*a* and an ice-making fan 170 may be disposed on a front surface of the second inlet hole 121*b*.

The first inlet hole 121*a* may be provided in an upper center region of the grill fan assembly 100 and the second inlet hole 121*b* may be provided in one side region of the grill fan assembly 100 with respect to the first inlet hole 121*a*.

Since the ice-making fan module 170 is disposed the second inlet hole 121*b* to supply cold air to the ice-making chamber 22, the second inlet hole 121*b* may be disposed adjacent to the other lateral surface 42*e* of the freezing case where the ice-making chamber cold air supply duct 600 is provided.

With respect to the first inlet hole 121*a*, a flow path opening/closing module seating portion 122 on which the flow path opening/closing module 130 is seated may be formed in the other side region rather than the side region of the grill fan assembly 100 in which the second inlet hole 121*b* is disposed.

The flow path opening/closing module 130 may include a flow path opening/closing damper 140 and 150 configured to selectively cut off the cold air supplied to the refrigerator compartment 51.

The refrigerator compartment 51 may include a first storage chamber 51*a* and a second storage chamber 51*b* that are preset to have different temperatures, respectively.

In this instance, the flow path opening/closing module 130 may include a first storage chamber flow path opening/closing damper 140 for selectively cutting off the cold air supplied to the first storage chamber 51*a* and a second storage chamber flow path opening/closing damper 150 for selectively cutting off the cold air supplied to the second storage chamber 51*b*.

The first storage chamber flow path opening/closing damper 140 and the second storage chamber flow path opening/closing damper 150 may be seated on the flow path opening/closing module seating portion 122, in a state of being covered by a damper cover 131.

The damper cover 131 may be formed of an insulating material such as Styrofoam, and the material is not limited thereto.

The damper cover 131 may be formed by coupling a first damper cover 131*a*, a second damper cover 131*b* and a third damper cover 131*c* to each other.

The first storage chamber flow path opening/closing damper 140 may be disposed between the first damper cover 131*a* and the second damper cover 131*b*, and the second storage chamber flow path opening/closing damper 150 may be disposed between the second damper 131*b* and the third damper 131*c*.

A first storage chamber cold air outlet 132*a* may be formed on an upper surface of the damper cover 131 covering the first storage chamber flow path opening/closing damper 140 to be in communication with the connection duct 200 to supply cold air.

A second storage chamber cold air outlet 132*b* may be formed on an upper surface of the damper cover 131 covering the second storage chamber flow path opening/closing damper 150 to be in communication with the second storage chamber cold air supply 400 to supply cold air.

With respect to the left-right direction of the grill fan assembly 100, the freezing fan module 160 may have an area overlapping with the first storage chamber flow path opening/closing damper 140 that is larger than an area overlapping with the second storage chamber flow path opening/closing damper 150.

For example, an area of the flow path opening/closing module seating portion 122 corresponding to the second storage chamber flow path opening/closing damper 150 may be more projected toward a rear surface of the shroud than an area thereof corresponding to the first storage chamber flow path opening/closing damper 140.

The first storage chamber 51*a* and the second storage chamber 51*b* may be adjusted to have different amounts of cold air to be adjusted at different temperatures, respectively.

The cold air guided to the flow path opening/closing module 130 may be branched from the first storage chamber flow path opening/closing damper 140 and the second storage chamber flow path opening/closing damper 150 to be supplied to the first storage chamber 51*a* and the second storage chamber 51*b*, respectively.

In this instance, since the first storage chamber flow path opening/closing damper 140 overlaps more in the left-right direction with the freezing fan module 160 configured to blow cold air, the cold air blown by the freezing fan module 160 may be guided more toward the first storage chamber flow path opening/closing damper 140.

As described above, since the area of the freezing fan module 160 overlapping with the first storage chamber flow path opening/closing damper 140 is larger than the area thereof overlapping with the second storage chamber flow path opening/closing damper 150, it may be possible to induce a cold air flow capable of supplying more cold air to the second storage chamber 51*b* than the first storage chamber 51*a*.

A water discharge hole 129 configured to discharge a condensate generated by a temperature difference between the spaces may be further formed in a lower center region of the shroud 120.

The grill fan 110 disposed on the front surface of the shroud 120 may be coupled to the shroud 120, to accommodate the ice-making fan module 170, the freezing fan module 160 and the flow path opening/closing module 130.

A grill fan upper region outlet hole 111 may be formed in an upper center region of the grill fan 110 and configured to discharge the cold air blown by the freezing fan module 160 toward an upper front surface of the freezer compartment 52.

In this instance, some of the cold air blown by the ice-making fan module 170 may be discharged to the freezer compartment 52 through the grill fan upper region outlet hole 111.

A grill fan lower region outlet hole 112*a* may be formed in a lower center region of the grill fan 110 to discharge the cold air blown by the freezing fan module 160 toward a lower front surface of the freezer compartment 52.

The grill fan lower region outlet hole 112 may be provided with a first grill fan lower region outlet hole 112*a* and a pair of second grill fan lower region outlet holes 112*b* disposed on both lateral surfaces with respect to the first grill fan lower region outlet hole 112*a*.

The second grill fan lower region outlet hole 112*b* may guide the cold air discharged to the freezer compartment 52 to flow to the both lateral surfaces to uniformly circulate the overall region of the freezer compartment 52.

A pair of freezer compartment cold air returning guides 119 may be formed below the grill fan lower region outlet holes 112*a* and 112*b* to guide the returning cold air.

The cold air having circulated the ice-making chamber 22 and the cold air having circulated the freezer compartment 52 may return to the freezer compartment cold air returning guide 119 provided in the lower region of the freezer compartment 52 to be supplied to the evaporator 101.

The cold air blown by the freezing fan module 160 may be supplied to the ice-making chamber 22, the refrigerator compartment 51 including the first storage chamber 51*a* and the second storage chamber 51*b*, and the freezer compartment 52.

The cold air blown by the ice-making fan module 170 may be supplied to the ice-making chamber 22 and the freezer compartment 52.

Accordingly, the refrigerator 1 according to the present disclosure may supply cold air all of the refrigerator compartment 51, the freezer compartment 52 and the ice-making chamber 22 by using one evaporator 101 and one grill fan assembly 100.

The refrigerator 1 may adjust the cold air supplied to the refrigerator compartment 51 by using the flow path opening/closing module 130 provided in the grill fan assembly 100, thereby providing a new cold air supply system.

If the flow path opening/closing module 130 is disposed in the refrigerator compartment 51, not the freezer compartment 52, the inner volume of the refrigerator compartment 51 may be reduced as much as the space occupied by the flow path opening/closing module 130.

According to the present disclosure, since the flow path opening/closing module 130 for selectively cutting off the cold air supplied to the refrigerator compartment 51 is provided in the grill fan assembly 100 blowing the cold air generated by one evaporator 101 to the refrigerator compartment 51 and the freezer compartment 52, there may be no need of securing an additional separate space for the flow path opening/closing module 130 in the refrigerator compartment 51.

Accordingly, the refrigerator 1 may provide a new cold air supply system capable of enhancing capacity competitiveness of the refrigerator 1.

The refrigerator 1 having the new cold air supply system capable of enhancing the capacity competitiveness may include one grill fan assembly 100 disposed in the freezer compartment 52 and configured to supply cold air to all of the ice-making chamber 22, the refrigerator compartment 51 and the freezer compartment 52, and two flow path opening/closing dampers 140 and 150 configured to selectively cut off the cold air supplied to the refrigerator compartment 51 as one embodiment. However, embodiments of the present disclosure are not limited thereto.

For example, referring to FIGS. 25, 26A and 26B, one grill fan assembly 100 may be configured to supply cold air to the ice-making chamber 22, the refrigerator compartment 51 and the freezer compartment 52, and may include one flow path opening/closing damper 140 configured to selectively cut off the cold air supplied to the refrigerator compartment 51.

Specifically, the grill fan assembly 100 according to another embodiment may include the ice-making fan module 170, the freezing fan module 160 and one refrigerator compartment flow path opening/closing damper 140 that are provided between the shroud and the grill fan 110.

The freezing fan module 160 may be disposed in the first inlet hole 121*a*, and the ice-making fan module 170 may be disposed in the second inlet hole 121*b* of the shroud 120.

The refrigerator compartment flow path opening/closing damper 140 may be covered by the first damper cover 131*a* and the second damper cover 131*b*.

An ice-making chamber cold air outlet guide 173 including an ice-making chamber outlet hole 172 may be disposed on the ice-making fan module 170 and configured to guide the cold air supplied in communication with the ice-making chamber cold air supply duct 600.

A refrigerator compartment cold air outlet guide 133 may be disposed on the refrigerator compartment flow path opening/closing module 130 including the refrigerator compartment flow path opening/closing damper 140, the first damper cover 131*a* and the second damper cover 131*b*, and may be configured to guide the cold air supplied in communication with the connection duct 200.

For example, referring to FIGS. 25, 27A and 27B, one grill fan assembly 100 may be configured to supply cold air to the refrigerator compartment 51 and the freezer compartment 52, and may include one flow path opening/closing damper 140 configured to selectively cut off the cold air supplied to the refrigerator compartment 51.

Specifically, the grill fan assembly 100 according to this embodiment may include a flow path cut-off member 180 disposed between the shroud 120 and the grill fan 110, and one refrigerator compartment flow path opening/closing damper 140.

The freezing fan module 160 may be disposed in the first inlet hole 121*a* of the shroud 120 and the flow path cut-off member 180 may be disposed in the second inlet hole 121*b* of the shroud 120.

The flow path cut-off member 180 may have a shape capable of cutting off the cold air supplied to the second inlet hole 121*b*.

Since the flow path cut-off member 180 is disposed at a position where the ice-making fan module 170 is provided, the cold air may be prevented from leaking through the ice-making chamber cold air outlet guide 173.

Accordingly, in case of a refrigerator model without the ice-making chamber 22, the grill fan assembly 100 may be used without a separate shape change only by simply installing the flow path cut-off member 180, thereby enhancing assembly process efficiency.

The refrigerator compartment flow path opening/closing damper 140 may be covered by the first damper cover 131*a* and the second damper cover 131*b*.

A refrigerator compartment cold air outlet hole guide 133 including a refrigerator compartment cold air outlet hole 132 may be disposed on the refrigerator compartment flow path opening/closing module 130 including the refrigerator compartment flow path opening/closing damper 140, the first damper cover 131*a* and the second damper cover 131*b*, and may be configured to guide the cold air in communication with the connection duct 200.

According to the present disclosure, since the flow path opening/closing damper 140 configured to selectively cut off the cold air supplied to the refrigerator compartment 51 is provided in the grill fan assembly 100 configured to blow the cold air generated by one evaporator 101 to the refrigerator compartment 51 and the freezer compartment 52, there may be no need of securing an additional separate space for the flow path opening/closing module 130 in the refrigerator compartment 51.

Accordingly, the refrigerator 1 may provide a new cold air supply system capable of enhancing capacity competitiveness of the refrigerator 1.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A refrigerator comprising:

an inner case comprising (i) a refrigerating case that defines a refrigerator compartment and (ii) a freezing case that defines a freezer compartment;

an outer case disposed outside the inner case;

a connection duct disposed between the inner case and the outer case; and a refrigerator compartment cold air supply duct that is detachably coupled to a rear inner surface of the refrigerating case and in fluid communication with the connection duct, wherein the connection duct and the refrigerator compartment cold air supply duct define a cold air flow path extending in an up-down direction, wherein an upper surface of the connection duct is coupled to and faces a lower surface of the refrigerator compartment cold air supply duct, wherein the upper surface of the connection duct and the lower surface of the refrigerator compartment cold air supply duct are inclined with respect to a surface of the refrigerator compartment, wherein the refrigerating case defines a duct inserting groove at an upper surface of the refrigerating case, and wherein an upper area of the refrigerator compartment cold air supply duct is inserted in and coupled to the duct inserting groove.

2. The refrigerator of claim 1, further comprising an insulating material that is disposed between the inner case and the outer case and in direct contact with the connection duct.

3. The refrigerator of claim 1, wherein the cold air flow path has a linear shape.

4. The refrigerator of claim 1, wherein a portion of a front surface of the refrigerator compartment cold air supply duct is parallel to a portion of a front surface of the connection duct.

5. The refrigerator of claim 1, wherein the inner case has a refrigerator compartment cold air supply communication hole that is defined at a rear surface of the inner case and open upward.

6. The refrigerator of claim 5, wherein the refrigerating case comprises a rear projected portion that protrudes from a rear surface of the refrigerating case toward an inside of the refrigerating case, and wherein the refrigerator compartment cold air supply communication hole is defined at an upper surface of the rear projected portion.

7. The refrigerator of claim 6, wherein at least a portion of the connection duct is inserted in the rear projected portion from an outer surface of the refrigerating case.

8. The refrigerator of claim 6, wherein the connection duct is coupled to the refrigerating case and supports a rear surface of the rear projected portion.

9. The refrigerator of claim 1, wherein the connection duct comprises a rear extended portion that extends vertically from a rear end of the upper surface of the connection duct, the rear extended portion being coupled to the refrigerating case and supporting a rear surface of the refrigerating case.

10. The refrigerator of claim 1, wherein the upper surface of the connection duct and the lower surface of the refrigerator compartment cold air supply duct are inclined in a direction descending toward a front surface of the refrigerator compartment, and wherein the upper surface of the connection duct and the lower surface of the refrigerator compartment cold air supply duct are coupled to each other by sliding on each other.

11. The refrigerator of claim 1, wherein the duct inserting groove extends along a boundary between the upper surface of the refrigerating case and a rear surface of the refrigerating case.

12. The refrigerator of claim 1, wherein the refrigerator compartment cold air supply duct comprises:

a duct insulating portion that defines the cold air flow path; and a duct sheet coupled to a rear side of the duct insulating portion and covers the cold air flow path, and wherein a thickness of the duct sheet is less than a thickness of the duct insulating portion.

13. The refrigerator of claim 1, wherein the connection duct has a first end connected to the freezer compartment and a second end connected to the refrigerator compartment, the connection duct passing through a center of the refrigerator compartment with respect to a left-right direction, and wherein a width of the cold air flow path increases from the first end to the second end of the connection duct.

14. The refrigerator of claim 1, further comprising:

a door configured to open and close at least a portion of the refrigerator compartment;

an ice-making chamber defined in the door; and an ice-making chamber cold air supply duct configured to supply cold air to the ice-making chamber, wherein the ice-making chamber cold air supply duct passes through a lateral surface of the refrigerator compartment.

15. The refrigerator of claim 14, wherein the refrigerator compartment cold air supply duct defines a first refrigerator compartment cold air flow path and a second refrigerator compartment cold air flow path that are configured to branch cold air from the connection duct, and wherein the first refrigerator compartment cold air flow path is wider than the second refrigerator compartment cold air flow path, and wherein the ice-making chamber cold air supply duct is disposed closer to the second refrigerator compartment cold air flow path than to the first refrigerator compartment cold air flow path.

16. The refrigerator of claim 14, further comprising:

a refrigerator compartment cold air returning duct configured to guide cold air discharged from the refrigerator compartment, the refrigerator compartment cold air returning duct having:

a first end that is connected to the refrigerator compartment and passes through a center of the refrigerator compartment with respect to a left-right direction, and a second end that is connected to the freezer compartment and passes through a center of the freezer compartment with respect to the left-right direction.

17. The refrigerator of claim 16, wherein the refrigerator compartment comprises a first storage chamber and a second storage chamber, and wherein the refrigerator further comprises a storage chamber cold air supply duct disposed at an outer surface of the refrigerating case and configured to supply cold air to the second storage chamber, wherein the connection duct and the storage chamber cold air supply duct are disposed at a first side of the refrigerator compartment cold air returning duct with respect to the left-right direction, and wherein the ice-making chamber cold air supply duct is disposed at a second side of the refrigerator compartment cold air returning duct with respect to the left-right direction.

18. The refrigerator of claim 17, further comprising an insulating material that is disposed between the inner case and the outer case and in direct contact with the storage chamber cold air supply duct.

19. The refrigerator of claim 17, further comprising:

a first storage chamber flow path damper that is disposed in the freezer compartment and configured to selectively block cold air from being supplied to the connection duct; and a second storage chamber flow path damper that is disposed in the freezer compartment and configured to selectively block cold air from being supplied to the storage chamber cold air supply duct.

20. The refrigerator of claim 1, wherein the refrigerator compartment cold air supply duct defines:

a refrigerator compartment cold air main outlet hole configured to discharge cold air to the refrigerator compartment; and a refrigerator compartment cold air auxiliary outlet hole, and wherein the refrigerator compartment cold air supply duct comprises:

a refrigerator compartment cold air auxiliary outlet guide disposed at a front side of the refrigerator compartment cold air auxiliary outlet hole, and a refrigerator compartment filter disposed at the refrigerator compartment cold air auxiliary outlet guide and configured to filter cold air supplied through the refrigerator compartment cold air auxiliary outlet hole.

21. The refrigerator of claim 20, wherein the refrigerator compartment cold air auxiliary outlet guide comprises an insulating member spaced apart from a front surface of the refrigerator compartment filter, and wherein the refrigerator compartment cold air auxiliary outlet guide is configured to guide the cold air having passed through the refrigerator compartment filter to be discharged downward to the refrigerator compartment through a space defined between the insulating member and the refrigerator compartment filter.

22. The refrigerator of claim 16, further comprising a returning duct filter disposed inside the refrigerator compartment cold air returning duct and configured to filter cold air guided by the refrigerator compartment cold air returning duct.

23. The refrigerator of claim 1, wherein an upper end of the upper surface of the connection duct extends upward and is attached to a rear surface of the refrigerator compartment cold air supply duct, wherein a lower end of the upper surface of the connection duct extends downward and is located forward relative to the upper end of the upper surface of the connection duct, and wherein the upper surface of the connection duct and the lower surface of the refrigerator compartment cold air supply duct are inclined with respect to the rear surface of the refrigerator compartment cold air supply duct and extend downward and forward toward a front surface of the refrigerator compartment.

24. The refrigerator of claim 1, wherein the duct inserting groove is disposed adjacent to a ceiling of the refrigerator compartment.

* * * * *